US005627334A

United States Patent [19]

Hirano et al.

[11] Patent Number: 5,627,334

[45] Date of Patent: May 6, 1997

[54] APPARATUS FOR AND METHOD OF GENERATING MUSICAL TONES

[75] Inventors: Sayoko Hirano; Yutaka Washiyama, both of Hamamatsu, Japan

[73] Assignee: Kawai Musical Inst. Mfg. Co., Ltd., Shizuoka-ken, Japan

[21] Appl. No.: 394,279

[22] Filed: Feb. 24, 1995

Related U.S. Application Data

[63] Continuation-in-part of Ser. No. 312,612, Sep. 27, 1994.

[30] Foreign Application Priority Data

| | | | |
|---|---|---|---|
| Sep. 27, 1993 | [JP] | Japan | 5-239669 |
| Feb. 24, 1994 | [JP] | Japan | 6-027041 |
| Mar. 10, 1994 | [JP] | Japan | 6-040182 |
| Mar. 10, 1994 | [JP] | Japan | 6-040185 |

[51] Int. Cl.[6] ..... G10H 7/00

[52] U.S. Cl. ..... 84/623; 84/659

[58] Field of Search ..... 84/602, 603, 604, 84/623, 625, 607, 627–659, 661, 624

[56] References Cited

U.S. PATENT DOCUMENTS

| | | | |
|---|---|---|---|
| 5,138,927 | 8/1992 | Nishimoto | 84/624 |
| 5,412,152 | 5/1995 | Kageyama et al. | 84/607 |
| 5,536,902 | 7/1996 | Serra et al. | 84/623 |

*Primary Examiner*—William M. Shoop, Jr.
*Assistant Examiner*—Marlon Fletcher

[57] ABSTRACT

The content of component waveforms of at least one signal is changed in a variety of ways among the formant center signals that are synthesized with the formant waveform signals, making it possible to arbitrarily change the waveform of a musical tone that is generated. To cope with changes in the formant waveform signals Ffj(t) or the formant carrier signals Gj(t) formed by synthesizing the component waveforms, furthermore, the signals Fj(t) and Gj(t) are weighed and interpolated. This permits the signals Fj(t) and Gj(t) to change smoothly. Moreover, the number or combination of formant waveform signals synthesized to produce a musical tone is controlled depending upon the musical factors, elapsed time of sounding, envelope levels, envelope phases and/or settings instructed by an operator. This enables the form of the synthesized formant to be changed and the content of a musical tone that is generated to he changed in a variety of ways.

48 Claims, 31 Drawing Sheets

LINEAR OPE.

$Val_j += Val_j \pm SP_j$

EXPONENTIAL OPE.

$Val_j += (O_j - Val_j) \times SP_j + Val_j$

| U/D | ΔSB | OPE. FORMULA Σωf | GATE OUTPUT cont.(515) |
|---|---|---|---|
| 0 | 1 | Ea+Δ | 0 |
| 0 | 0 | Ea−Δ | 1 |
| 1 | 0 | Ta+Δ | 0 |
| 1 | 1 | Ta−Δ | 1 |

FIG. 18

211

HARMONICS WAVE MEM.

ELAPSED TIME OF SOUNDING (ENVELOPE LEVEL/PHASE) ⟶

MUSICAL FACTORS ⟶

| | | | | |
|---|---|---|---|---|
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcjk(t)… ajk(t)… cj(t) | …… | ωcjk(t)… ajk(t)… cj(t) |
| ωcjk(t)… ajk(t)… cj(t) | ωcjk(t)… ajk(t)… cj(t) | ωcj1(t) ωcj2(t) | aj1(t) aj2(t) | cj(t) k(t)… (t)… cj(t) |
| ωcjk(t)… ajk(t)… cj(t) | ωcjk(t)… ajk(t)… cj(t) | ωcj3(t) ⋮ | aj3(t) ⋮ | ωcjk(t)… ajk(t)… cj(t) |
| ⋮ | ⋮ | ωcjk(t) ⋮ | ajk(t) ⋮ | ⋮ |
| ωcjk(t)… ajk(t)… cj(t) | ωcjk(t)… ajk(t)… cj(t) | ωcjn(t) cj(t) | ajn(t) …… | ωcjk(t)… ajk(t)… cj(t) |

FIG. 25

212

| TABLE OF FRT. FORMS | | | | | |
|---|---|---|---|---|---|
| | ELAPSED TIME OF SOUNDING (ENVELOPE LEVEL/PHASE) → | | | | |
| MUSICAL FACTORS ↓ | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |
| | ⋮<br>⋮<br>⋮ | ⋮<br>⋮<br>⋮ | ⋮<br>⋮<br>⋮ | ⋮<br>⋮<br>⋮ | ⋮<br>⋮<br>⋮ |
| | ωfj (t)<br>Ta, Ea<br>SP, O, Min | ωfj (t)<br>Ta, Ea<br>SP, O, Min | ωfj (t)<br>Ta, Ea<br>SP, O, Min | ……<br>……<br>…… | ωfj (t)<br>Ta, Ea<br>SP, O, Min |

APPARATUS FOR AND METHOD OF GENERATING MUSICAL TONES

This is a continuation-in-part of application Ser. No. 08/312,612 filed on Sep. 27, 1994, the entire contents of which are incorporated herein by reference.

BACKGROUND OF THE INVENTION

1. Field of the Invention

This invention relates to an apparatus for, and a method of generating musical tones, and more particularly, to the generation of formant waveform signals having waveforms obtained by synthesizing frequency components corresponding to specific formants of musical tones.

2. Description of the Related Art

In the field of musical tone generation apparatus and method, there has seldom been an apparatus for performing control concerning formant. However, there has been an apparatus, in which formant waveform signals obtained by synthesizing frequency components in a specific frequency band corresponding to specific formants are stored in a memory and read out by supplying read address data thereto.

Such apparatus, however, permits the only formant waveform signals to be merely read out and cannot change contents of the musical tones. For example when a designated tone pitch is changed, the increment rate of the read address data is changed. In this way, it is possible to generate a formant waveform signal corresponding to the tone pitch. However, the width and the density of frequency components of the formant of the formant waveform signal are changed in proportion to the change in the tone pitch. While there is no problem where such proportional changes are permissible, there are many cases where such changes are not permissible or changes other than the proportional ones are required. Therefore, it has been impossible to generate formant waveform signals, in which the density of the formant frequency components has no bearing on the tone pitch changes.

SUMMARY OF THE INVENTION

The present invention was accomplished in order to solve the above-mentioned problems, and its object is to arbitrarily change the contents of formant waveform signals irrespective of changes in the tone pitch or the like.

According to a first embodiment of the present invention, component waveforms of a musical tone are generated and upon which are operated amplitude coefficients that are generated, the thus operated component waveforms are synthesized to form formant center signals relative to each other, and the thus synthesized formant center signals are synthesized with formant waveform signals having a waveform obtained by synthesizing frequency components of particular formants. This makes it possible to control the frequency of formant waveform signals and to control the frequency of formant center signals separately and independently from each other, enabling the contents of musical tones that are generated to be changed in a variety of ways.

According to a second embodiment of the present invention, a formant waveform signal formed and a formant center signal are further synthesized together, the synthesized content of components of either one of these signals is changed depending upon a change in the musical factors and the like, the two output signals before and after the change are weighed, the two output signals are interpolated based on the two output signals that are thus weighed, and the weighing is changed from one side to the other side from the start of the section of interpolation toward the end thereof. This makes it possible to control the frequency of formant waveform signals and to control the frequency of formant center signals separately and independently from each other, and a change in the content of musical tones generated by interpolation is smoothed.

According to a third embodiment of the present invention, a plurality of formant waveform signals and a plurality of formant center signals are generated and are synthesized together, the number or combination of the formant waveform signals are determined depending upon the musical factors that are generated, and the number or combination of the formant waveform signals is controlled depending upon the number.

According to a fourth embodiment of the present invention, either the formant center signals or the formant waveform signals are additionally or multiplicationally synthesized, the thus synthesized signals are further additionally synthesized, or the thus synthesized signals and the formant center signals or the formant waveform signals are additionally or multiplicationally synthesized together. This makes it possible to control the frequency of formant waveform signals and to control the frequency of formant center signals separately and independently from each other. Besides, the content of musical tones that are generated can be changed in a variety of ways by controlling the number or combination of formant waveform signals or by additionally or multiplicationally synthesizing the formant center signals and the formant waveform signals together in a multiplexed manner.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein:

FIG. 18 is a diagram showing a harmonic wave memory 211 in a program/data storage unit 21;

FIG. 25 is a diagram showing a formant form table 212 in the program/data storage unit 21;

DETAILED DESCRIPTION OF THE PREFERRED EMBODIMENTS

Summary of the Embodiment

Figure 1:
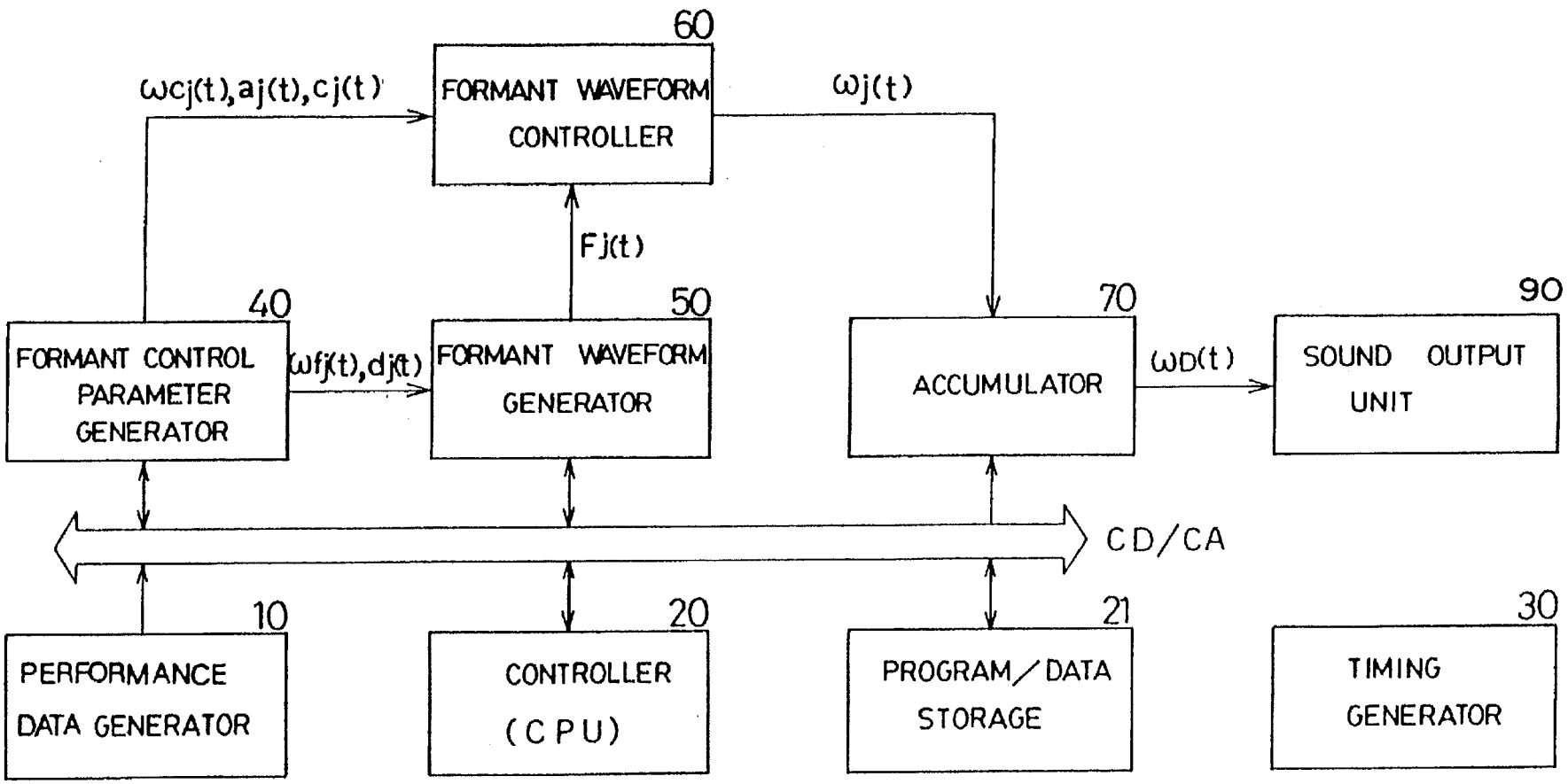
FIG. 1 is a block diagram showing a musical tone generation apparatus.

Component waveforms (cosine waves) of formant carrier signals are read out from a trigonometric function table 63 at a frequency corresponding to formant carrier parameters ωcjk(t), sent to a multiplier 64 where their amplitudes are adjusted into magnitudes corresponding to formant carrier level parameters ajk(t), sent to an adder 65 where they are added together and where direct current components corresponding to formant carrier bias parameters cj(t) are added thereto, and are then sent to a multiplier 66 where they are multiplied by formant waveform signals Fj(t). The component waveforms (cosine waves) can be also generated even in the component waveforms of the formant waveform signals Fj(t).

Formant waveform signals Ffj(t) of before changed read out from the synthesized waveform memories 802*a* to 802*d* are multiplied in a multiplier 804*a* by a weight data WT1, formant waveform signals Ffj(t) of after changed read out from the synthesized waveform memories 802*a* to 802*d* are multiplied in a multiplier 804*b* by a weight data WT2, and these multiplied signals are added up together and are interpolated through an adder 805. One of the weight data WT1 and WT2 changes from "0" into "1", whereby the weight is shifted, and the interpolated signal is shifted from the one to the other.

The outputs of the multipliers 632... are fed back to other multipliers 632... or the same multipliers 632... through AND gate group 638..., are input to an adder 634 through AND gate group 639..., and are input to adder 631... and multipliers 632... of other multiple synthesis devices 635 through AND gates 640... The enable/inhibit of the AND gate group 639... vary depending upon the musical factors, lapse of times from the start of sounding, envelope levels, envelope phases and/or instructions by an operator. This causes a change in the multiple synthesis course, i.e., in the algorithm of synthesis operation and further causes a change in the combination of formant signals Gj(t) and Fj(t) that are synthesized.

1. Overall Circuitry

FIG. 1 shows the overall circuitry of the musical tone generation apparatus. A performance data generator 10 generates tone pitch data and other performance data. The performance data generator 10 is a sounding designation unit for playing music by manual operation, an auto play unit or an interface. Among the performance data that are generated by the performance data generator 10 are musical factor data, for example tone pitch data (tone pitch range data (upper keyboard, lower keyboard and pedal keyboard)), data of time elapsed from the start of sounding, performance part data, musical tone part data, musical instrument part data and other data. As the sounding designation unit is used keyboard instruments, string instruments, wind instruments, percussion instruments, computer keyboards, etc. The auto play unit automatically reproduces stored performance data. The interface is a MIDI (musical instrument digital interface) or the like which receives performance data from a unit connected to the interface or sends performance data to the connected unit. The performance data generator 10 has various switches, such as timbre tablets, effect switches, rhythm switches, pedals, wheels, levers, dials, handles, touch switches. etc. which are for musical instruments. From these various switches musical factor data are input. Among the musical factor data are timbre data, touch data (indicative of the speed/strength of sound designation operation), effect data. rhythm data, stereo data, quantization data, modulation data, tempo data, volume data, envelope data, data of time elapsed from the start of sounding, etc.

These musical factor data are included in the performance data and are input from the various switches noted above. Further, these musical factor data are contained in the auto performance data or in performance data that are transmitted or received via the interface. The touch switches are provided in one-to-one correspondence to sounding designation units, and the touch switches generate initial touch data and after-touch data indicative of the speed and strength of touch. The timbre data correspond to tones of musical instruments such as keyboard instruments (e.g., piano), wind instruments (e.g., flute), string instruments (e.g., violin), percussion instruments (e.g., drums), etc. The envelope data are envelope level data, envelope phase data, etc. The performance part data, musical tone part data and musical instrument part data correspond to, for instance, melody, accompaniment, chord, base, etc. and also correspond to upper keyboard, lower keyboard, foot keyboard, etc. These musical factor data are supplied to controller 20 for the switching of various signals, data and parameters as will be described later.

The performance data are processed in the controller 20, and various data thus produced are fed to a formant control parameter generator 40, a formant waveform generator 50 and an accumulator 70 to generate formant synthesis signal Wj(t). The controller 20 is constituted by a CPU etc. A program/data storage 21 is constituted by such storage units as ROM and RAM. In the program/data storage 21 are stored programs for various processes which are executed by the controller 20 as well as the various data noted above and various other data. Among the various data are those necessary for time division processes and those for assignment of time division channels.

The formant synthesis signal Wj(t) is generated on a time division basis through the formant control parameter generator 40, formant waveform generator 50 and formant waveform controller 60. In Wj(t), "j" indicates the division order of time division process or channel number. The formant control parameter generator 40 can generate various parameters, i.e., formant control parameters ωcj(t), ωfj(t), aj(t), cj(t), dj(t), etc., which are necessary for generating the formant synthesis signal ωj(t).

These parameters will be described later in detail. Through the formant waveform generator 50 and formant waveform controller 60, formant synthesis signal Wj(t) is read out, generated and synthesized according to the formant control parameter input. The formant synthesis signal Wj(t) is accumulated and synthesized for each group channel in the accumulator 70 to be output and sounded as musical tone from a sounding unit 90.

From a timing generator 30 timing control signals for synchronizing the entire circuitry of the musical tone generation apparatus are output to the individual circuits. Among the timing control signals are clock signals at various frequencies, the AND or OR of these clock signals, a signal at a frequency corresponding to the channel division time in the time division process, channel number data j, etc.

2. Formant Control Parameters and Formants

Figure 2:
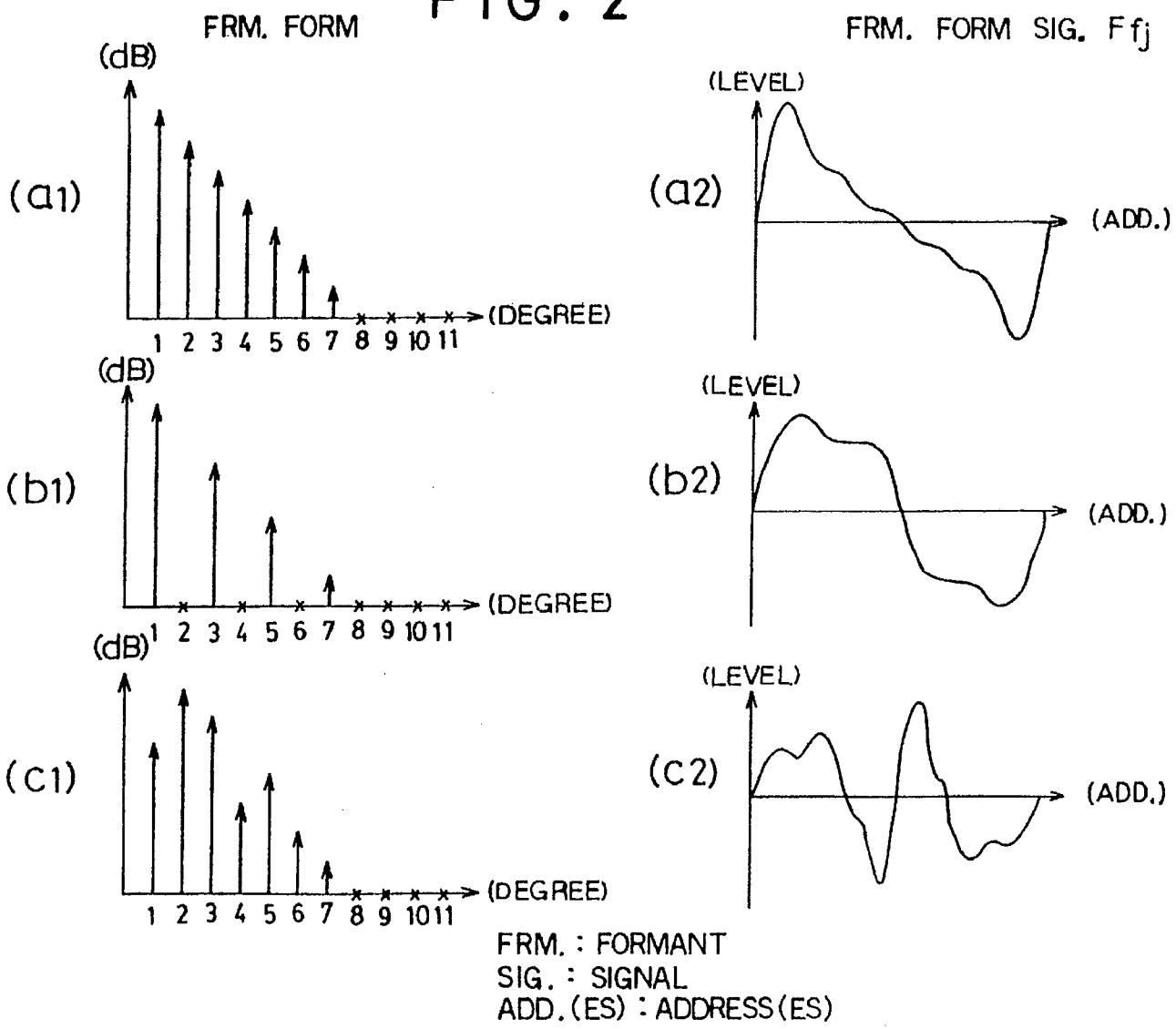
FIGS. 2(*a*1),(*a*2),(*b*1),(*b*2),(*c*1) and *c*(2) are views showing the correspondence between formant forms and formant waveform signals.
Figure 3:
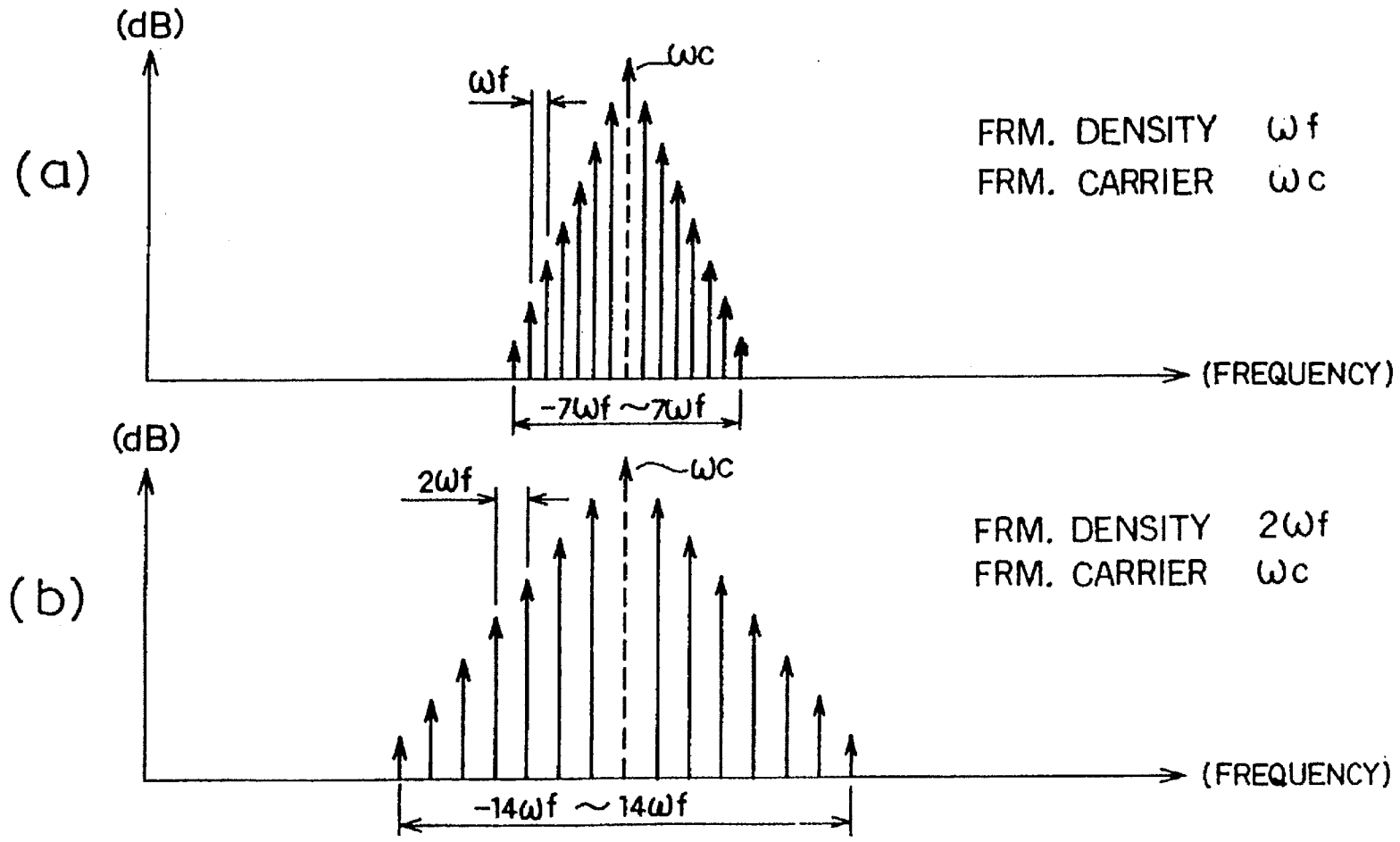
FIGS. 3(*a*) and (*b*) are views showing the relation between formant form and formant density parameter.
Figure 4:
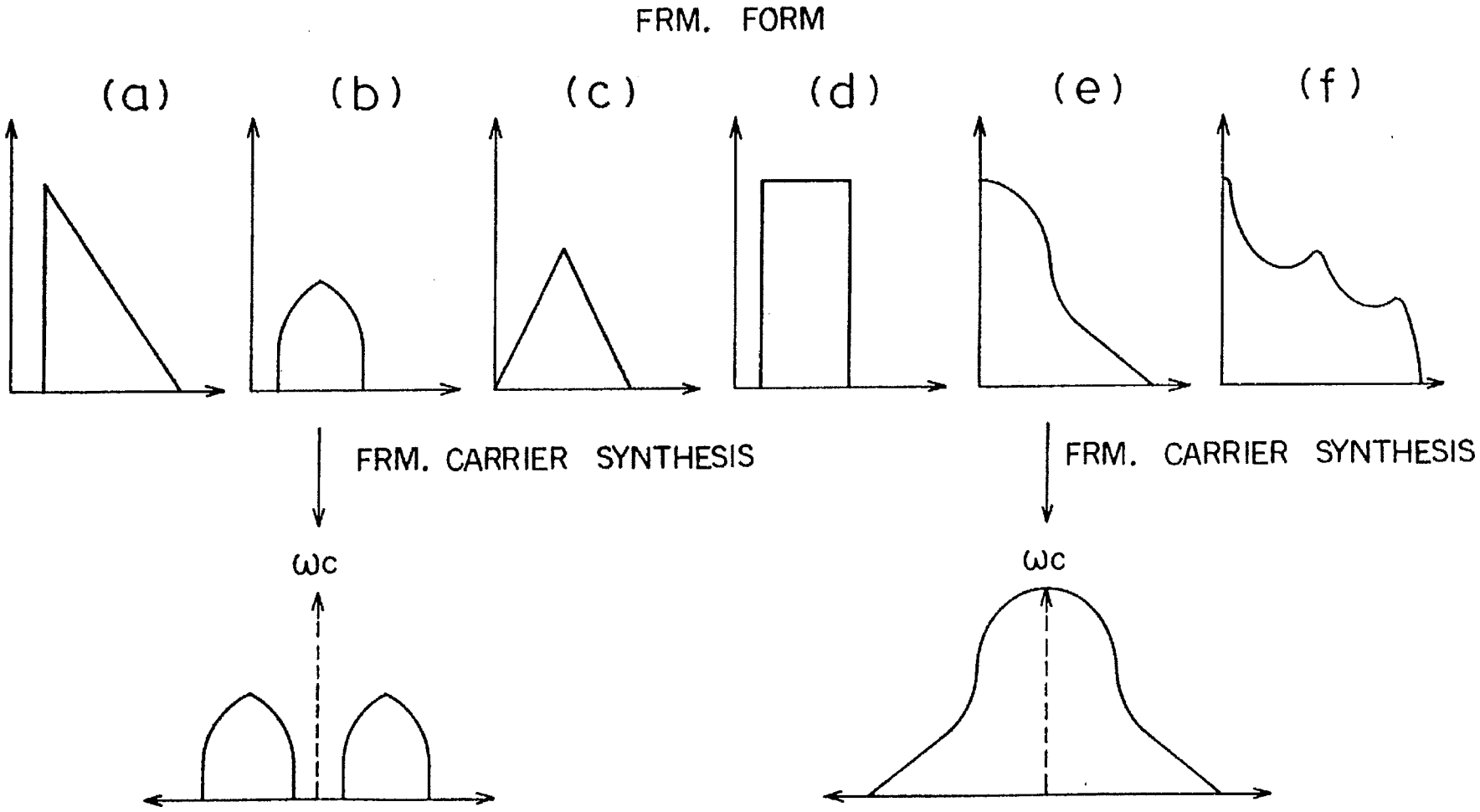
FIGS. 4(*a*),(*b*),(*c*),(*d*),(*e*) and (*f*) are views showing various formant forms.

FIGS. 2 to 4 show the relation between the formant control parameter noted above and formant. FIG. 2 shows simple examples of the correspondence between formant and formant waveform signal Ffj(t). Referring to FIG. 2, in (a1) it is shown that the levels of the first harmonics (fundmental wave), second harmonics, third harmonics, . . . , of frequency spectrum components are successively reduced with an equal difference. The formant form in (a1) is a half triangle form. Shown in (a2) is the waveform of the formant waveform signal Ffj(t) which is obtained as a result of synthesizing the frequency components in a specific frequency band corresponding to the formant of musical tone (of musical instruments) shown in (a1).

Shown in (b1) is a formant form which is obtained by selecting only the odd number ones of the frequency spectrum components shown in (a1). While this formant form is only half triangular the corresponding synthesized formant waveform signal Ffj(t) has a waveform as shown in (b2). Shown in (c1) is a formant form obtained by changing the levels of the orders of the frequency spectrum components in (a1). This formant form is a two-hill form, and the corresponding synthesized formant waveform signal Ffj(t) has a waveform as shown in (c2).

The illustrated formant waveform signals Ffj(t) are only examples, and it is possible to realize various formant waveform signals Ffj(t) by varying the formant form. Such various formant waveform signals Ffj(t) are stored in a formant waveform memory 53 which will be described later. The frequencies of the frequency spectrum components in (a1), (b1) and (c1) in FIG. 2 are in integral ratio relation to one another, but it is also possible to relate the frequencies in a non-integral ratio relation. Such non-integral ratio relation formant waveform signals Ffj(t) are also stored in the formant waveform memory 53.

In FIG. 3, shown in (a) are the frequency spectral components of a musical tone waveform obtained as a result of synthesis of the formant waveform Ffj(t) shown in FIG. 2(*a*2), on formant carrier signal cosine ωcj(t) as the formant center signal (fundamental wave). The formant waveform Ffj(t) is read out at a rate corresponding to formant density parameter ωfj(t), one of the formant control parameters. As the frequency spectrum of the resultant signal of synthesis of the formant waveform signal Ffj(t) on the formant carrier signal cosine ωc(t), the formant shown in (a1) in FIG. 2 is formed on both sides of formant carrier parameter ωc as the center. In this case the other formants except FIG. 2(*a*1) are formed, but are not shown in this FIG. 2. The formant carrier parameter ωc determines the frequency of the formant carrier signal (or formant center signal) cos ωc(t).

When the formant waveform signal Ffj(t) in (a2) in FIG. 2 is read out at a rate corresponding to the formant density parameter ωf, the formant has a width of +7ωf vertically as shown in (a) in FIG. 3. When the formant waveform signal Ffj(t) is read out at double the rate corresponding to the formant density parameter ωf, the width of the formant is spread to ±14 ωf vertically as shown in (b) in FIG. 3.

Thus, the formant density parameter ωf determines the width of the formant, i.e., the density of the frequency components of the formant. Further, a change in the value of the formant density parameter ωf causes the formant itself to slide along the frequency axis. Thus, the formant density parameter ωf further determines the position of the formant on the frequency axis.

FIG. 4 shows forms of formants corresponding to various formant waveform signals Ffj(t), the forms being half triangular, pot-like, triangular, rectangular, etc. There are various other forms such as half circular, hill-like, two-hill-like, etc. Further, there are composite formants consisting of pluralities of these (like) formants combined (synthesized) to be or not to be overlapped. By synthesizing such a formant waveform signal Ffj(t) on the formant carrier signal cosine ωc(t), a line symmetry format as shown in (b) in FIG. 4 is formed. Thus, with the same form of formant of the formant waveform signal Ffj(t), different formants are obtainable through synthesis on the formant carrier signal by shifting the formant along the frequency axis. Thus, it is possible to vary the character of musical tones that are output as a result of the synthesis.

To the formant waveform signal Ffj(t) is added formant waveform bias parameter dj(t). The signal after the addition is also called formant waveform signal Fj(t). The formant waveform bias parameter dj(t) is a factor which determines the level or bias of the formant waveform signal Ffj(t), and the strength of the formant is determined by the magnitude of the formant waveform bias parameter dj(t). The addition of the formant waveform bias parameter dj(t) may be replaced with multiplication thereby, with both the addition and multiplication or all kinds of calculations (1) which will be described later in detail. With multiplication synthesis of the formant waveform signal Fj(t) on the formant carrier signal cos ωc(t) as the formant center signal, a musical tone having the corresponding tone pitch can be realized. In this case, the formant waveform signal Fj(t) is synthesized not only as harmonic components but also as subharmonic components on the formant carrier signal cosine ωc(t), thus providing the synthesized musical tone with a spread.

When the formant density parameter ωfj(t) which determines the rate of reading of the formant waveform signal Fj(t) (formant waveform signal Ffj(t)) is changed according to the designated tone pitch, the formant waveform signal Fj(t) itself is changed to correspond to the tone pitch, but it is no longer possible to control the formant density of the formant waveform signal Fj(t) independently of the tone pitch. The multiplication of the formant carrier signal cos ωc(t) by the formant waveform signal Fj(t) may be replaced with addition, by both the addition and multiplication or all kinds of calculations (1) which will be described later in detail.

The formant carrier signal cos ωc(t) is multiplied by the formant carrier level parameter aj(t), and formant carrier bias parameter c(t) is added. The formant carrier level parameter aj(t) and formant carrier bias parameter cj(t) are factors which determine the level of the formant carrier signal cos ωc(t), a value of both parameters aj(t) and cj(t) determine a strength of the musical sound. The formant carrier level parameter aj(t) has the same character as amplitude modulation signal, and by varying the value of the formant carrier level parameter, aj(t), it is possible to obtain, in addition to the amplitude modulation effect, envelope control, stereo position control, measurement of the elapsed time from the start of sounding, etc.

The formant synthesis signal Wj(t) is expressed with the above formant control parameters ωcj(t), aj(t), cj(t) and dj(t) and the formant waveform signal Ffj(t) as follows.

$$Wj(t)=\{aj(t)\times\cos\omega cj(t)+cj(t)\}\times\{Fjf(t)+dj(t)$$

The formant carrier signal cosine ωc(t) may or may not be in accord with the formant center signal at the formant peak corresponding to the formant waveform signal Ffj(t). For example, the level of the formant carrier signal cosine ωc(t) is lower than the level at the formant peak point corresponding to the formant waveform signal Ffj(t). This can be attained by adequately selecting the values of the formant control parameters aj(t), cj(t) and dj(t).

3. Formant Control Parameter Generator 40

Figure 5:
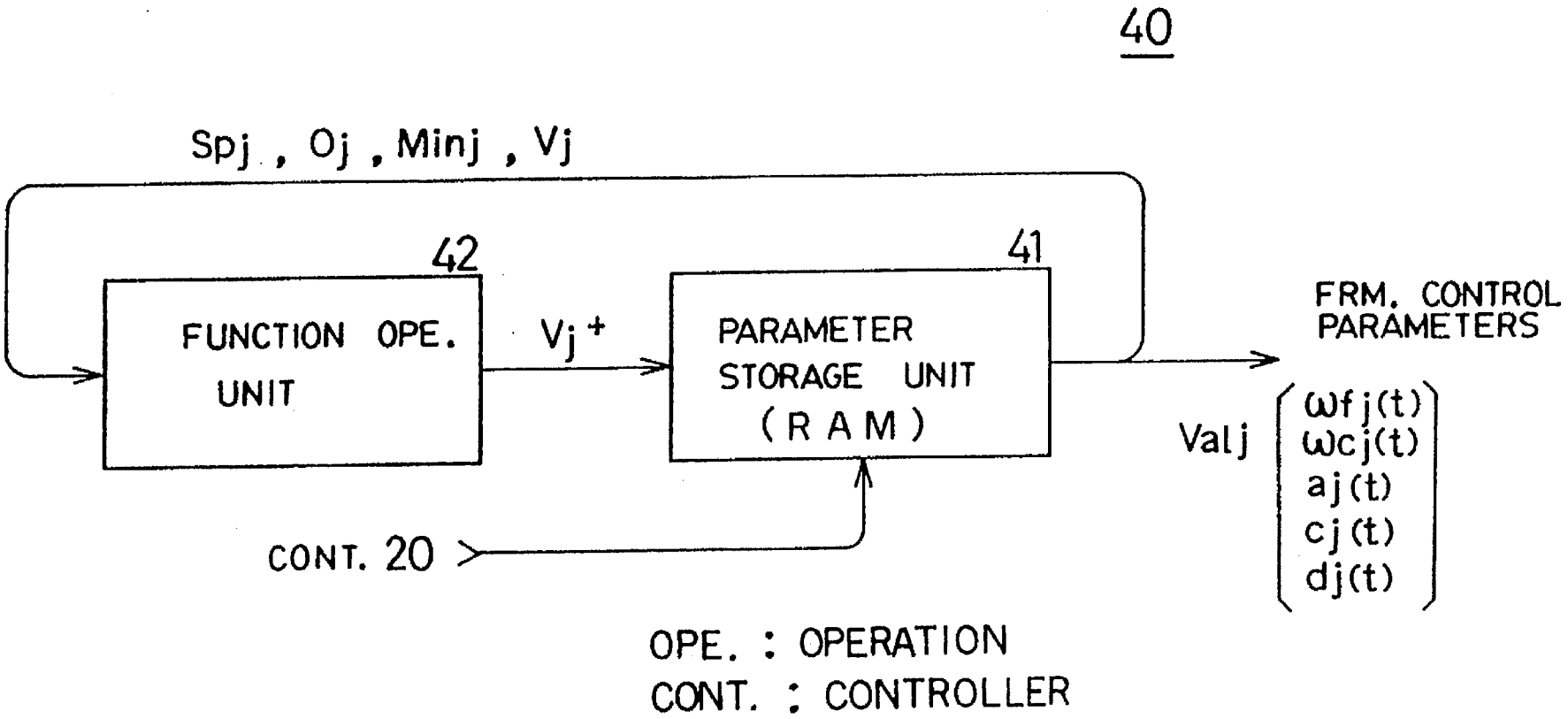
FIG. 5 is a circuit diagram showing a formant control parameter generator 40.

FIG. 5 shows the formant control parameter generator 40. Formant control parameters corresponding to the method of play as noted above, are written in the parameter storage 41 by the controller 20. Such formant control parameter are calculated (computed) and processed in the function operation unit 42, and the result is then written again in the parameter storage 41. In this way, the formant control parameters ωfj(t), ωaj(t), aj(t), cj(t), and dj(t) are updated.

Actually, there are provided five formant control parameter generators 40 for operation on the formant density parameter ωfj(t), formant carrier parameter ωcj(t), formant carrier level parameter aj(t), formant waveform bias parameter dj(t) and formant carrier bias parameter cj(t), respectively. Thus, the formant control parameters ωfj(t), ωcj(t), aj(t), cj(t) and dj(t) can be generated as parallel data.

4. Parameter Storage 41

Figure 6:
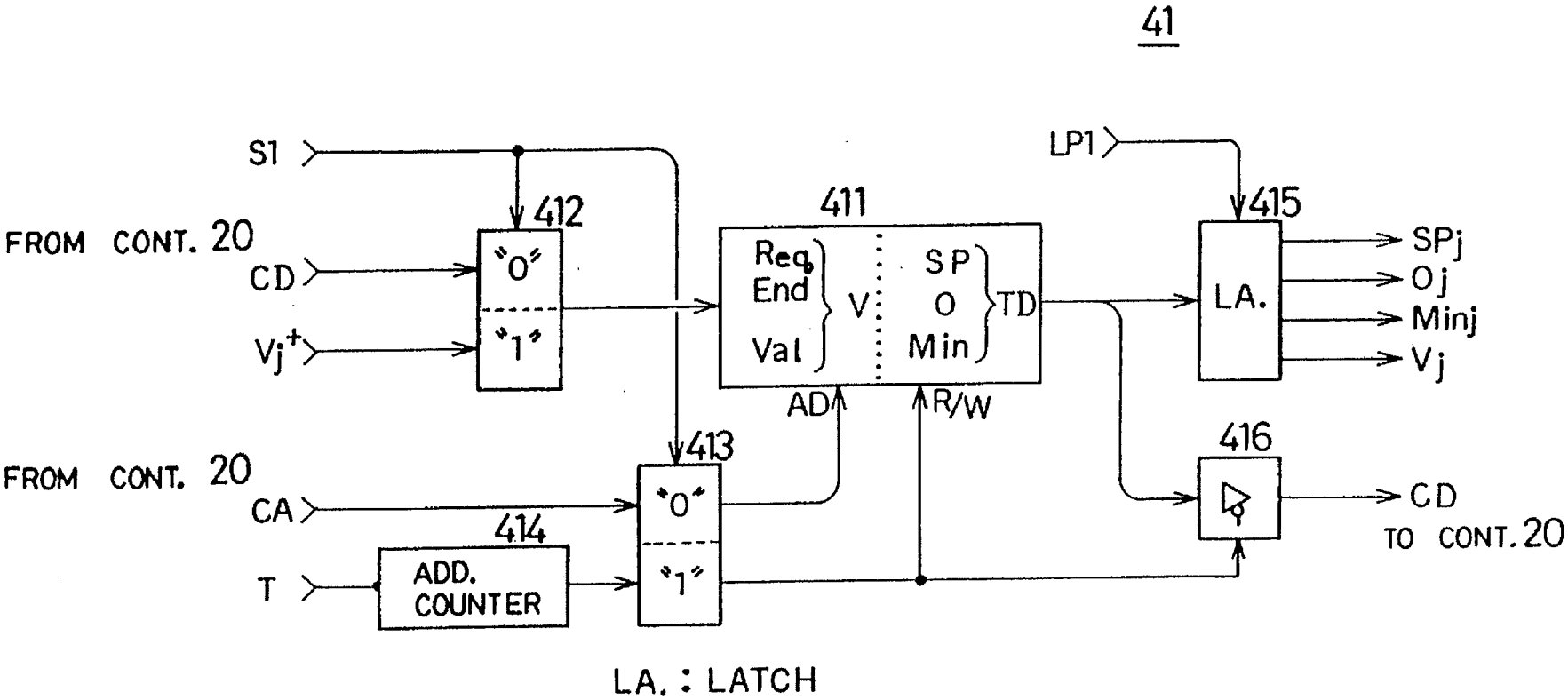
FIG. 6 is a circuit diagram showing a parameter storage 41.

FIG. 6 shows the parameter storage 41. Again there are provided five parameter storages 41 for the respective formant control parameters ωfj(t), ωcj(t), aj(t), cj(t) and dj(t). In the following description only one of the five parameter storages 41 and the formant control parameter Valj(Vj) will be explained.

Formant control parameter CD is fed from the controller 20 through a selector 412 to be written in a parameter memory 411. This writing is done, for instance, at the time of the start of sounding, i.e., at the time of the generation of an event signal for the sounding operation, or at the time of channel assignment to the musical tone to be sounded. This formant control parameter CD is written as formant control parameter TD, and the formant control parameter TD includes speed data SP, objective data O and mini data Min.

The speed data SP indicates the formant control parameter operation speed, i.e., operation step value. The objective data indicates the objective value of the operation. The mini data Min indicates a value which is to be subtracted from the objective data O to obtain data right before the objective data O. The controller 20 selects the speed data SP, objective data O and mini data Min according to the musical factor data indicative of the timbre, touch, tone pitch range, etc. input from the performance data generator 10, elapsed time from the start of sounding, envelope level, envelope phase, etc. to be described later, input data or select data by operator, etc. These speed data SP, objective data O and mini data Min may be input from the performance data generator 10 by the operator.

Thus, the program/data storage 21 has a corresponding table between the musical factor data, elapsed time from the start of sounding, envelope level or envelope phase, and the speed data SP, objective data O, mini data Min, etc. In this table, data is stored as multiple data corresponding to the musical factor. For example, the data SP, O and Min are stored for each of a plurality of timbres. Of these data, those for one timbre are stored for a plurality of musical instrument parts (tone pitch ranges). Of these data, those for one musical instrument part (tone pitch range) are stored for each touch. Of these data, those for one touch are stored for each elapsed time from the start of sounding, envelope level or envelope phase, and so forth.

Thus, the formant control parameters Valj (fj(t), ωcj(t), aj(t), cj(t) and dj(t)) are changed according to the musical factor data such as the timbre, touch, tone pitch range, etc., elapsed time from the start of sounding, envelope level, envelope phase or input data or select data by operator.

In this case, as for the musical factors the formant control parameter Valj, time count data, etc. which is changed according to the envelope data or elapsed time is synthesized by all kinds of calculations (1) which will be described later in detail. It is possible to omit the storage of data for each elapsed time from the start of sounding or each envelope level, and instead modify for synthesis the elapsed time from the start of sounding of envelope level with respect to each of the date SP, O and Min. The modification synthesis is based on all kinds of calculations (1) which will be described later in detail, and an operation (computation) device for the modification synthesis of the elapsed time from the sounding start or envelope level is provided at the output terminal of the parameter storage 41 or the output terminal of the function operation unit 42 shown in FIG. 5.

In the parameter memory 411 formant control parameter V is further stored. This formant control parameter V is obtained as a result of processing the torment control parameter TD in the function operation unit 42, and the formant control parameter V includes parameter value Val, request data Req and end data End.

The parameter value Val is a value of each formant control parameter as calculated in the above operation. The request data Req is to request the connnencement of the next operation after the reaching of the objective value by the calculated value. The end data End indicates the end of all the operations with the parameter value Val brought to "0".

The above formant control parameters TD (SP, O and Min) and V are stored in sets corresponding in number to the number of the time division channels in the parameter memory 411. The j-th channel formant control parameters SPj, Oj, Minj and Vj are supplied via latch 415 to the function operation unit 42 for operation, and the results are written again as formant control parameters Vj+ in the parameter memory 411 via a selector 412.

The formant control parameters Req and End in the parameter memory 411 are supplied through a tri-state buffer 416 to the controller 20 for the request of formant control parameters TD (SP, O and Min) necessary for the next operation. Thus, the controller 20 counts the envelope phases for each musical tone. In this case, at the time of the channel assignment to a new musical tone, the envelope phase is cleared, and the request data Req Is incremented by "+1" whenever it is supplied to the controller 20. According to such envelope phase. the controller 20 executes switching of various signals. data and parameters as described above or to be described later.

Address data and read/write signal R/W in the parameter memory 411 are supplied from the controller 20 through a selector 413 to the parameter memory 411 and also supplied from an address counter 414 through the selector 413 to the parameter memory 414. The read/write signal R/W is further supplied as a set signal to the tri-state buffer 416.

To the selectors 412 and 413 a select signal S1 is supplied to switch data to be selected. To the latch 415 a latch signal LP1 is supplied. The period of the latch signal LP1 is equal to the channel division time. The latch signal LP1, select signal S1 and count signal T of the address counter 414 are supplied from the timing generator 30.

5. Operation of Parameter Storage 41

Figure 7:
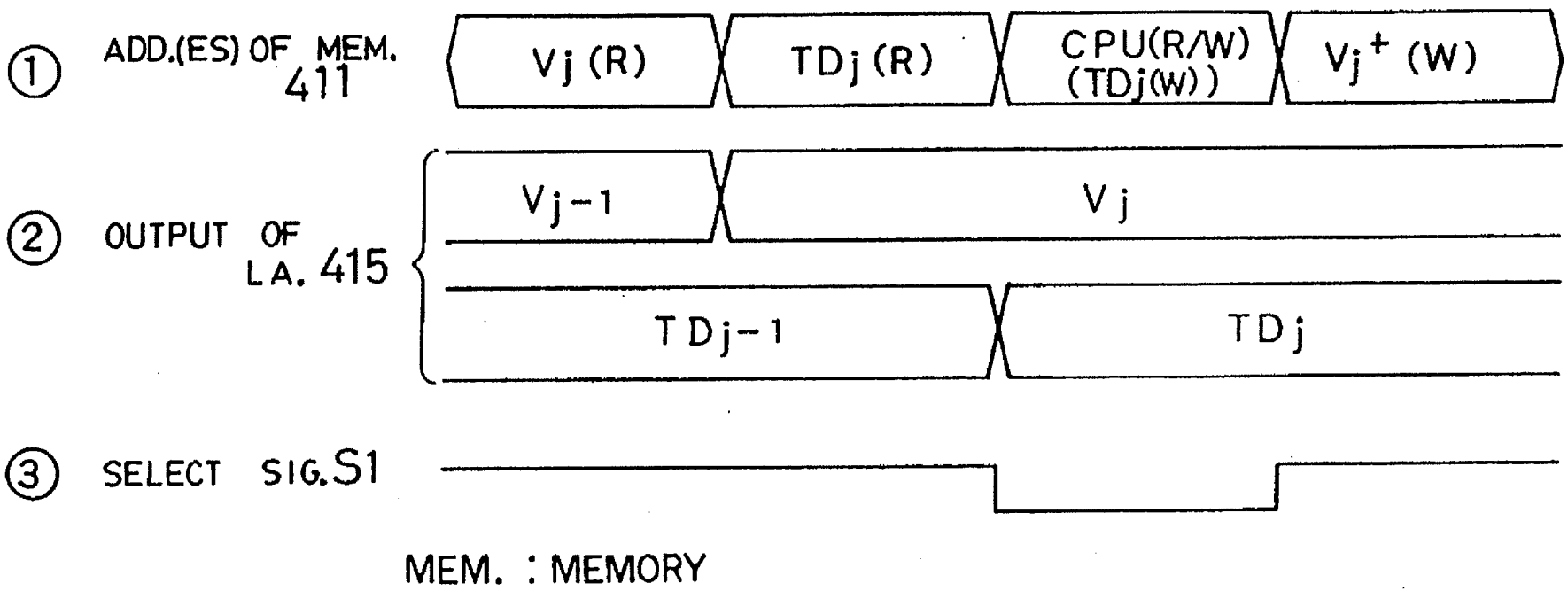
FIG. 7 is a time chart concerning the parameter storage 41.

FIG. 7 is a time chart illustrating the operation of the parameter storage 41. The reading of the j-th channel formant control parameter Vj, reading of the j-th channel formant control parameter TD, accessing of the controller 20 and writing of the formant control parameter Vjt+ after operation with respect to the j-th channel, are sequentially switched and repeated. Writing the formant control parameter TD is executed when accessing by the controller 20.

The output of the latch 415 is delayed by one step behind the read and write timings noted above, as shown in FIG. 7. The select signal S1 is at a low level when and only when accessing by the controller 20.

6. Function Operation Unit 42

Figure 8:
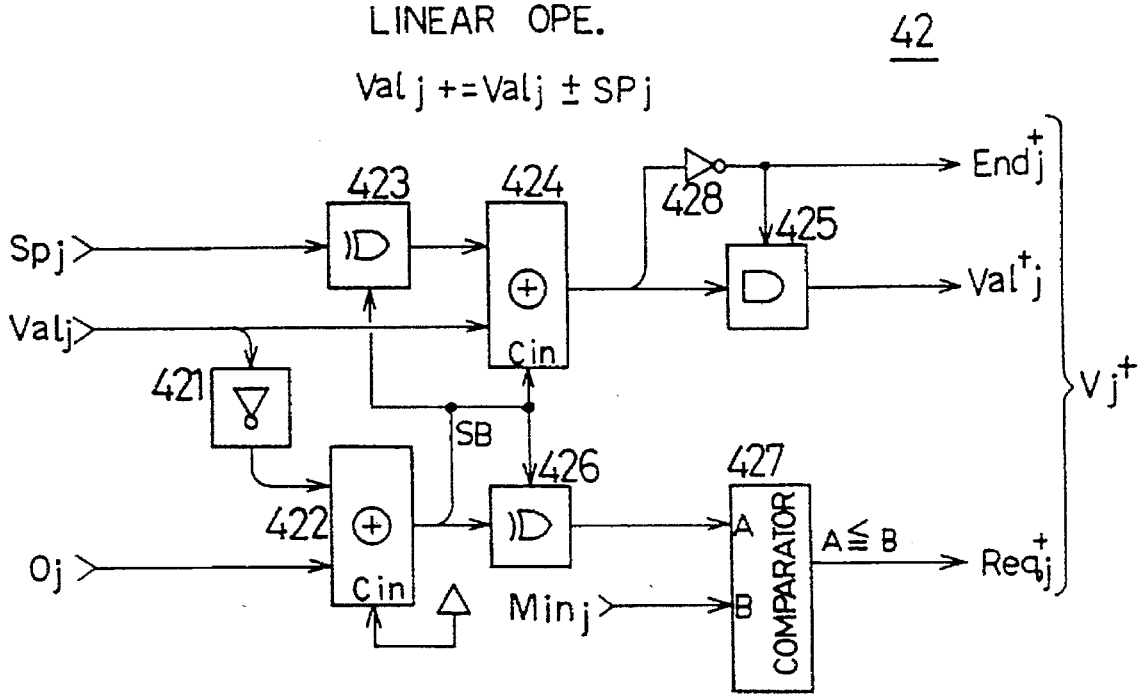
FIG. 8 is a circuit diagram showing a function 42 for performing linear operation.
Figure 9:
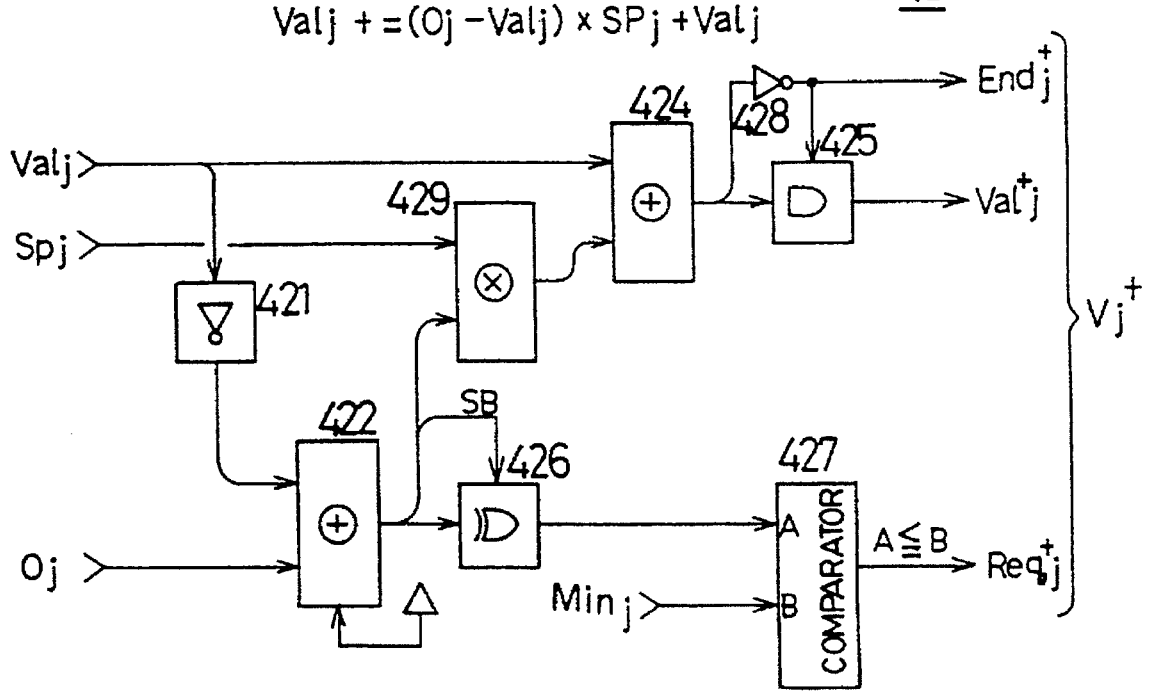
FIG. 9 is a circuit diagram showing a function 42 for performing exponential operation.

FIGS. 8 and 9 show examples of the function operation unit 42, The function operation unit 42 shown in FIG. 8 performs a linear operation. while the function operation unit 42 shown in FIG. 9 performs an exponential operation. An adder 424 adds the parameter value Valj and speed data SPj from an exclusive OR gate group 423, and its output is coupled through an AND gate group 425 to provide a new parameter value Valj+.

The parameter value Valj is sign inverted in an inverter group 421 before being added to the objective data Oj in an adder 422, and the sum output thereof is incremented by "+1". Thus, the parameter data Valj is subtracted from the objective data Oj. The sign bit SB of the subtraction data is supplied to the exclusive OR gate group 423 and also supplied as "+1" increment signal to the adder 424. Thus, when the objective data Oj is less than the parameter value Valj. the speed data SPj is sign inverted, and the speed data SPj is subtracted from the parameter value Valj.

The subtracted (difference) data from the adder 422 is supplied through an exclusive OR gate group 426 to a comparator 427. To the exclusive OR gate group 426 is also supplied the sign bit SB. and when the subtracted (difference) data has a negative value, it is inverted to the positive value. Thus, the exclusive OR gate group 426 provides the absolute value |Oj−Valj| of the difference between the parameter value Valj and the objective value Oj.

This absolute difference |Oj−Valj| is compared in a comparator 427 to the mini data Minj. When the absolute difference |Oj−Valj| becomes less than the mini data Minj, a comparative signal is provided as the request data Req+. The sign bit SB of the parameter value Valj from the adder 424 is inverted in an inverter 428 to be output as the end data Endj+. This end data Endj+ is inverted to a high level when and only when the parameter value Valj becomes negative with the end of the operation. The end data Endj+ is supplied to an AND gate group 425 to make the parameter value Valj+ to be "O". The above operation is expressed as Valj+= Valj±SPj.

In the function operation unit 42 shown in FIG. 9 for the exponential operation. difference data (Oj−Valj) between the parameter value Vali and the objective data Oj is obtained through inverter group 421 and adder 422. The difference data is multiplied in a multiplier 429 by the speed data SPj. The product data is added in an adder 424 to the parameter value Valj. and the sum is coupled through an AND gate group 425 to be provided as the parameter value Valj+. The remainder of the operation is the same as in the function operation unit 42 shown in FIG. 8. The above operation is expressed as Valj+=(Oj−Valj)×SPj+Valj.

The formant control parameters TD (i.e., speed data SP, objective data O and mini data Min). request data Req and end data End, are used for operations concerning the envelope levels of the attack, decay, sustain and release phases of the envelope waveform or operation concerning the elapsed time from the start till the end of sounding.

In this case, the formant control parameter aj(t) to be described later, which is obtained as a result of the above operation represents the envelope level, and the formant control parameter cj(t) or dj(t) represents the elapsed time from the start of sounding. If the speed data SP is large or if the objective data O is small. the data obtained as the result of the operation can be used as representing the envelope level. On the other hand, if the speed data SP is small or if the objective data O is large, the operation result data can be used as representing the elapsed data from the start of sounding. Such data representing the envelope level or the elapsed time from the start of sounding, are supplied to the controller 20 to switch various signals, data and parameters as described above or to be described later.

The operation result data constitute the formant control parameters Valj (ωfj(t), ωcj(t). aj(t), cj(t) and dj(t)).

Alternatively. it is possible to fix only values of the parameters ωfj(t) and ωcj(t). Further, it is possible to also fix value of the parameters aj(t), cj(t) and dj(t) or set these parameters to the same value. By so doing, it is possible to provide only a single function operation unit 42 or dispense with some of the function operation units 42. Further, it is possible to vary the parameters ωfj(t) and ωcj(t) for frequency modulation or vary the density of the frequency components of the formant of the formant waveform signal Ffj(t) according to the envelope or the elapsed time from the start of sounding.

The operation in the function operation unit 42 May be replaced with an operation using a digital signal processor, an operation circuit, etc. on the basis of a certain operation formula.

Further, in place of the above operation, it is possible that calculated parameter values Val are stored in and successively read out from the memory. In this case, it is possible to use fluctuations (wavering, swings, sways) data FL from a fluctuation data memory 321 or frequency or amplitude modulation data FM1 to FM3, SFM, AM1 to AM3 or SAM described in specification U.S. patent application Ser. No. 08/172,146 (Japan Patent Application Serial No. 04-230136 and 04-346063) as the parameter values Val.

Further, it is possible to replace the circuits shown in FIGS. 8 and 9 with. for instance, a time counter for the operation concerning the formant control parameters Valj ($\omega fj(t)$, $\omega cj(t)$, $aj(t)$, $cj(t)$ and $dj(t)$). Such time counter is reset and caused to start counting under control of a sounding operation event signal or a signal produced at the time of the channel assignment to a musical tone to be sounded. The time counter counts the elapsed time from the start of sounding on a time division basis, i.e., for each channel.

Further, cumulative formant density parameter $\Sigma\ \omega fj(t)$ or cumulative formant carrier parameter 7, $\Sigma\ \omega cj(t)$ represents the read address for the formant waveform signal Ffj(t) or formant carrier signal $\cos \omega ct$. The number of times of repeated reading of such signal and also the value of the cumulative parameter $\Sigma\ \omega fj(t)$ or $\Sigma\ \omega cj(t)$ (read address) indicate the elapsed time from the start of sounding, and the value may be used as the elapsed time from the start of sounding. Particularly, the value is effective in case where the formant waveform signal Ffj(t) or the formant carrier signal $\cos \omega ct$ is stored for a plurality of periods from the rising (attack) or for all the periods from the start till the end of sounding. Such data indicative of the elapsed time from the start of sounding is supplied to the controller 20 to switch various signals, data and parameters as described above or to be described later.

The circuits shown in FIGS. 8 and 9 may both be provided in the musical tone generation apparatus for switching according to the musical factors, envelope phase, envelope level. elapsed time from the start of sounding or input data or select data by operator. As the data for the switching is used some or all of the musical factors from the performance data generator 10 or the parameters Valj ($\omega fj(t)$, $\omega cj(t)$, $aj(t)$, $cj(t)$ and $dj(t)$).

7. Formant waveform Generator 50

Figure 10:
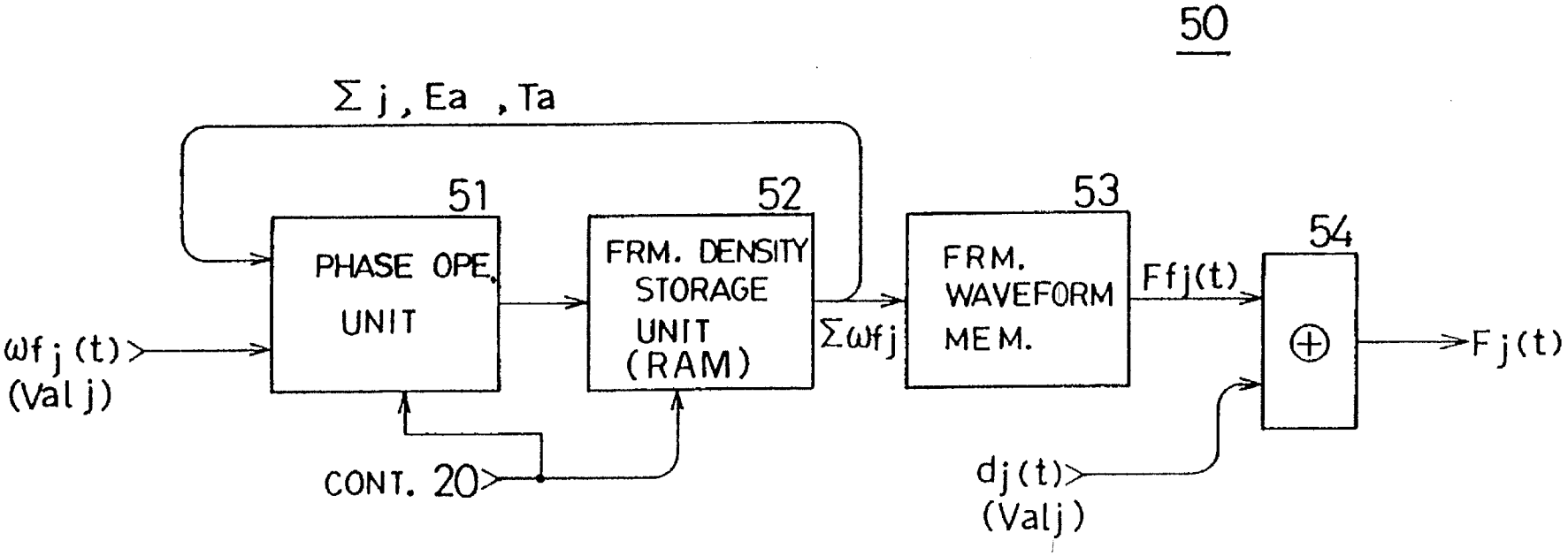
FIG. 10 is a circuit diagram showing a formant waveform generator 50.

FIG. 10 shows the formant waveform generator 50. The formant density parameter $\omega fj(t)$ as one of the calculated parameter values Valj noted above is processed in a phase operation unit 51 before being stored in a formant density storage unit 52. This formant density parameter $\omega fj(t)$ is stored for all the channels. When stored in the formant density storage unit 52, the formant density parameter $\omega fj(t)$ is read out for each channel to be supplied to a formant waveform memory 53 and also fed back to a phase operation unit 51 for accumulation. The start value for the accumulation, i.e., repeat top data Ta, is supplied from the controller 20.

The formant waveform signal Ffj(t) is stored in large number in the formant waveform memory 53. That is, it is stored for each touch data. each tone pitch range data, timbre data, each elapsed time from the start of sounding, each envelope level. each envelope phase, etc.

It is also possible to store the formant waveform data Ffj(t) in the formant waveform memory 53 for each of other musical factor data, for instance each effect data, each rhythm data, each stereo data. each modulation data, each performance part data, each Musical tone or sound part data, each musical instrument part data, etc. That is, the formant waveform data Ffj(t) are stored as multiple data corresponding to the musical factor. For example. each formant waveform signal Ffj(t) is stored for each of a plurality of different timbres, each timbre formant waveform signal Ffj(t) is stored for each musical instrument part (tone pitch range), each musical instrument part (tone pitch range) formant waveform signal Ffj(t) is stored for each touch, each touch formant waveform signal Ffj(t) is stored for each elapsed time from the start of sounding, each envelope level or each envelope phase, and so forth.

The each formant waveform signal Ffj(t) are selected according to the repeat top data Ta from controller 20, and the repeat top data Ta are selected according to the musical factors, for example, timbres, touch, tone pitch (tone pitch range), etc., envelope phase, envelope level, elapsed time from the start of sounding or input data or select data by operator input from the performance data generator 10. The formant waveform signal Ffj(t) are also input from the performance data generator 10 by operator.

In this case. the formant control parameter Valj or the time count data which is changed according to the envelope data or elapsed time is synthesized to the musical factors by all kinds of calculations (1) which will be described later in detail.

It is possible to omit the storage of data for each elapsed time from the start of sounding or each envelope level, and instead modify for synthesis the elapsed time from the start of sounding of envelope level with respect to the formant waveform signal Ffj(t). The modification synthesis is based on all kinds of calculations (1) which will be described later in detail, and an operation (computation) device for the modification synthesis of the elapsed time from the sounding start or envelope level is provided at the output terminal of the formant waveform memory 53 shown in FIG. 10.

Accordingly. the program/data storage 21 includes a table relating the musical factor data, repeat top data Ta, repeat end data Ea, etc. to one another. In this table. data is stored as multiple data corresponding to the musical factors. For example, each of the data Ta and Ea is stored for each of a plurality of different timbres, the data for each timbre is stored for each musical instrument part (tone pitch range), the data for each musical instrument part (tone pitch range is stored for each touch, the data for each touch is stored for each elapsed time from the sounding start, each envelope level or each envelope phase, and so forth.

Each of the data Ta and Ea are selected according to the repeat top data Ta from controller 20. and the repeat top data Ta are selected according to the musical factors, for example, timbres. touch, tone pitch (tone pitch range), etc., envelope phase, envelope level, elapsed time from the start of sounding or input data or select data by operator input from the performance data generator 10. Each of the data Ta and Ea are also input from the performance data generator 10 by operator.

In this case. the formant control parameter Valj or the time count data which is changed according to the envelope data or elapsed time is synthesized to the musical factors by all kinds of calculations (1) which will be described later in detail.

It is possible to omit the storage of data for each elapsed time from the start of sounding or each envelope level, and instead modify for synthesis the elapsed time from the start of sounding of envelope level with respect to each of the repeat top data Ta and repeat end data Ea. The modification synthesis is based on all kinds of calculations (1) which will be described later in detail and an operation (computation) device for the modification synthesis of the elapsed time from the sounding start or envelope level is provided between the output terminal of the formant density storage unit 52 and the input terminal of the phase operation unit 51 shown in FIG. 10.

As noted before, there are various forms of formant of the formant waveform signal Ff(t), such as half triangular, pot-like, triangular, rectangular, half circular, hill-like, two-hill-like, etc., and also there are composite formants obtained by combining a plurality of like formants with or without overlap.

The formant waveform signal Ffj(t) which is read out on a time division basis from the formant waveform memory 53, is fed to an adder 54 for bias provision, i.e., addition of the formant waveform bias parameter dj(t), and the result is fed as formant waveform signal Fj(t) to the formant waveform generator 60. The bias provision, instead of the addition bias, may be the multiplication of the formant waveform signal Ffj(t) by the formant waveform bias parameter dj(t) or both the multiplication and addition or all kinds of calculations (1) which will be described later in detail.

The formant density parameter ωfj(t) for the each musical tone may be supplied directly from the controller 20. This transfer of parameter ωfj(t) from the controller 20 is made according to the musical factor data input from the performance data generator 10, such as the timbre, touch, tone pitch range, etc., the elapsed time from the sounding start, the envelope level, envelope phase or input data or select data by operator. To this end, the program/data storage 21 includes a table relating the musical factor data, etc. to the formant density parameter ωfj(t). The formant density parameter ωfj(t) are also input from the performance data generator 10 by operator.

Thus the density of frequency components of the formant of the formant waveform signal Ffj(t), and the formant position thereof of the formant waveform signal Ffj(t) on the frequency axis from the formant carrier signal, are changed according to the musical factor data such as the timbre, touch, tone pitch range, etc., the elapsed time from the sounding start, envelope level, envelope phase or input data or select data by operator etc. In this case, each parameter is stored as multiple data corresponding to the musical factors same as the data SP, O, Min, Ta, Ea, or the formant waveform signal Ffj(t).

In this case, as for the musical factors the formant control parameter Valj or the time count data which is changed according to the envelope data or elapsed time is synthesized by all kinds of calculations (1) which will be described later in detail.

It is possible to omit the storage of data for each elapsed time from the sounding start or each envelope level and, instead, modify for synthesis the elapsed time from the sounding start of envelope level with respect to the formant density parameter ωfj(t). The modification synthesis is based on all kinds of calculations (1) which will be described later in detail, and an operation (calculation) device for the modification synthesis of the elapsed time from the sounding start or envelope level is provided at the input terminal of an exclusive OR gate group 512 shown in FIG. 13.

8. Formant Density Storage unit 52

Figure 11:
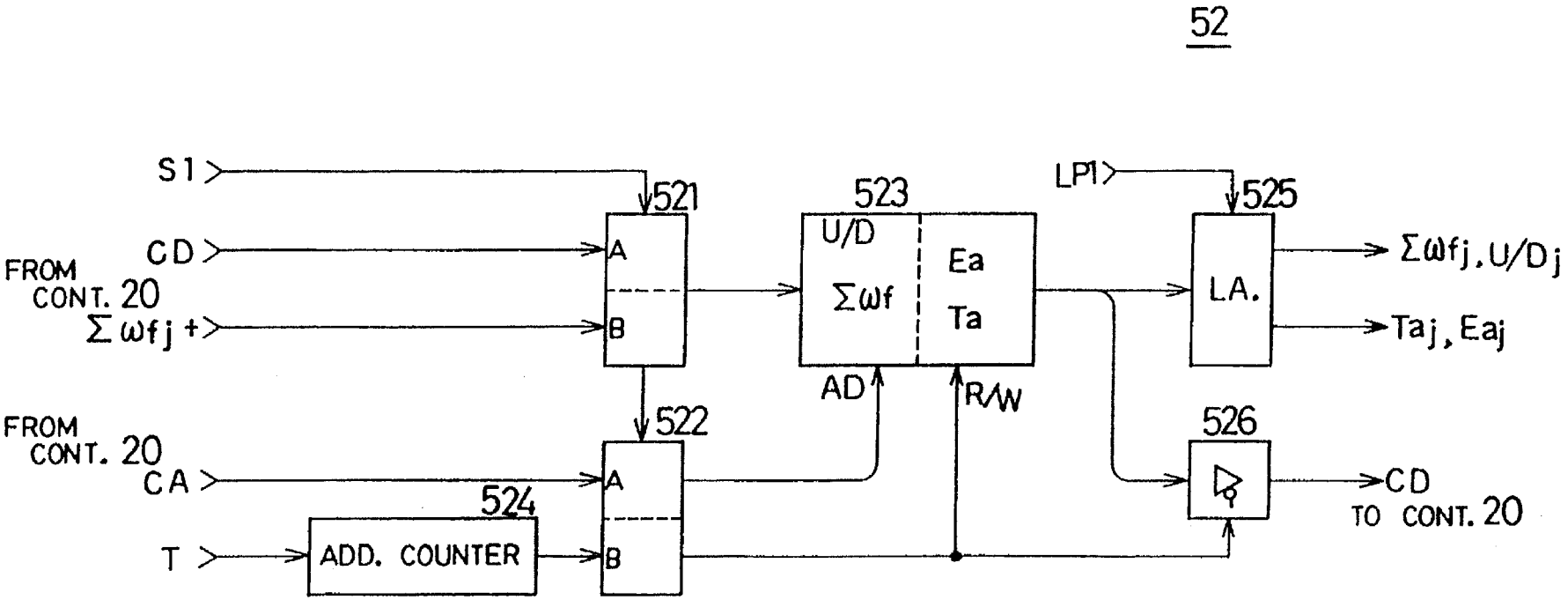
FIG. 11 is a circuit diagram showing a formant density storage 52.

FIG. 11 shows the formant density storage unit 52. This formant density storage unit 52 has substantially the same structure as the parameter storage 41 noted above. Formant control parameter CD from the controller 20 is coupled through a selector 521 to be written in a formant density memory 523. This parameter is written at the time of, for instance, the generation of event signal for sounding operation or the channel assignment to a musical tone to be sounded.

The formant control parameter CD consists of the repeat top data Ta, the repeat end data Ea and an up/down flag U/D. The repeat top data Ta and the repeat end data Ea indicate the first and last addresses, respectively, of an area of the formant waveform memory 53 in which the formant waveform signal Ffj(T) to be read out is stored. The up/down flag U/D indicates that the accumulation of the formant density parameter fj(t) is addition or subtraction.

The formant density parameter ωfj(t) which has been accumulated in the phase operation unit 51, i.e., cumulative formant density parameter Σ ωfj(t), is coupled through a selector 521 to be written in a formant density memory 523. The cumulative formant density parameter Σ ωfj(t) and formant control parameters Ta and Ea and U/D are stored in the formant density memory 523 in a number corresponding to the number of time division channels. The j-th channel cumulative formant density parameter Σ ωfj(t) and formant control parameters Taj, Eaj and U/Dj are fed through a latch 525 to the phase operation unit 51 and also fed through a tri-state buffer 526 to the controller 20 for such purposes as requesting formant control parameter CD necessary for the next operation.

Address data CA and read/write signal R/W are supplied for the formant density memory 523 through the controller 20 and selector 522 to the formant density memory 523 and also supplied through an address counter 524 and the selector 522 to the formant density memory 523. The read/write signal R/W is further supplied as a set signal to the tri-state buffer 526.

A select signal S1 is supplied to the selectors 521 and 522 to switch data to be selected. A latch signal LP1 is supplied to the latch 525. The cycle period of the latch signal LP1 is equal to the channel division time. The latch signal LP1, select signal S1 and count signal T of the address counter 524 are supplied from the timing generator 30.

9. Operation of Formant Density Storage 52

Figure 12:
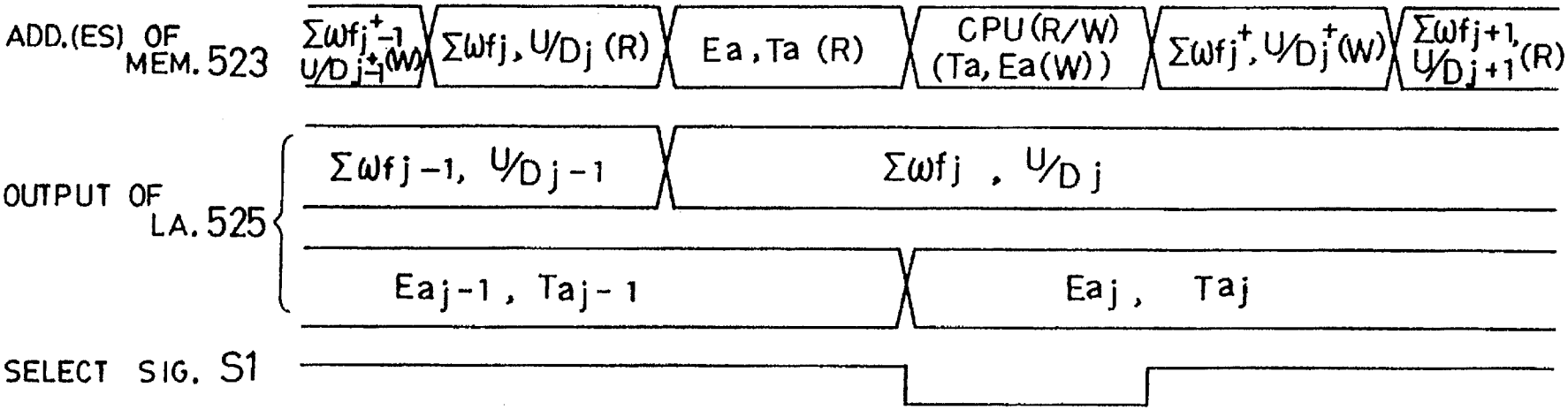
FIG. 12 is a time chart concerning the formant density storage 52.

FIG. 12 is a time chart illustrating the operation of the formant density storage unit 52. The reading of the j-th channel cumulative formant density parameter Σ ωfj(t) and up/down flag U/D, reading of the j-th channel repeat top data Taj and repeat end data Eaj, accessing of the controller 20, and writing of the cumulative formant density parameter Σ ωfj(t)+ and up/down flag U/Dj+ after the accumulation for the j-th channel, are executed repeatedly by sequential switching. The repeat top data Taj and repeat end data Eaj are written in the timing of accessing by the controller 20.

The output of the latch 525 is delayed by one step behind the above read and write timings, and thus it is as shown in FIG. 12. The select signal S1 is at a low level when and only when the controller 20 accesses.

10. Phase Operation Unit 51

Figure 13:
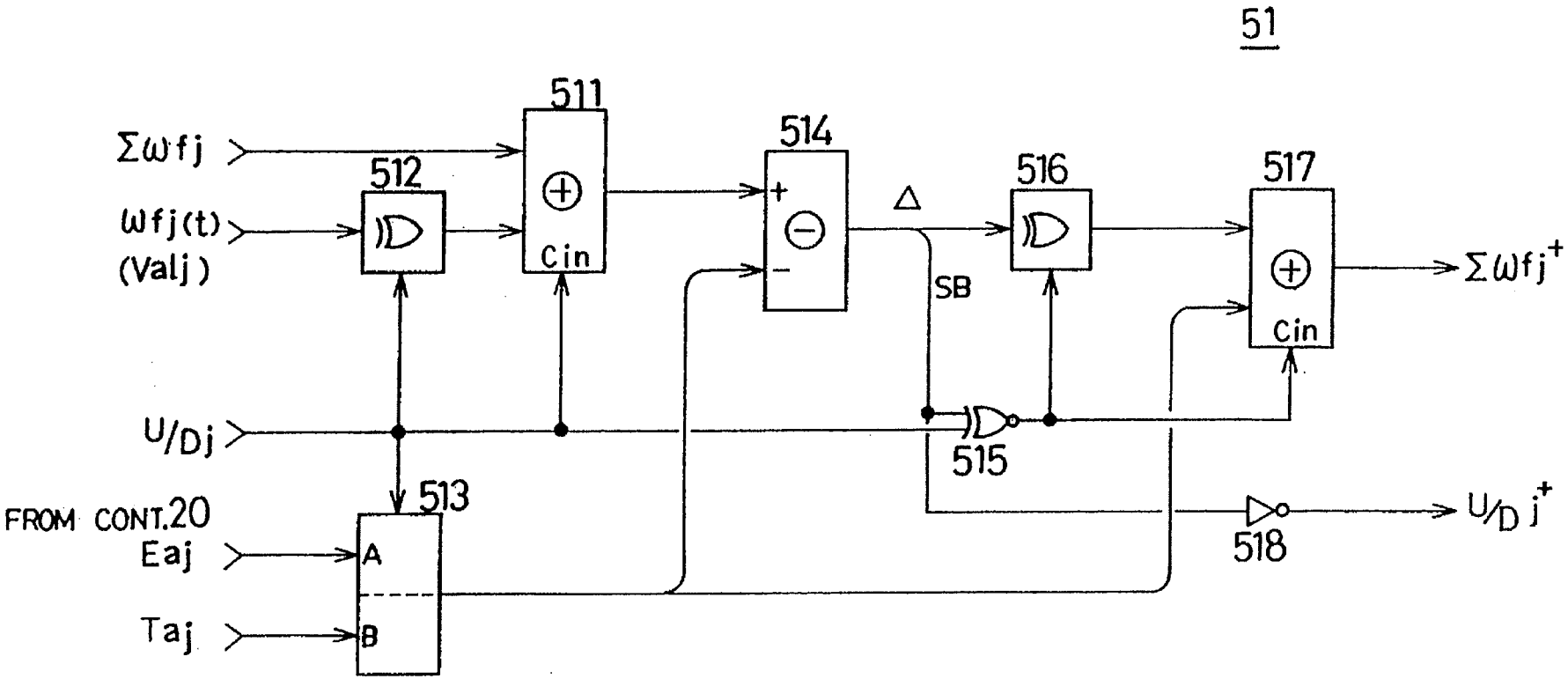
FIG. 13 is a circuit diagram showing a phase operation unit 51.

FIG. 13 shows the phase operation unit 51. The formant density parameter ωfj(t) from the formant control parameter generator 40 is coupled through an exclusive OR gate group 512 to an adder 511 for addition, i.e. accumulation, to the cumulative formant density parameter Σ ωfj(t) from the formant density storage unit 52. A subtractor 514 obtains difference data, i.e., arrival difference data Δj, between the sum output of the adder 511 and repeat top data Taj or repeat end data Eaj. The arrival difference data Δj is coupled through an exclusive OR gate group 516 to an adder 517 to be added to the repeat top data Taj or repeat end data Eaj, thus producing cumulative formant density parameter Σ ωfj(t)+ after accumulation which is fed to the formant density storage unit 52.

The up/down flag U/Dj from the formant density storage unit 52 is supplied to the exclusive OR gate group 512.

When the accumulation of the formant density parameter ωfj(t) is subtraction, the formant density parameter ωfj(t) is sign inverted. A selector 513 selectively provides either of the repeat top data Taj and repeat end Eaj from the formant density storage unit 52 to the subtractor 514 and adder 517. The up/down flag U/Dj is supplied as select signal to the selector 513, which thus selects the repeat end data Eaj when the accumulation of the formant density parameter ωfj(t) is addition and selects the repeat top data Taj when the accumulation of the formant density parameter ωfj(t) is subtraction.

The up/down flag U/Dj is input to an exclusive NOR gate 515, to which the sign bit SB of the arrival difference data Δj from the subtractor 514 is also input. Thus, the exclusive NOR gate 515 can detect that the cumulative formant density parameter Σ ωfj(t) has exceeded the repeat top data Taj or repeat end data Eaj as a result of the accumulation. The detection signal from the exclusive NOR gate 515 is fed to the exclusive OR gate group 516 for sign inversion of the value of the arrival difference data Δj. The sign bit SB of the arrival difference data Δj is fed through an inverter 518 as up/down flag U/Dj to the formant density storage unit 52. It is possible as well that when the cumulative formant density parameter Σ ωfj(t) becomes more than the repeat end data Eaj. the cumulative formant density parameter Σ ωfj(t) is not subtracted but the parameter Σ ωfj(t) jumps to the repeat top data Taj and the addition may be repeated.

Each formant waveform signal Ffj(t) is stored in the formant waveform memory 53 for one period or a plurality of periods. As the plurality of periods of the formant waveform signal Ffj(t), a plurality of periods of a rising (attack) portion and a plurality of periods of a portion subsequent to the rising are stored. The rising portion is read once, while the portion subsequent to the rising is read repeatedly. Alternatively, the whole waveform from the start till the end of sounding is stored and read out once.

In this case, the repeat top data Taj and repeat end data Eaj indicate the top and end of the portion that is repeatedly read out. The initial data Iaj indicate the top of the rising (attack) that is read out in sounding start. Thus, initial data Iaj is also stored in the formant density memory 523.

The initial data Iaj is determined by the controller 20 as one of the formant control parameters CD. Like the repeat top data Taj and repeat end data Eaj, it is determined according to the musical factor data. elapsed time from the sounding start, envelope level. envelope phase or input data or select data by operator etc., and it is written in the formant density memory 523. It is read out from the formant density memory 523 to be fed through the latch 525 to the formant waveform memory 53 and also fed to the phase operation unit 51.

In the phase operation unit 51, the initial data Iaj is output through a selector (not shown) as cumulative formant density parameter Σ ωfj(t)+. In the selector, the cumulative formant density parameter Σ ωfj(t)+ as the output of the adder 517 and the initial data Iaj are selected. To the selector, a key-on event signal is supplied as selection switching signal. At the time of sounding operation event signal generation or at the time of channel assignment to a musical tone to be sounded, the initial data Iaj is output as cumulative formant density parameter Σ ωfj(t)+ for successive accumulation.

This parameter Σ ωfj(t) (initial data Iaj) is written again through a selector 521 in the formant density storage unit 52 in the formant density memory 523. Subsequently, the cumulative formant density parameter Σ ωfj(t) is successively accumulated from the initial data Iaj toward the repeat end data Eaj, and further accumulation from the repeat top data Taj to the repeat end data Eaj is repeated.

11. Operation of Phase Operation Unit 51

Figure 14:
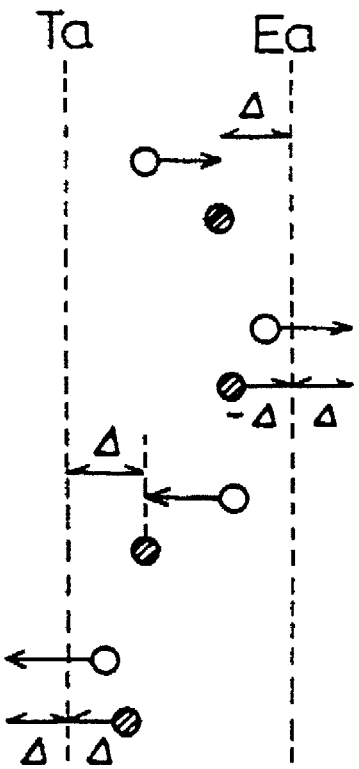
FIG. 14 is a view illustrating the operation of the phase operation unit 51.

FIG. 14 shows the relation between the operation in the phase operation unit 51 to accumulate the formant density parameter ωfj(t) and the repeat top and end data Ta and Ea. When the up/down flag U/D is indicative of addition and the sign bit of the arrival difference data Δj is negative, the output of the exclusive NOR gate 515 is at a low level, and the cumulative formant density parameter Σ ωfj(t)+the formant density parameter ωfj(t) becomes the repeat end data Ea+arrival difference data Δj.

When the up/down flag U/D is indicative of addition and the sign bit of the arrival difference data Δj is positive, the output of the exclusive NOR gate 515 is at a high level, and the cumulative formant density parameter Σ ωfj(t)+the formant density parameter ωfj(t) becomes the repeat end data Ea–the arrival difference data Δj. Thus, fold-back correction is made when the repeat end data Ea is exceeded by the cumulative formant density parameter Σ ωfj(t).

When the up/down flag U/D is indicative of subtraction and the sign bit of the arrival difference data Δj is positive, the output of the exclusive NOR gate 515 is at a low level, and the cumulative formant density parameter Σ ωfj(t)+the formant density parameter ωfj(t) becomes the repeat top data Ta+the arrival difference data Δj.

When the up/down flag U/D is indicative of subtraction and the sign bit of the arrival difference data Δj is negative, the output of the exclusive NOR gate 515 is at a high level, and the cumulative formant density parameter Σ ωfj(t)+the formant density parameter ωfj(t) becomes the repeat top data Ta–the arrival difference date Δj. Thus, fold-back correction is made when the repeat top data Ta is exceeded by the cumulative formant density parameter Σ ωfj(t).

12. Formant Waveform Generator 60

Figure 15:
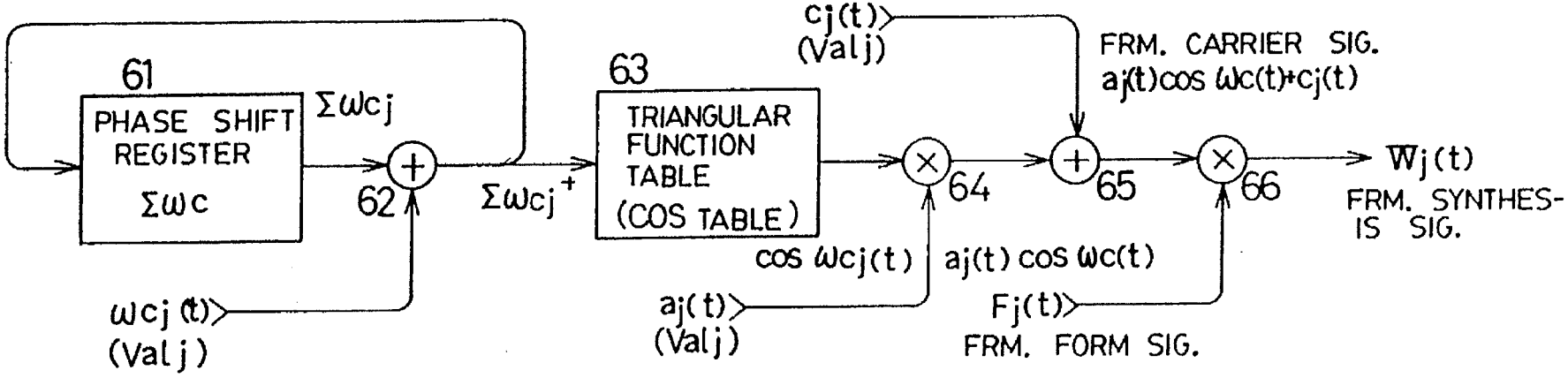
FIG. 15 is a circuit diagram showing a formant waveform generator 60.

FIG. 15 shows the formant waveform generator 60. Formant carrier parameter ωcj(t) is fed from the, formant control parameter generator 40 to an adder 62 to be accumulated to cumulative formant carrier parameter Σ ωcj(t) from a phase shift register 61, and the output of the adder 62 is set again in the phase shift register 61. The phase shift register 61 has shift areas corresponding in number to the cumulative formant carrier parameters Σ ωcj(t) of all the channels. The all channel cumulative formant carrier parameters Σ ωcj(t) are thus stored and shifted successively to be output. The cumulative formant carrier parameter Σ ωcj(t) is supplied as read address data to a triangular function table (cos table) 63. In the triangular function table 63 cos waveform data are stored. These cos waveform data cos ωcj(t) are read out on a time division basis as formant carrier signal Gj(t).

The formant carrier signal cos ωcj(t) is multiplied in a multiplier 64 by the formant carrier level parameter aj(t) for such purposes as envelope control. The output of the multiplier 64 is fed to an adder 65 for adding the formant carrier bias parameter cj(t) to it. The output of the adder 65 is in turn fed to a further multiplier 66 to be multiplied by the formant waveform signal Fj(t). In this way, formant synthesis signal Wj(t) is obtained through the synthesis of the formant waveform signal Fj(t) on the formant carrier signal, and it is output to the accumulator 70. In this way, the formant waveform signal Fj(t) is synthesized on the formant carrier signal cos ωcj(t) as formant center signal (fundamental wave).

The frequency of the formant carrier signal Gj(t) and the frequency of the formant waveform signal Fj(t) (Ffj(t)). can be selected independently to generate various different kinds of musical tones. The frequency of the formant carrier signal Gj(t) is determined by a designated tone pitch and also by various frequency data concerning formants, other frequency data, frequency modulation data, etc. The frequency of the formant waveform signal Fj(t) (formant waveform signal Ffj(t)), is determined by the musical factor data, such as the timbre, touch, tone pitch range, etc., elapsed time from the sounding start, envelope level, envelope phase or input data or select data by operator.

It is possible as well to generate the formant carrier signal cos ωcj(t) using a digital signal processor, an operation circuit, etc. for executing an operation based on an operation formula. Further, it is possible to store in the cos table 63, instead of the cos waveform data, sin waves, triangular waves, trapezoid waves, rectangle waves, sawtooth waves and other complex waveform data containing harmonic components.

Further, it is possible to supply the formant waveform signal Fj(t) in lieu of the cumulative formant carrier parameter Σ ωcj(t) to the triangular function table 63. As a further alternative, it is possible to supply to the triangular function table 63 a signal obtained by adding or multiplying the formant waveform signal Fj(t) to or by the cumulative formant carrier parameter Σ ωcj(t). The synthesis of data from the formant waveform signal Fj(t), formant carrier Gj(t) and cos ωcj(t) may be based an all kinds of calculations (1) which will be described later in detail. It is thus possible to make the synthesis of the formant waveform signal Fj(t) on the formant carrier signal Gj(t) and cos ωcj(t) complicated to permit generation of various musical tones.

The formant carrier parameter ωcj(t) may be fed directly to the controller 20. The transfer of data from the controller 20 is made according to the performance data such as tone pitch data input from the performance data generator 10. The program/data storage 21 has a table (frequency number memory) relating the tone pitch data, etc. to the formant carrier parameter ωcj(t). In this case, the formant carrier parameter ωcj(t) corresponds to the first formant at the lowest frequency among a plurality of formants of a musical tone, but it may correspond to the second formant, the third formant, etc. as well.

Further, the transfer of the formant carrier parameter ωcj(t) from the controller 20 is made according to the musical factor data from the performance data generator 10 such as the timbre, touch, tone pitch range, etc. the elapsed time from the sounding start, envelope level, envelope phase, input data or select data by operator, etc. The program/data storage 21 has a table relating the musical factor data, etc. to the formant carrier parameter ωcj(t). The formant carrier parameter ωcj(t) are also input from the performance data generator 10 by operator.

Thus, the frequency of the formant carrier signal Gj(t) is changed according to the musical factor data such as the timbre, touch, tone pitch range, etc., the elapsed time from the sounding start, envelope level or envelope phase, input data or select data by operator, etc. In this case, the formant carrier parameter wcj(t) is stored as multiple data corresponding to the musical factors same as the data SP, O, Min, Ta, Ea, the formant waveform signal Ffj(t) or the formant density parameter Σ ωfj(t).

In this case, as for the musical factors the formant control parameter Valj or the time count data which is changed according to the envelope data or elapsed time is synthesized by all kinds of calculations (1) which will be described later in detail.

It is possible to omit the storage of data for the each elapsed time from the sounding start or envelope level, and instead, modify for synthesis the elapsed time from the sounding start or envelope level with respect to each formant carrier parameter ωcj(t). The modification synthesis is based on all kinds of calculations (1) which will be described later in detail, and an operation (calculation) device for the modification synthesis of the elapsed time or envelope level is provided at the input terminal of an adder 62 shown in FIG. 15.

In this case, the formant carrier signal ωcj(t) corresponds to the second formant, third formant, etc. other than the first formant at the lowest frequency among a plurality of formants of one musical tone, but it may correspond to the first formant as well. The value of the formant carrier parameter ωcj(t) corresponding to the second formant, third formant, etc. is comparative data with respect to "1" which is the value of the formant carrier parameter ωcj(t) corresponding to the first formant, for instance "1.2", "1.5", "1.8", "2.0", "3.5", "4.9", etc. This comparative data is multiplied on the tone pitch data (frequency number data) of the first formant to obtain actual calculated formant carrier parameter ωcj(t).

The formant carrier signal Gfj(t), cos ωcj(t) and formant waveform signal Ffj(t) corresponding to the first formant, the second formant, the third formant, . . . according to one musical sound of one operating sound start generate on a time division basis for each channel. In this case, a plurality of the formant carrier signal Gfj(t), cos ωcj(t) and formant waveform signal Ffj(t) corresponding to each formants of one sound are all different or same in part.

The formant carrier signal {aj(t)×cos ωcj(t)+cj(t)}, i.e., the formant center signal, may or may not be in accord with the formant peak center signal corresponding to the formant waveform signal Ffj(t)+dj(t). What is to be considered is a case when the formant carrier signal level is lower than the formant peak level. In the example shown in FIG. 4, with formant carrier signal level reduction a single formant peak at the center is changed to two peaks on the opposite sides of the center. In this case, the character of musical tone, such as the timbre, is also changed. This can be attained by adequately selecting the values of the formant control parameters aj(t), cj(t) and dj(t). Consequently, the character of musical tone can be changed according to the musical factor data, envelope data, data of the elapsed time from the sounding start, etc.

Instead of synthesizing the formant waveform signal Ffj(t) on the formant carrier signal cos ωcj(t) by multiplication, it is possible to let the formant waveform signal Ffj(t) be output directly as musical tone by making the formant density parameter ωfj(t) to correspond to a designated tone pitch.

13. Accumulator 70

Figure 16:
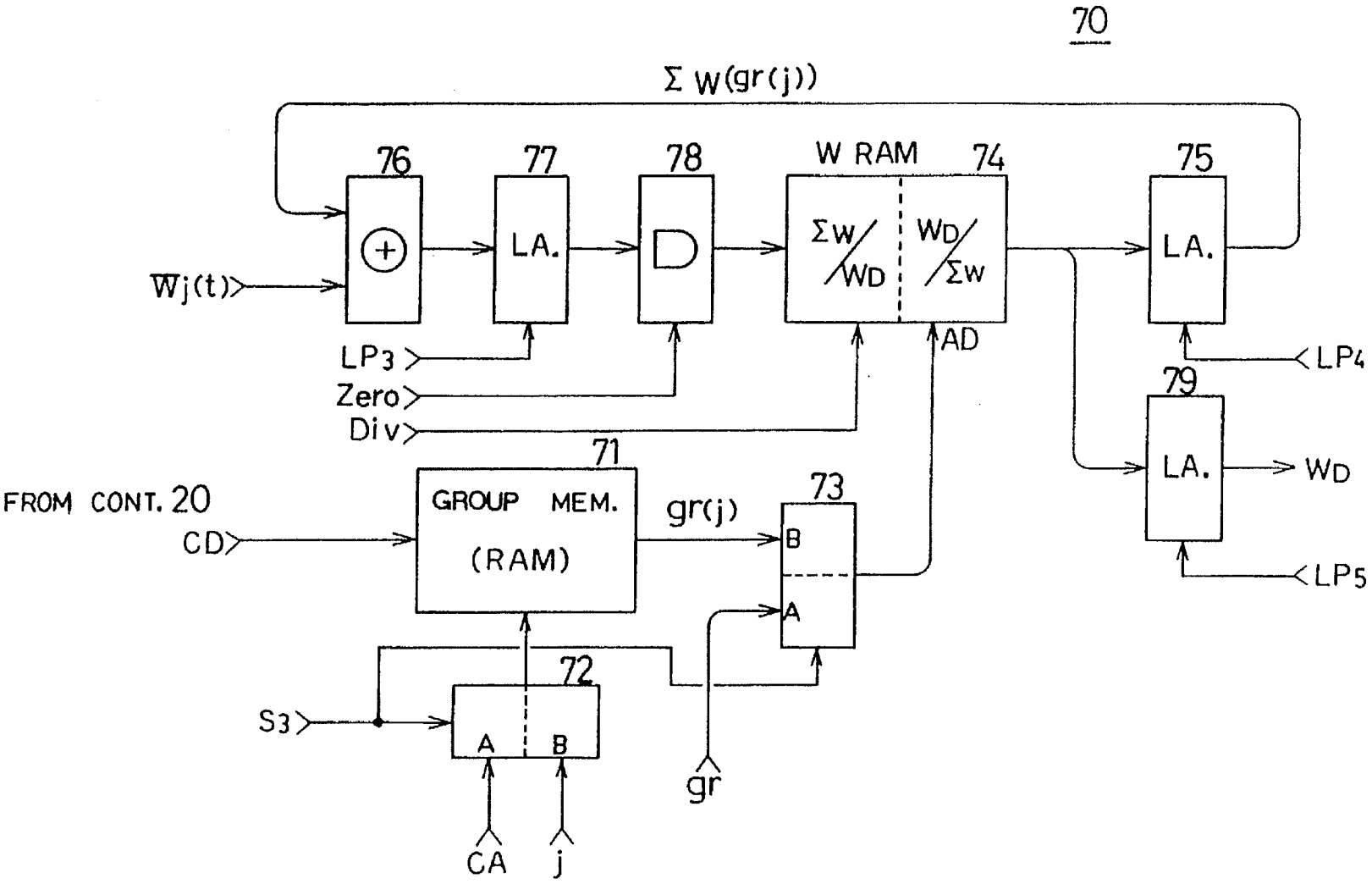
FIG. 16 is a circuit diagram showing an accumulator 70.

FIG. 16 shows the accumulator 70. Formant synthesis signal Wj(t) from the formant waveform generator 60 is fed to an adder 76 to be accumulated to cumulative formant synthesis signal Σ W(gr(j)) from a latch 75. The output of the adder 76 is fed through a latch 77 and an AND gate group 78 to be written in an accumulation memory 74. The accumulation memory 74 has two storage areas which are switched for writing and reading of data. The two storage areas of the accumulation memory 74 are divided for groups. The formant synthesis signal Wj(t) is accumulated for each group.

Cumulative formant synthesis signal Σ W(gr(j)) in the area in which data is being written, is successively accumulated for each group channel to be fed to the latch 75. Cumulative formant synthesis signal Σ W(gr(j)) in the area from which data is being read out is data after the end of accumulation for each group channel, and is fed through a latch 79 to the sound output unit 90.

The groups noted above each correspond to the musical factor data (or elapsed time from the sounding start, envelope level or envelope phase) or each sound of each channel formant synthesis signal Wj(t). Accumulation synthesis of the formant synthesis signal Wj(t) is made for each group. This processes for each group is carried out on a time division basis. This means that group channels are formed, which are different from the aforementioned channels to be assigned to musical tones. The musical factors that are corresponded by the groups are the timbre, touch, tone pitch range, stereo, etc. as noted above. As for the timbre, there may be a percussion instrument group and a strings/keyboard instrument group. As for the tone pitch range, there may be a high and a low tone pitch range. As for the stereo. they may be a left and a right stereo. The each group corresponding to the each sound noted a plurality of formants in one sound of one operating sound generation.

Latch signals LP3 to LP5 are supplied to the respective latches 77, 75 and 79. A zero signal Zero which is inverted to a low level for each channel time is provided on the AND gate group 78 to clear cumulative formant synthesis signal Σ W(gr(j)) which has been output. A division switching signal Div is supplied to the accumulation memory 74 to switch the writing and reading of the cumulative formant synthesis signal Σ W(gr(j)).

In a group memory 71, group data gr of musical tone to which each channel is assigned. i.e., the formant synthesis signal Wj(t). is stored for each channel. Thus. the group memory 71 has storage areas corresponding to all the channels. If there are two different groups, the group data gr can assume values of "0" and "1". If there are four different groups, it can assume values of "00", "01", "10" and "11". The group data gr(j) for each channel is supplied successively as address data through a selector 73 to the accumulation memory 74. Further, group data gr from the sound output unit 90 or controller 20 is supplied as address data through the selector 73 to the accumulation memory 74.

The address data Supplied from the controller 20 to the group memory 71 or time division channel number data j from a channel counter (not shown) in the timing generator 30, is supplied through a selector 72 to the group memory 71. Select signal S3 is supplied to the selectors 72 and 73 to switch the data to be selected. The select signal S3, the zero signal Zero and division switching signal Div are supplied from the timing generator 30.

14. Operation of Accumulator 70

Figure 17:
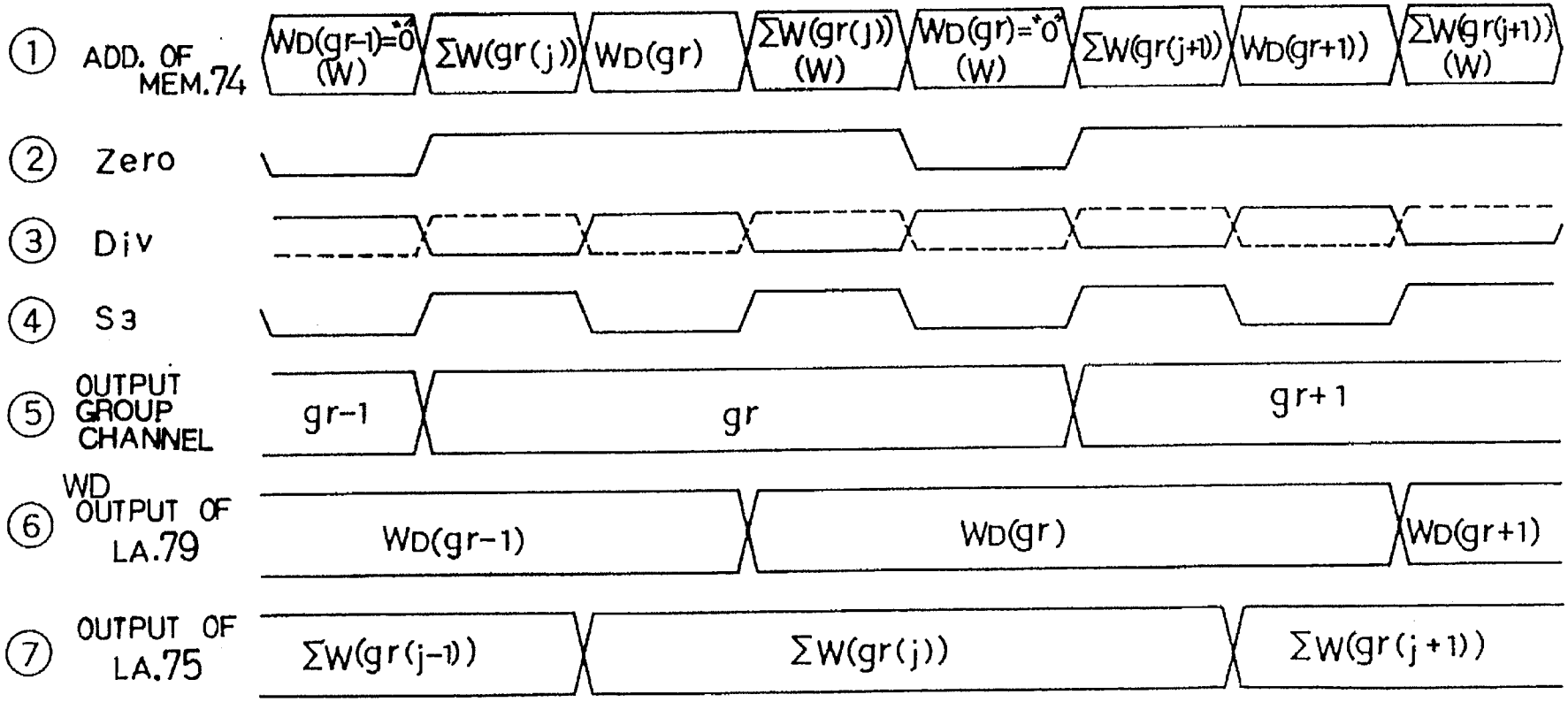
FIG. 17 is a time chart concerning the accumulator 70.

FIG. 17 is a time chart illustrating the operation of the accumulator 70. The reading of cumulative formant synthesis signal Σ W(gr(j)) for accumulation, reading of cumulative formant synthesis signal Σ W(gr(j)) after accumulation, writing of the cumulative formant synthesis signal Σ W(gr(j)) after the accumulation, and clearing of the cumulative formant synthesis signal Σ W(gr(j)) after the accumulation, are repeated sequentially for each group. The zero signal Zero is inverted to a low level when the cumulative formant synthesis signal Σ W(gr(j)) after the accumulation is cleared.

When a cycle of accumulation for all the channels is completed, the division switching signal Div is switched from a signal shown by solid line in FIG. 17 to a signal shown by a dashed line. Thus, the two storage areas of the group memory 71 are switched, that is, the writing and reading are interchanged. The outputs of the latches 79 and 75 are each delayed by one step as the timing is shown in FIG. 17.

15. Parameter of Formant Center Signal (Formant Carrier)

FIG. 18 shows a harmonic wave memory 211 in the program/data storage unit 21. The harmonic wave memory 211 is storing a plurality of sets (k=1 to k=n) of formant carrier parameters ωcjk(t) (frequency of component waveforms), formant carrier level parameters ajk(t) (amplitude coefficient of component waveforms), and formant carrier bias parameters cj(t) (direct current component of synthesized waveform).

The n sets of parameters ωcjk(t), ajk(t) and cj(t) are stored for each of the musical factors, lapse of times from the start of sounding, envelope levels and/or envelope phases. The musical factors include the above-mentioned timbre, touch, tone pitch range, etc. The storage for each of the musical factors is being multiplexed like the storage of the aforementioned data SP, O, Min, Ta, Ea, formant waveform signals Ffj(t), formant density parameters ωfj(t) and formant carrier parameters ωcj(t).

The parameters ωcjk(t), ajk(t) and cj(t) for each of the musical factors are selected based (depending) upon the musical factor data input from the aforementioned performance (play) data (information) generator 10, lapse of time(s) from the start of sounding, envelope levels, envelope phases and/or instructions by the operator. The parameters ωcjk(t), ajk(t) and cj(t) are input by the operator through the performance data generator 10.

In this case, the musical factors can be synthesized with the above-mentioned formant control parameters Valj and time count data that vary depending upon the envelope information (data) or upon the lapse of time in compliance with various operations (1) that will be described later.

Here, the storage based on the lapse of time from the start of sounding or on the envelope level may be omitted, and, instead, the lapse of time from the start of sounding or the envelope level may be modification synthesized for each of the parameters ωcjk(t), ajk(t) and cj(t). The modification-synthesis is based upon a variety of operations (1) that will be described later, and an operation unit for modification-synthesizing the elapsed time of sounding or the envelope level is provided at the input terminals of the shift registers 601 . . . , 602 . . . , 603 . . . in FIG. 19.

These parameters ωcjk(t), ajk(t) and cj(t) can be selected and switched depending upon the envelope or the lapse of time from the start of sounding. The data for effecting the selection and switching will be part or whole of the parameters Valj (ωfj(t), ωcj(t), aj(t), cj(t), dj(t)) from the function operation unit 42.

The above-mentioned plural sets of formant carrier parameters ωcjk(t), formant carrier level parameters ajk(t) and formant carrier bias parameters cj(t) are for forming a formant carrier signal. A formant carrier signal is formed by addition-synthesizing or accumulation-synthesizing a plurality of sine waves or cosine waves having different frequencies, i.e., component waveforms.

The formant carrier parameters ωcjk(t) determine the speed of reading the cosine waves, i.e., frequency (frequency number). The formant carrier level parameters ajk(t) determine the level (amplitude coefficient) of cosine waves, i.e., weighting. The formant carrier bias parameters cj(t) determine the direct current component, i.e., bias of the formant carrier signal formed by synthesizing the cosine waves, and are stored in a number of only one in each of the sets. The formant carrier bias parameters cj(t) can be stored in a plurality of numbers (k=1 to k=n) per a musical factor.

Parameters ωcjk(t), ajk(t), cj(t) of n sets of from "k=1 to k=n" are stored in the harmonic wave memory 211 wherein the formant carrier level parameter ajk(t) of k=1 is larger than other formant carrier level parameters ajk(t) and k=1 represents a first harmonic wave, i.e., a fundamental wave. However, a formant carrier level parameter ajk(t) of other than k=1 may be regarded to have the greatest value, the component wave corresponding to the formant carrier level parameter ajk(t) of other than k=1 may be regarded to be a fundamental wave, and subharmonic components may be stored in addition to harmonic components.

The formant carrier parameter ωcjk(t) does not represent a value of frequency number but represents a ratio or a difference of the fundamental wave relative to the frequency number. For instance, if the value the formant carrier parameter ωcjk(t) of the fundamental wave is "1", then, the other formant carrier parameters ωcjk(t) will have values of "2", "3", "4", "5", . . . "0.5", "0.25", "0.125", . . . This means that the frequencies of the harmonic components or subharmonic components have a relation of integral ratios with respect to the frequency of the fundamental wave.

They, however, may have non-integral ratios such as "1.1", "1.2", "1.3" . . . "2.1", "2.2", "2.3" . . . "1.01" "1.02", "1.03" . . . "0.9", "0.8", "0.7" . . . "0.4", "0.3", "0.2" . . . "0.99", "0.98", "0.97" . . .

When the formant carrier parameters ωcjk(t) have differences from the formant carrier parameter ωcjk(t) of the fundamental wave, the formant carrier parameters ωcjk(t) will be, for example, "+0.01", "+0.02", "+0.03" . . . "+0.11", "+0.12", "+0.13" . . . "−0.01", "−0.02", "−0.03" . . . "−0.11", "−0.12", "0.13" . . .

Tone pitch information (data) or frequency number data input through the performance data generator 10 relying upon the formant carrier parameters ωcjk(t) are subjected to the multiplication or division depending upon the ratio, subjected to the addition or subtraction depending upon the difference, or are subjected to a variety of operations (1) that will be described later, and are sent to the formant waveform generator 60 that will be described later. If the formant carrier parameter ωcjk(t) representing a ratio or a difference relative to the frequency number of the fundamental wave undergoes a change depending upon the musical factors and the like, then, the frequencies of the component waves or the ratios of the frequencies undergo a change resulting in a change in the density of frequency components of the synthesized signals.

16. Formant Waveform Generator 60

Figure 19:
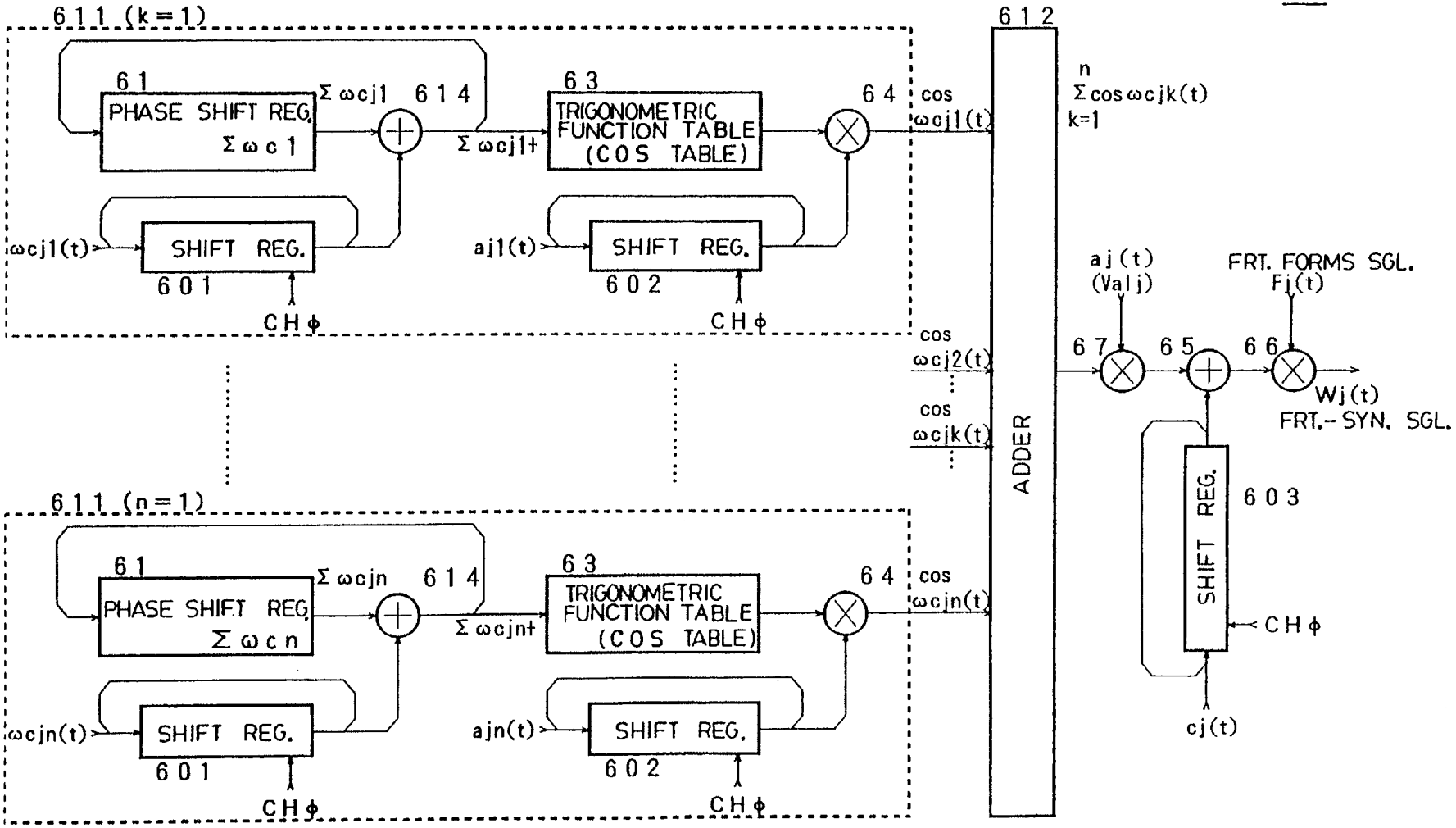
FIG. 19 is a diagram showing the formant waveform generator 60 according to a second embodiment.

FIG. 19 illustrates the formant waveform generator 60 according to another embodiment. The harmonic wave generators 611 generate cosine waves corresponding to a component waveform of a formant carrier signal, i.e., corresponding to harmonic waves or subharmonic waves, which are addition-synthesized through an adder 612 and are output in the form of a formant carrier signal.

The parameters ωcjk(t), ajk(t) and cj(t) corresponding to musical factors read out from the harmonic wave memory 211 by the controller 20, are stored in the shift registers 601 . . . 602 . . . , and 603 . . . The shift registers 601 . . . 602 . . . and 603 . . . have shift areas corresponding to the number of channels, and the above-mentioned parameters are stored in the divisional times of the channels to which is assigned musical tone that is synthesized by the formant waveform generator 60. The parameters ωcjk(t), cjk(t) and cj(t) of the channels are ooutput being sequentially shifted. In this case, the formant carrier parameters ωcjk(t) that are stored are values that are converted and operated into the frequency numbers.

The formant carrier parameters ωcjk(t) from the shift registers 601 . . . are accumulated in the adders 614 . . . upon the accumulated formant carrier parameters Σ ωcjk(t) sent from the phase shift registers 61 . . . , and are stored again in the phase shift registers 61 . . . The phase shift register 61 . . . have shift areas corresponding to the number.of channels such as j=1 to j=32, store accumulated formant carrier parameters Σ ωcjk(t) of all channels, and output them sequentially.

The accumulated formant carrier parameters Σ ωcjk(t) are fed as read-out address data to the trigonometric function tables 63 . . . The trigonometric function tables 63 . . . are storing waveform data of cosine waves; (i.e.,) the waveform data cos ωcjk(t) of cosine waves are read out in a time-divisional manner as a component waveform of a formant carrier signal Gj(t).

The component waveform of the formant carrier signal Gj(t) in the multipliers 64 . . . multiplies the formant carrier level parameters ajk(t) from the shift registers 602 and is envelope-controlled, and is further addition-synthesized in the adder 612 with other component waveforms controlled by envelope from other harmonic wave generator 611, and the formant waveform signal Fj(t) is multiplication-synthesized in the multiplier 66 for each of the channels. The synthesized formant carrier signal Gj(t) is multiplied and is envelope-controlled at the multiplier 67 by the formant carrier level parameter aj(t) from the formant control parameter generator 40, and is added at the adder 65 with a formant carrier bias parameter cj(t) from the shift register 603, i.e., added with a direct current component.

Thus, the formant carrier signal Gj(t) synthesized with the formant waveform signal Fj(t) acquires a waveform that contains harmonic components. In particular, values of the formant carrier parameters ωcjk(t), formant carrier level parameters ajk(t) and formant carrier bias parameters cj(t) stored in the harmonics memory 211 can be arbitrarily set or can be selectively switched in various ways, whereby the composition of harmonic components or subharmonic components is changed and, hence, the content (composition), frequency and/or a density of frequency components of a formant of component waveforms of the formant carrier signal Gj(t) is changed enabling the waveform of the formant carrier signal Gj(t) to be switched and selected in various ways.

In particular, the formant carrier parameter ωcjk(t) is representing a ratio or a difference with respect to the frequency number of the fundamental wave of the formant carrier signal Gj(t). Therefore, if the formant carrier parameter ωcjk(t) changes depending upon the musical factors and the like, the frequencies of component waveforms or ratios of the frequencies undergo a change resulting in a change in the density of the frequency components of the formant carrier signal Gj(t). In this case, if some of the formant carrier level parameters ajk(t) are set to "0", then, the number or range of the component waveforms of the formant carrier signal Gj(t) can be changed.

Furthermore, a formant-synthesized signal Wj(t) obtained by synthesizing the formant carrier signal Gj(t) and the formant waveform signal Fj(t) together, is output to the accumulator 70. The formant carrier signal Gj(t) is synthesized as a formant center signal (fundamental wave) with the formant waveform signal Fj(t).

Here, a plural (k=1 to k=n) of formant carrier bias parameters cj(t) may be stored in the shift registers and may be fed to the adder provided before or after the multipliers 64 . . . Moreover, the adder 65 may be a multiplier where the formant carrier bias parameter cj(t) may be multiplied.

Figure 20:
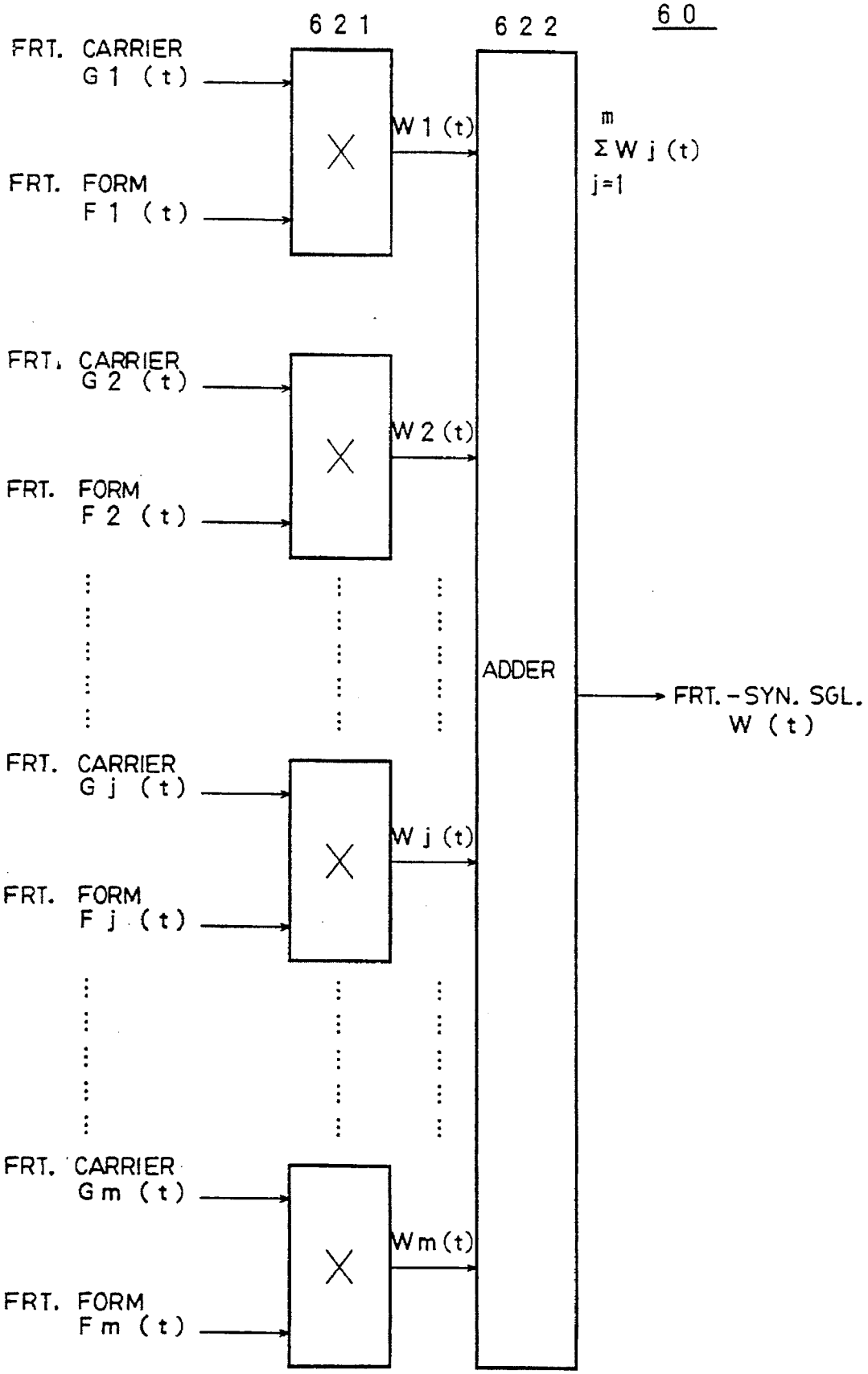
FIG. 20 is a diagram showing the formant waveform generator 60 according to a third embodiment.

The formant carrier signal Gj(t) and the formant waveform signal Fj(t) can also be synthesized together in a circuit shown in FIG. 20. In this case, the formant carrier signal Gj(t) and the formant waveform signal Fj(t) of each of the channels are simultaneously generated in parallel, multiplication-synthesized through the multipliers 621 . . . , addition-synthesized through the adder 622 and are output. In this case, the formant waveform generators 60 shown in FIG. 15 or 19 and the formant form waveform generators 50 shown in FIG. 10 are provided in a number corresponding to the number of channels.

Furthermore, the multiplication by the formant carrier level parameter ajk(t) at the multiplier 64 may be the addition of formant carrier level parameter ajk(t), may be the division when the parameter is not larger than "1", may be the subtraction when the parameter has a minus value, or may be a variety of operations (1) that will be described later, or the multiplication by the parameter ajk(t) may be omitted. The content of operation may be varied depending upon the musical factors, lapse of time from the start of sounding, envelope level, envelope phase and/or instruction of setting by the operator. For example, the above-mentioned operation will be a multiplication when the touch is small, tone pitch range is small, timbre is complex, envelope is small and lapse of time from the start of sounding is small. The operation will be a bit shift when the touch is large, tone pitch range is large, timbre is simple, envelope is large and lapse of time from the start of sounding is large. In this case, the operation units are provided in a plural number depending upon the operations, and the data input to the operation units are switched depending upon the musical factors and the like.

The harmonic wave generators 611 can be used in a reduced number or in a number of one by effecting the high-speed time-divisional processing. In this case, the numbers of shift registers 601 . . . 602 . . . , and phase shift registers 61 will be "(number of channels)×(degree of harmonics)", the number of the shift registers 603 is a (degree of harmonics), and the adder 65 is an accumulator.

As described above, the frequency of the formant carrier signals Gj(t) and the frequency of the formant waveform signals Fj(t) (formant waveform signals Ffj(t)) can be selected independently of each other, making it possible to produce a variety of musical tones. The frequency of formant carrier signals Gj(t) is determined depending upon a variety of frequency information (data) related to formant, other frequency information (data) and frequency modulation information (data) in addition to a specified tone pitch, and the frequency of the formant waveform signals Fj(t) (formant waveform signals Ffj(t)) is determined depending upon the above mentioned musical factors such as timbre, touch, tone pitch, etc.

The formant carrier signals Gj(t) or the component waveforms cos ωcjk(t) may be produced by the operation based upon the arithmetic operation executed by a digital signal processor or an operation circuit. The trigonometric function table 63 may store waveform data of a complex shape containing sine wave, chopping wave, root-angular wave or any other harmonic components instead of the waveform data of cosine wave.

Furthermore, the formant waveform signals Fj(t) may be fed, instead of the accumulated formant carrier parameters Σ ωcjk(t), to the trigonometric function table 63. Besides, the accumulated formant carrier parameters Σ ωcjk(t) may be added with or multiplied by the formant waveform signals Fj(t) and may, then, be fed to the trigonometric function table 63. The formant waveform signals Fj(t) and the formant carrier signals Gj(t) may be synthesized together by the above-mentioned multiplication or by various operations (1) that will be described later. This permits the formant waveform signals Fj(t) and the formant carrier signals cos ωcjk(t) to be synthesized together in a complex manner, making it possible to realize a variety of musical tones.

The formant carrier signals {aj(t)×Gj(t)+cj(t)) or the formant center signals, usually, may or may not be in agreement with a center signal at a peak point of the formant corresponding to the formant waveform signals {Ffj(t)+dj(t)}. This may, for instance, be the case where the level of the formant carrier signal Gj(t) is lower than the level at a peak point of formant. In the case of FIG. 4, the peak point of formant changes into two points on both sides of the center from a central point as the level of the formant carrier signal Gj(t) decreases. This is accompanied by a change in the quality of tone such as timbre. This is accomplished by suitably selecting the values of the formant control parameters ajk(t), cj(t) and dj(t). As a result, the quality of tone changes depending upon the musical factors, lapse of time (s) from the start of sounding, envelope levels and/or envelope phases.

It is also allowable that the formant waveform signals Ffj(t) are not multiplication-synthesized with the formant carrier signals Gj(t), the formant density parameters ωfj(t) are the ones determined by a specified tone pitch, and the formant waveform signals Ffj(t) are directly output as musical tones. Furthermore, the whole or part of the formant carrier parameters ωcjk(t) stored in the harmonic wave memory 211 can be omitted. In this case, the tone pitch data, i.e., frequency number data input through the performance data generator 10 are bitshifted into 2 times, 4 times, 8 times . . . , ½ times, ¼ times, ⅛ times . . . , and are sent to the shift registers 601 . . . where harmonic wave components and subharmonic wave components are formed.

The formant carrier parameters ωcjk(t), formant carrier level parameters ajk(t) and formant carrier bias parameters cj(t) can be changed depending upon the lapse of times from the start of sounding like the aforementioned formant control parameters Valj (ωfj(t), ωcj(t), aj(t), cj(t), dj(t)).

In this case, the parameters ωcjk(t), ajk(t), cj(t) are read out by the controller 20 from the harmonic wave memory 211, sent to the formant control parameter generator 40, operated into values corresponding to the lapse of time from the start of sounding (e.g., subjected to various operations (1) that will be mentioned later), and are sent to the formant waveform generator 60 shown in FIG. 19. Thus, the formant carrier parameter ωcjk(t) (frequency of component waveform), formant carrier level parameter ajk(t) (amplitude coefficient of component waveform), formant carrier bias parameter cj(t) (direct current component of synthesized waveform), and content of component waveform are changed depending upon the lapse of time from the start of sounding.

Moreover, the content of operation of the formant carrier level parameter ajk(t) at the multiplier 64 may be varied depending upon the lapse of time from the start of sounding. For instance, the operation is a multiplication when the elapsed time is short and is a bit shift when the elapsed time is long. In this case, the operation units are provided in a plural number depending upon the operations, and the data input to the operation units are switched depending upon the musical factors.

A variety of modifications, changes, uses, diversions, substitutions, additions, etc. for the formant control parameters Valj (ωfj(t), ωcj(t), aj(t), cj(t) and dj(t)) that are described above or will be described later, quite hold true directly and exclusively for the formant carrier parameters ωcjk(t), formant carrier level parameters ajk(t) and formant carrier bias parameters cj(t) that are described above or will be described later. This is because, the parameters Valj (ωcj(t), aj(t), cj(t)) and the parameters ωcjk(t), ajk(t) and cj(t) have quite the same natures. The above modifications will not be described here to avoid the specification from becoming lengthy.

The above-mentioned formant carrier signals Gj(t), formant carrier parameters ωcj(t), formant carrier level parameters ajk(t) and formant carrier bias parameters cj(t) can be directly diverted as parameters for forming formant waveform signals Ffj(t).

In this case, the parameters stored in the harmonic wave memory 211 for each of the musical factors are read out by the controller 20, subjected to the conversion operation depending upon the ratio or the difference, and are stored in the shift registers 601 . . . , 602 . . . , 603 . . . in the formant waveform generator 60. The component waveforms are then read out from the trigonometric function tables 63 . . . , multiplied by amplitude coefficients through the multipliers 64, and are addition-synthesized through the adder 612 with the component waveforms of which the amplitudes are controlled. Thus, the formant waveform signals Ffj(t) are produced by the synthesis of harmonic waves (subharmonic waves).

The thus synthesized formant waveform signals Ffj(t) are multiplication-synthesized by the parameters aj(t) through the multiplier 67, addition-synthesized with the parameters cj(t) through the adder 65, and are further multiplication-synthesized with the formant carrier signals Gj(t) through the multiplier 66.

As shown in FIGS. 3 and 4, the amplitude coefficients of frequency spectral components have various formant forms, which can be selected and switched depending upon the musical factors, lapse of times from the start of sounding, envelope levels, envelope phases and/or settings instructed by the operator. The multiplication by parameters aj(t) at the multiplier 67 may be omitted.

In this case, the frequency of the formant carrier signals Gj(t) determines the tone pitch of the synthesized musical tone, and the frequency of fundamental wave of component waveforms of formant waveform signals Ffj(t) can be set constant irrespective of the tone pitch or can be arbitrarily set irrespective of the tone pitch. Moreover, the density of frequency components of formant of the formant waveform signals Ffj(t) can be set irrespective of the tone pitch.

The formant carrier signals Gj(t) and the formant waveform signals Ffj(t) can be both produced by the synthesis of harmonic waves (subharmonic waves). These two signals produced by the synthesis are further subjected to the synthesis such as multiplication and are output to produce sound.

The formant carrier signals Gj(t) or the formant waveform signals Fj(t) formed by the synthesis of harmonic waves (subharmonic waves) can be once written and stored in the memory and can then be read out at the time of sounding so as to be sounded as musical tones. In this case, the signals that are synthesized are written into the formant form waveform memory (RAM) 53 or into the trigonometric function table (RAM) 62.

A variety of modifications, changes, uses, diversions, substitutions and additions mentioned with reference to the parameters ωcjk(t), ajk(t) and cj(t) for the formant carrier signals Gj(t) described earlier or that will be described later, quite hold true directly and exclusively even for the modifications and the like of the parameters for the formant waveform signals Ffj(t) that are described above or will be described later. This is because, these parameters have the same natures. The modifications and the like are not described here to avoid the specification from becoming lengthy.

Though not diagramed, selectors are provided at the input terminals of the shift registers 601 . . . , 602 . . . , 603 . . . Under normal condition, the selectors select the outputs of the shift registers 601 . . . , 602 . . . , 603 . . . , and feed them back, and the selection is switched by the controller 20 at a moment when the parameters ωcjk(t), ajk(t) and cj(t) are written by the controller 20.

17. Weight Interpolation Circuit

Figure 21:
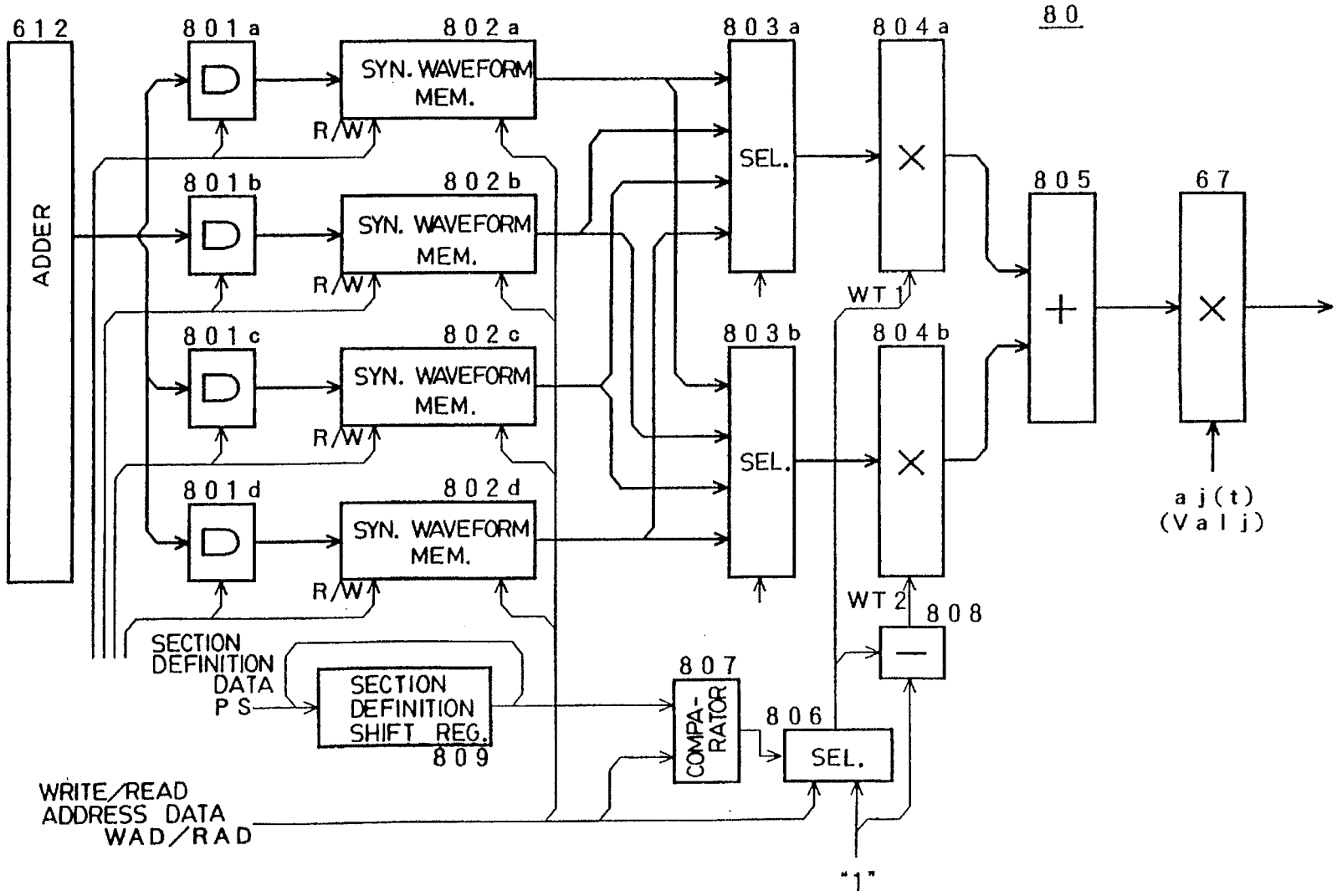
FIG. 21 is a diagram showing a weight interpolation circuit 80.

FIG. 21 shows a weight interpolation circuit 80 which is provided between the adder 612 and the multiplier 67 in FIG. 19. The signals Gj(t), Fj(t) and Ffj(t) addition-synthesized through the adder 612. the formant waveform generator 50 or the triangular function table 63 are written into any of synthesized waveform memories 802*a*, 802*b*, 802*c*, 802*d* through the AND gate groups 801*a*, 801*b*, 801*c*, 801*d*. The signals from the adder 612 are either the formant waveform signals Ffj(t) or formant carrier signals Gj(t). Here, the signals from the adder 612 are the formant waveform signals Ffj(t). In this case, the formant waveform signals Fj(t) and the formant carrier signals Gj(t) are replacemently (alternatingly) input to the multiplier 66 of FIG. 19.

Figure 22:
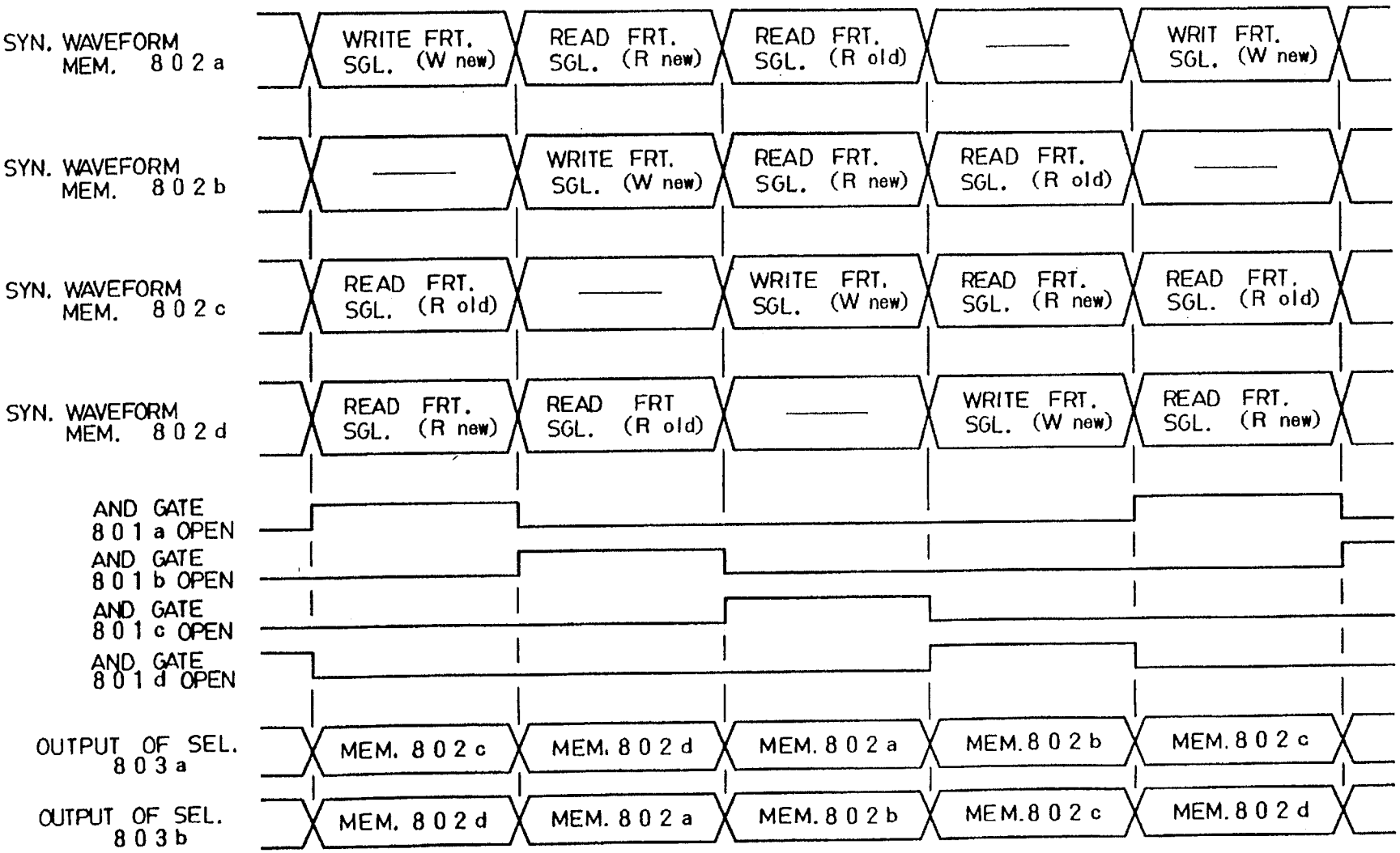
FIG. 22 is a time chart illustrating the write/read switching state of synthesized waveform memories 802*a* to 802*d* in the weight interpolation circuit 80.

As shown in FIG. 22, the formant waveform signals Ffj(t) are written into any one of the synthesized waveform memories 802*a*, 802*b*, 802*c*, 802*d* which are sequentially switched by a selector 801. Among these synthesized waveform memories 802*a* to 802*d*, the synthesized waveform memories 802*a* to 802*d* from which the formant waveform signals Ffj(t) are read out as signals after being changed are the synthesized waveform memories 802*a* to 802*d* into which the latest signals are written as shown in FIG. 22, and the synthesized waveform memories 802*a* to 802*d* from which the formant waveform signals Ffj(t) are read out as signals before being changed are the synthesized waveform memories 802*a* to 802*d* into which the signal are written just before the latest signals are written into the synthesized waveform memories 802*a* to 802*d*.

The select signal to the above-mentioned AND gate groups 801*a*, 801*b*, 801*c*, 801*d* and selectors 803*a* and 803*b*, enables the reading/writing shown in FIG. 22. The select signal is the one converted from the channel count data of a channel of time-divisional processing, or is a select signal from the controller 20. The read/write signal R/W to the synthesized waveform memories 802*a*, 802*b*, 802*c* and 802*d* is just an enable signal of the AND gate groups 801*a*, 801*b*, 801*c* and 801*d* or an inverted enable signal thereof.

The synthesized waveform memories 802*a*, 802*b*, 802*c* and 802*d* have channel areas corresponding to the number of time-divisional channels (16, 32, etc.), and store formant waveform signals Ffj(t) or formant carrier signals Gj(t) for all musical tones assigned to the channels.

As the write address data WAD or the read address data RAD for the synthesized waveform memories 802*a*, 802*b*, 802*c* and 802*d*, (use is made of) the above-mentioned integer data in accumulated formant carrier parameters Σ ωcjk(t) of the phase shift register 61 of the harmonic wave generator 611 that generates the fundamental wave are used. This brings the generation of formant waveform signals Ffj(t) into synchronism with the write/read of formant waveform signals Ffj(t) to and from the synthesized waveform memories 802*a* to 802*d*.

As the write address data WAD and the road address data RAD, there can be used high-order integer data of the accumulated formant density parameters Σ ωfj(t) of the phase operation unit 51 or of the accumulated formant carrier parameters Σ ωcj(t) of the phase shift register 61. Moreover, the write address data WAD or the read address data RAD may be the count data from the address counter (not shown). The address counter makes a count in response to a channel clock signal CHϕ.

The formant waveform signals Ffj(t) of one cycle are written into the synthesized waveform memories 802*a*, 802*b*, 802*c* and 802*d*. In this case, the formant waveform signals Ffj(t) have no relation to the tone pitch and, hence, the length of a cycle of the formant waveform signals Ffj(t) does not change depending upon the tone pitch. In reading the formant waveform signals Ffj(t), there is no need to change the reading speed depending upon the tone pitch. It is of course allowable to change the reading speed depending upon the tone pitch. When the formant carrier signals Gj(t) are written into the synthesized waveform memories 802*a* to 802*d* and are read out therefrom, high-order integer data of accumulated formant carrier parameters Σ ωcj(t) of the phase shift register 61 are used as the read address data RAD.

When the formant waveform signals Ffj(t) and formant carrier signals Gj(t) of a plurality of cycles are written into the synthesized waveform memories 802*a* to 802*d*, the following processing is carried out. That is, cosine waves of a plurality of cycles are stored in the trigonometric function tables 63 . . . of the harmonic wave generators 611. Or, carry high-order bit groups are added to the high-order integer data of accumulated formant carrier parameters Σ ωcjk(t) of the phase shift register 61 used for the write address data WAD or the read address data RAD of synthesized waveform memories 802*a* to 802*d*.

The selector 803*a* selects any one of the formant waveform signals Ffj(t) of the synthesized waveform memories 802*a*, 802*b*, 802*c* and 802*d*, and outputs it as a formant waveform signal Ffj(t) before being changed. The selector 803*b* selects any one of the formant waveform signals Ffj(t) of the synthesized waveform memories 802*a*, 802*b*, 802*c* and 802*d*, and outputs it as a formant waveform signal Ffj(t) after being changed.

The formant waveform signal Ffj(t) before being changed selected by the selector 803*a* is multiplied by a weight data WT1 through the multiplier 804*a*, the formant waveform signal Ffj(t) after being changed selected by the selector 803*b* is multiplied by a weight data WT2 through the multiplier 804*b*, and these two formant waveform signals Ffj(t) are additionally synthesized together through the adder 805, whereby the two formant waveform signals Ffj(t) are interpolated and are sent to the multiplier 67.

The relation between the weight data WT1 and the weight data WT2 is such that the sum of the two data is "1". Therefore, either one of the weight data WT1 or WT2 may be obtained by subtracting the other data from "1". As the weight data WT1, there can be used high-order data or the whole data of read address data RAD of the synthesized waveform memories 802*a* to 802*d*, and the weight data WT2 can be the one obtained by subtracting the read address data RAD from "1".

The weight data WT1 and WT2 change like, for example, "1, 0", "7/8, 1/8", "6/8, 2/8", "5/8, 3/8" . . . "1/8, 7/8", "0, 1", whereby weighting between the formant waveform signal Ffj(t) before being changed and the formant waveform signal Ffj(t) after being changed are sequentially shifted from the former toward the latter, and the interpolation between the two formant waveform signals Ffj(t) is shifted from before being changed to after being changed, permitting the formant waveform signals Ffj(t) to be smoothly changed.

In the above-mentioned case, the section where the formant waveform signals Ffj(t) before being changed and the formant waveform signals Ffj(t) after being changed are interpolated, is the whole section of formant waveform signals Ffj(t) that are stored in the synthesized waveform memories 802*a* to 802*d*. Here, however, the two formant waveform signals Ffj(t) may be partly interpolated. In this case, the above-mentioned fixed values "1" and "0" are used as the weight data WT1 and WT2 in the section where no interpolation is effected, and the high-order data or the whole data of the read address data RAD are used as the weight data WT1 and WT2 in the section where interpolation is effected as described above.

The selector 806 and comparator 807 of FIG. 21 work to realize part of this interpolation. Either the read address data RAD or the data "1" is directly fed to the multiplier 804*a* via the selector 806, and a value obtained by subtracting the address data RAD or the data 1" from the data "1" is fed to the multiplier 804*b* via the subtractor 808.

The comparator 807 compares the section definition data PS with the read address data RAD. When the read address data RAD is larger than the section definition data PS, the comparator 807 outputs a detection signal to switch the select data of the selector 806. Therefore, the section definition data PS defines a section for effecting the interpolation.

The section definition data PS is stored in the harmonic wave memory 211 together with the parameters ωcjk(t), ajk(t) and cj(t) for each of the musical factors, lapse of times from the start of sounding, envelope levels and/or envelope phases. Then, the section definition data PS assigned to the channels and corresponding to a musical tone that is to be sounded, is read out and is stored in a section definition shift register 809. The section definition shift register 809 has shift areas corresponding to the number of channels, the data are stored in the divisional time of a channel to which is assigned a musical tone synthesized by the formant waveform generator 60, and the section definition data PS of the channels are sequentially output.

Though not diagramed, a selector is provided at an input terminal of the section definition shift register 809. When the output of the section definition shift register 809 is selected by the selector and is fed back and when the section definition data PS is written by the controller 20, the selection of the selector is switched by the controller 20.

As described above, the contents of component waveforms in the harmonic wave generators 611 . . . amplitude coefficients ajk(t), contents of operation, weight data WT1 and WT2, and section definition data PS are changed depending upon the musical factors (timbre, volume of sound, effect, filtering characteristics, etc.), lapse of times from the start of sounding, envelope levels, envelope phases and/or settings instructed by the operator. Changes in the musical factors are detected by the controller 20, and the contents such as component waveforms are changed. This change causes a change in the waveforms of the formant waveform signals Ffj(t) that are synthesized and output by the harmonic wave generators 611 . . . , and in the content of interpolation and in the section of interpolation. In these changes, the formant waveform signals Ffj(t) are written into the synthesized waveform memories 802*a* to 802*d* and the above-mentioned interpolation is effected in these ranges.

As described above, the formant waveform signals Ffj(t) in FIGS. 21 and 22 are all substituted by the formant carrier signals Gj(t), and whereby the formant carrier signals Gj(t) are synthesized for their harmonic waves in a time-divisional manner. Furthermore, one of the synthesized waveform memories 802*a* to 802*d* can be omitted, and a memory can be omitted into which no formant waveform signal Ffj(t) is written or from which no formant waveform signal Ffj(t) is read.

Moreover, the synthesized waveform memories 802*a* to 802*d* may be all omitted and, instead, there may be provided harmonic wave generators 611 . . . for synthesizing the component waveforms of the formant waveform signals Ffj(t) before being changed, an adder 612, harmonic wave generators 611 . . . for synthesizing the component waveforms of formant waveform signals Ffj(t) after being changed, and an adder 612, so that the formant waveform signals Ffj(t) before being changed and after being changed are weighted and interpolated by the multipliers 804*a*, 804*b*, adder 805, selector 806, comparator 807, and subtractor 808.

With the above-mentioned formant waveform signals Ffj(t) of a plurality of cycles being stored in the synthesized waveform memories 802*a* to 802*d*, zero-cross points at the ends can be brought into agreement despite the frequencies of harmonic waves generated by the harmonic wave generators 611 having non-integral ratios with respect to the frequency of the fundamental wave. For instance, when there are synthesized harmonic wave components having non-integral ratios such as "1.25" and "1.05" with respect to the fundamental wave "1", zero-cross points are not in agreement in one cycle between the synthesized waveform and the fundamental wave, and the phases are not in agreement, either.

Figure 23:
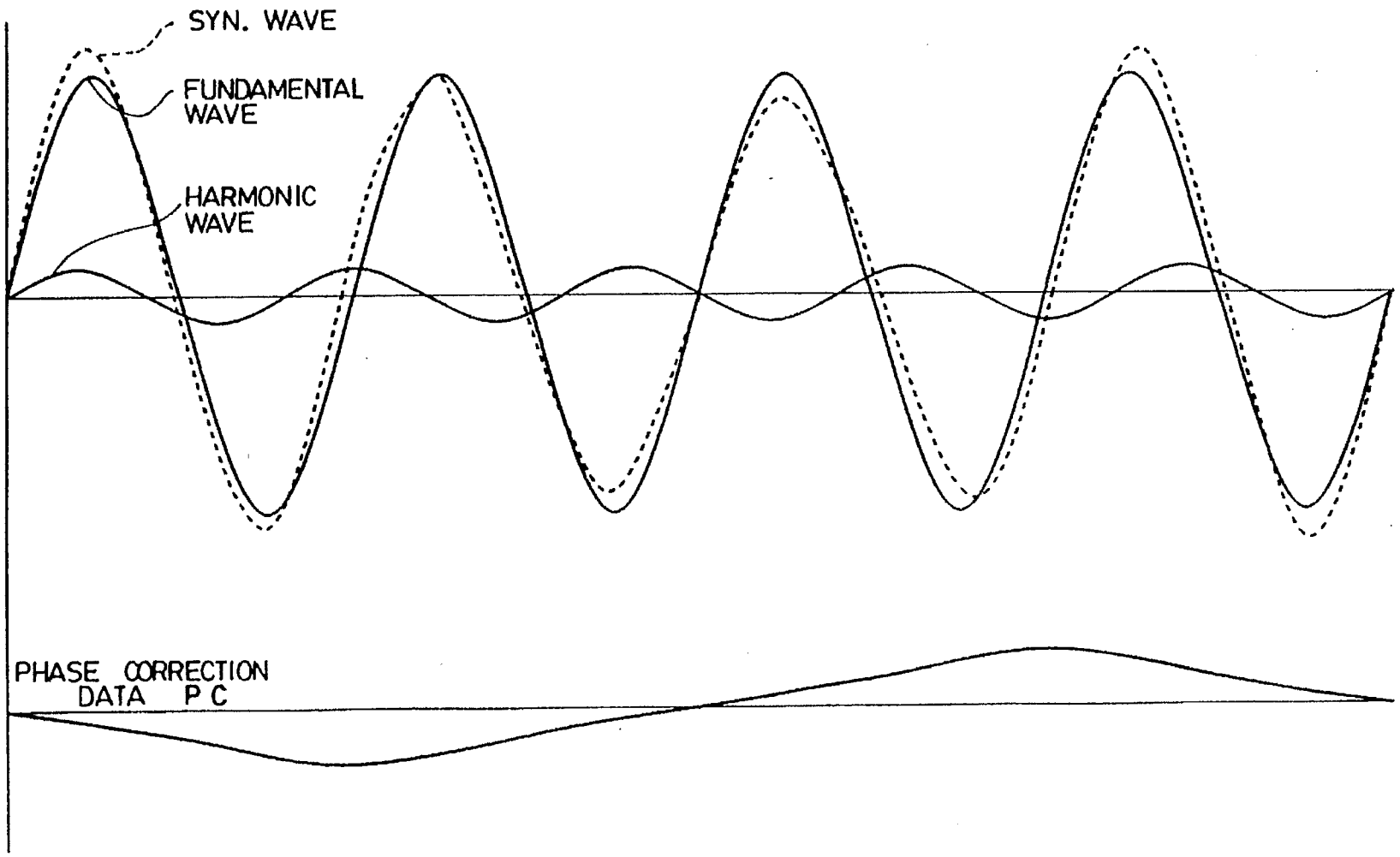
FIG. 23 is a diagram illustrating a phase difference between a fundamental wave and a waveform obtained by synthesizing the fundamental wave with a harmonic wave of a non-integral ratio.

When the fundamental wave is stored by 20 cycles, however, phases at the ends of the synthesized waveform and the fundamental wave come into agreement. This is shown in FIG. 23 where a broken line represents a waveform synthesized by the fundamental wave "1" and a harmonic wave "1.25". Though the phases are in agreement at the heads of the synthesized wave and the fundamental wave, zero-cross points are no longer in agreement in the way. However, zero-cross points are in agreement at the ends and phases are in agreement, too.

The phase difference caused by containing the component waveforms of harmonic components of non-integral ratios is corrected by phase correction data PC. In the example of FIG. 23, all phases and zero-cross points of the synthesized wave represented by the broken line are brought by the phase correction data PC into agreement with all phases and zero-cross points of the fundamental wave represented by a solid line. The phase correction data PC work to gradually correct tone pitch of the synthesized waveform, and are added to, multiply or divide the read address data RAD or the write address data WAD of the formant waveform signals Ffj(t) before being changed or after being changed. Accordingly, the phase can he corrected during when the formant waveform signals Ffj(t) before being changed or after being changed are written or are read out, or during both of them.

The phase correction data PC are stored in the harmonic wave memories 211 together with the parameters ωcjk(t), ajk(t) and cj(t) for each of the musical factors, lapse of times from the start of sounding, envelope levels and/or envelope phases. The phase correction data PC assigned to the channels and corresponding to a musical tone to be sounded are read out, and are written into a phase correction memory (not shown). The read address data RAD are fed even to the phase correction memory, whereby the phase correction data PC are sequentially read out, and are time-divisionally operated upon the read address data RAD of the synthesized waveform memories 802*a*, 802*b*, 802*c* and 802*d*. The correction memory is provided for each of the synthesized waveform memories 802*a*, 802*b*, 802*c*,and 802*d*.

This makes it possible to correct the phase. Even when the synthesized waveforms containing component waveforms of harmonic wave components of non-integral ratios are stored in the synthesized waveform memories 802*a*, 802*b*, 802*c* and 802*d*, such synthesized waveforms can be stored in one cycle, or can be stored in a plurality of cycles, as a matter of course.

The phase can be corrected even by using a filter. In this case, either one or both of the formant waveform signals Ffj(t) before being changed and after being changed are written into the synthetic waveform memories 802*a* to 802*d*, and 802 via the filter, or are sent to the multipliers 804*a*, 804*b* via the filter. The phase correction data PC are sent as filter characteristics data to the filter.

The interpolation through the adder 805 is a linear interpolation by an arithmetic mean value, but may be a curved interpolation by a geometrical mean value through the multiplier. Further, the value (or interpolated value) of the formant waveform signal Ffj(t) before being changed sent from the selector 803*a* may be set to be "A", the value of the formant waveform signal Ffj(t) after being changed sent from the selector 803*b* may be set to be "B", and the interpolation may be carried out based upon these two values and the above-mentioned weight data WT by using an operation circuit which repeats the operation of "A+(B−A) ×WT→A". Here, if the weight data WT is "½", the difference "B−A" between the interpolated value "A" and the target value "B" is simple shifted toward the low-order side by one bit, construction of the operation circuit is simple.

Furthermore, the selector 806, comparator 807 and section definition shift register 809 may be omitted, the section definition data PS may be omitted, the read address data RAD may be fed to the multipliers 804*a* and 804*b* at all times, and the whole sections of formant waveform signals Ffj(t) and Gj(t) stored in the synthesized waveform memories 802*a* to 802*d* may be specified as a section to be interpolated.

Figure 24:
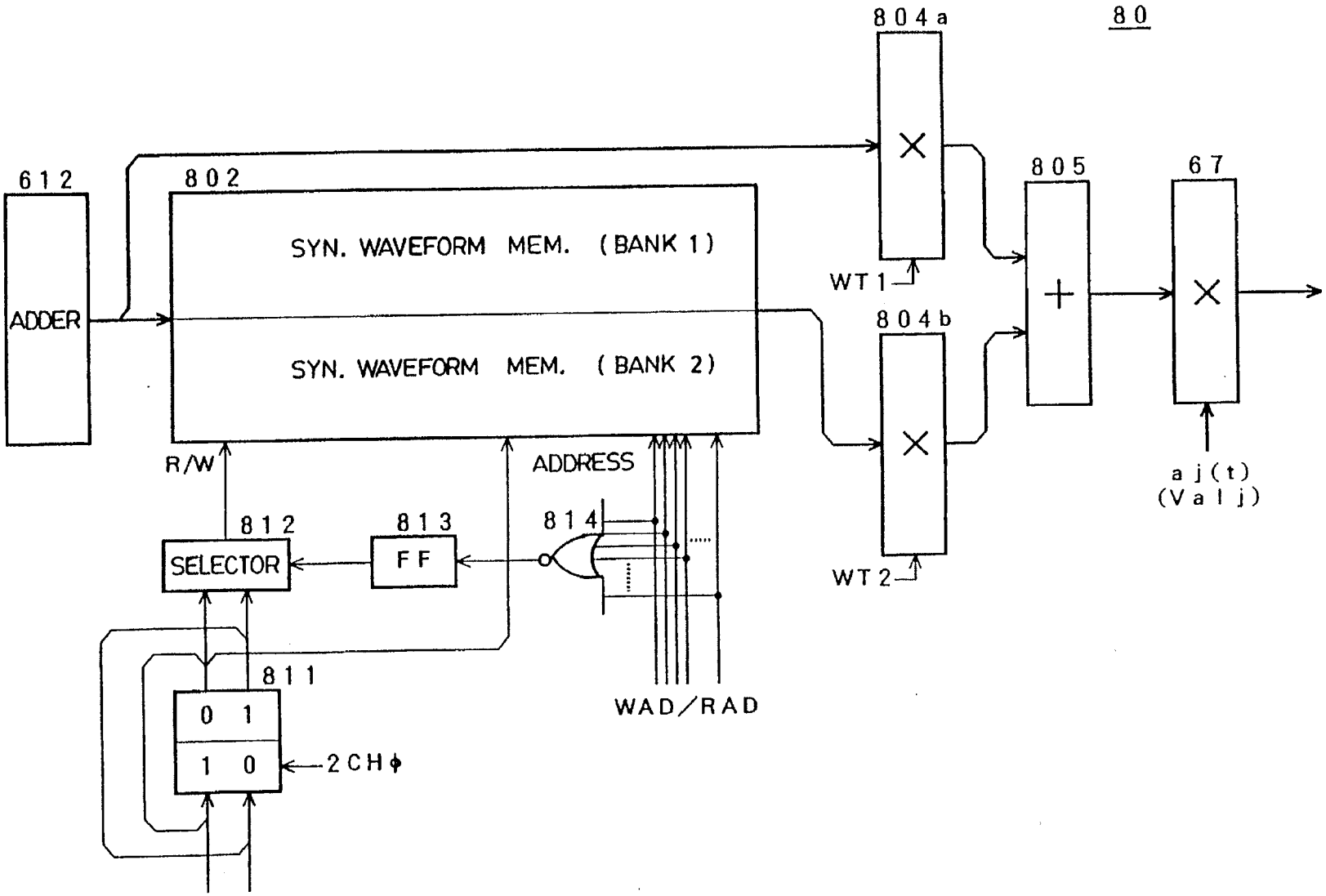
FIG. 24 is a diagram showing the weight interpolation circuit 80 according to the second embodiment.

FIG. 24 illustrates the weight interpolation circuit 80 according to a further embodiment. In this embodiment, the formant signals Fj(t) and Gj(t) are written into, and are read out from, one memory. The synthesized waveform memories 802*a*, 802*b*, 802*c* and 802*d* are merged into a single memory 802 which has two memory banks, each memory bank storing the formant signals Fj(t) and Gj(t) after being changed and before being changed of all channels.

The two states, i.e., writing of formant signals Fj(t), Gj(t) after being changed and reading of formant signals Fj(t), Gj(t) before being changed, are further switched in a time-divisional manner for each of the musical tones assigned to the channels. The formant signals Fj(t), Gj(t) after being changed written into the synthesized waveform memory 802 are also sent to the multiplier 804*a*, and the formant signals Fj(t), Gj(t) before being changed read out from the synthesized waveform memory 802 are sent to the multiplier 804*b* . Thus, the formant signals Fj(t) and Gj(t) after being changed and before being changed are weighed and interpolated.

In the switching shift register 811 are stored switching data CG "01", "10" which are sequentially ring-shifted. Among them, the high-order bits are fed as high order data of write/read address data WAD/RAD of the synthesized waveform memory 802, i.e., fed as bank switching data for the synthesized waveform memory 802. The frequency of shift clock signals 2CHϕ of the switching shift register 811 is twice as great as the frequency of the above channel clock signals CHϕ.

The high-order bits or the low-order bits of switching data CG "01", "10" of the switching shift register 811 are fed as read/write signal R/W to the synthesized waveform memory 802 via the selector 812. The bits of the write/read address data WAD/RAD of the synthesized waveform memory 802 are fed as an inverted signal to the flip-flop 813 via the NOR gate 814. The output signal of the flip-flop 813 is fed as a select signal to the selector 812.

Therefore, the output side of high-order bits or low-order bits of the switching data CG "01", "10" is switched (changed) only when the write/read address data WAD/RAD are "000 . . . 0 (all zeros)". Therefore, the banks of the synthesized waveform memory 802 into which the data are written or from which the data are read out, are alternatingly (replacemently) changed (switched). Other constitutions, operations, modifications, changes, uses, diversions, substitutions and additions are the same as those of the aforementioned embodiment of FIG. 21.

The formant waveform signals Ffj(t) before being changed (or after being changed) may be stored in the synthesized waveform memories 802*a* to 802*d* and in the banks of the synthesized waveform memory 802, and differential waveforms between the formant waveform signals Ffj(t) before being changed (or after being changed) and the formant waveform signals Ffj(t) after being changed (or before being changed) may be stored therein for each of the sampling points. Either one or both of these formant signals are corrected for their phases, additionally synthesized, and are output.

The synthesized waveform memory 802 may be substituted by a memory constituted by CCD (BBD) of the shift register type or of the delay line type. This memory is provided with CCDs of columns of a number equal to the number of bits of the formant signals Fj(t), Gj(t), and the formant signals Fj(t), Gj(t) of all channels are sequentially shifted by the shift clock signals SCϕ, and are output after one cycle or after a plurality of cycles.

The formant signals Fj(t), Gj(t) after being changed that are input to the synthesized waveform memory 802 of CCDs are then sent to the multiplier 804*a*, and the formant signals Fj(t), Gj(t) before being changed that are output are sent to the multiplier 804*b* where they are weighted and interpolated. The cycle of the shift clock signals SC0 is equal to the increment cycle of the write/read address data WAD/RAD. Other items are the same as those of the embodiment of FIG. 21.

It is of course allowable to use any other shift register, delay memory or latch memory as the synthesized waveform memory 802. The formant signals Fj(t), Gj(t) before being changed (or after being changed) and the formant signals Fj(t), Gj(t) before being changed (or after being changed) which is one before the above change, which are read out in a time-divisional manner from the synthesized waveform memory 802, may be multiplied by the weight data WT1 and WT2 through the multipliers 804*a* and 804*b*, and may be accumulation-synthesized through the accumulator and may then be sent to the multiplier 67. Furthermore, described above or later formant waveform signals Ffj(t) from the formant waveform memory 53 etc., described above or later formant carrier signals Gj(t) from the trigonometric function table 63 etc. (inclusive of the above-mentioned change), formant-synthesized signals Wj(t) from the multiplier 66 or accumulated formant synthesized signals Σ ω(gr(j)) from the accumulation memory 74 may be written into, or read out from, the synthesized waveform memories 802*a*, 802*b*, 802*c*, 802*d* and 802.

A variety of modifications, changes, uses, diversions, substitutions and additions mentioned for the formant carrier signals Gj(t), formant waveform signals Fj(t), other parameters Valj (ωfj(t), ωcj(t), aj(t), cj(t), dj(t), ωfjk(t), ωcjk(t), ajk(t), cjk(t), djk(t), WAD/RAD, etc.), data TD, SP, O, Min, Req, End, Ea and Ta which are mentioned above or will be mentioned later, all hold true directly and exclusively for the modifications and the like of the formant carrier signals Gj(t), formant waveform signals Fj(t) and other parameters that are mentioned above with reference to FIGS. 18 to 24 or will be mentioned later. This is because, these signals, parameters and data have the same natures. The modifications and the like are not described here to avoid the specification from becoming lengthy.

18. Formant Form Table 212

FIG. 25 shows a formant form table 212 of the program/data storage unit 21. In the formant form table 212 are stored the above-mentioned number of repeat top data Ta for each of the musical factors, lapse of times from the start of sounding, envelope levels and/or envelope phases.

The repeat top data Ta are specified being corresponded to the formant waveform signals Ffj(t) that are stored in the formant form waveform memory 53 for each of the musical factors, lapse of times from the start of sounding, envelope levels and/or envelope phases. In the formant form table 212 are also stored the repeat end data Ea, formant density parameters ωfj(t), speed data SP, target data O and mini-data Min in addition to the repeat top data Ta for each of the musical factors, lapse of times from the start of sounding, envelope levels and/or envelope phases.

The repeat top data Ta, formant density parameters ωfj(t) and repeat end data Ea are stored each in a set being corresponded to each other. The repeat top data Ta select and specify a number of formant waveform signals Ffj(t) stored in the formant form waveform memory 53 as described above.

The numbers of sets of repeat top data Ta, formant density parameters ωfj(t) and repeat end data Ea differ depending upon the musical factors, lapse of times from the start of sounding, envelope levels and/or envelope phases. The selection and switching of the parameter ωfj(t) and data Ta, Ea, Sp, O and Min can be input and specified by the operator through panel switch groups of the performance data generator 10. Depending upon the selection and switching, the corresponding parameters and data are written into the formant form table 212. The number or combination of formant waveform signals Fj(t) for a musical tone that is formed is changed and determined depending upon the musical factors, lapse of times from the start of sounding, envelope phases, envelope levels and/or settings instructed by the operator. The repeat top data, formant density parameters ωfj(t) and repeat end data Ea are input by the operator through the performance data generator 10.

As the number or combination of formant waveform signals Fj(t) changes, the number or combination of channels assigned to a musical tone changes in response thereto. The data are stored in a multiplexed manner for each of the musical factors, lapse of times from the start of sounding, envelope phases and/or envelope levels like the storage of the above-mentioned data SP, O, Min, Ta, Ea, formant waveform signals Ffj(t), formant density parameters ωfj(t), formant carrier parameters ωcj(t) or n sets of parameters ωcjk(t), ajk(t), cj(t).

In this case, the musical factors can be synthesized with the formant control parameters Valj, time count data, etc. that vary depending upon the envelope data or upon the lapse of time, in compliance with various operations (1) that will be described later.

The musical factors are input through the performance data generator 10 as described above. As described above, furthermore, the formant control parameters Valj, accumulated formant density parameters Σ ωfj(t), accumulated formant carrier parameters Σ ωcj(t) or time count data are, used as the lapse of time from the start of sounding, the formant control parameter aj(t) are used as the envelope level data, and the envelope phases are determined based upon the number of requested data Req that are counted.

The data may not be stored for each of the lapse of times from the start of sounding or the envelope levels, and, instead, the lapse of times from the start of sounding or the envelope levels may be correction-synthesized for each of the parameters ωfj(t) and data Ta, Ea, SP, O, Min. The correction-synthesis comply with various operations (1) that will be described later. An arithmetic unit for correction-synthesizing the elapsed time of sounding or the envelope level is provided at the output terminal of the parameter storage unit 41 or at the output terminal of the function operation unit of FIG. 5, between the output terminal of the formant density storage unit 52 and the input terminal of the phase operation unit 51 of FIGS. 10 and 28, at the input terminal of the exclusive OR gate group 512 of FIG. 13, at the input terminal of the selector 513, and at the input terminal of the adder 62 of FIG. 15.

The repeat top data Ta, formant density parameters ωfj(t), repeat end data Ea, and data SP, O, Min that are selected or input, are read out and are written by the controller 20 into the channel memory areas corresponding to the assigned channels of the assignment memory 213. Among the data that are written, the data SP, O and Min are sent to the formant control parameter generator 40, and the repeat top data Ta, formant density parameters ωfj(t) and repeat end data Ea are sent to the formant form waveform generator 50 where the form of the synthesized formant is changed and the number or combination of the formant waveform signals Fj(t) is controlled.

The data are sent by the controller 20 for each of the corresponding channel timings. The sending method has been disclosed in the specifications and drawings of, for example, Japanese Patent Applications Nos. 42298/1989, 305818/1989, 312175/1989, 2089178/1990, 409577/1990 and 409578/1990.

In the formant form table 212 can be further stored the above-mentioned formant control parameters cj(t), dj(t) of fixed values for each of the musical factors, lapse of times from the start of sounding, envelope phases and/or envelope levels, or being corresponded to the repeat top data Ta, formant density parameters ωfj(t) and repeat end data Ea.

19. Assignment Memory 213

Figure 26:
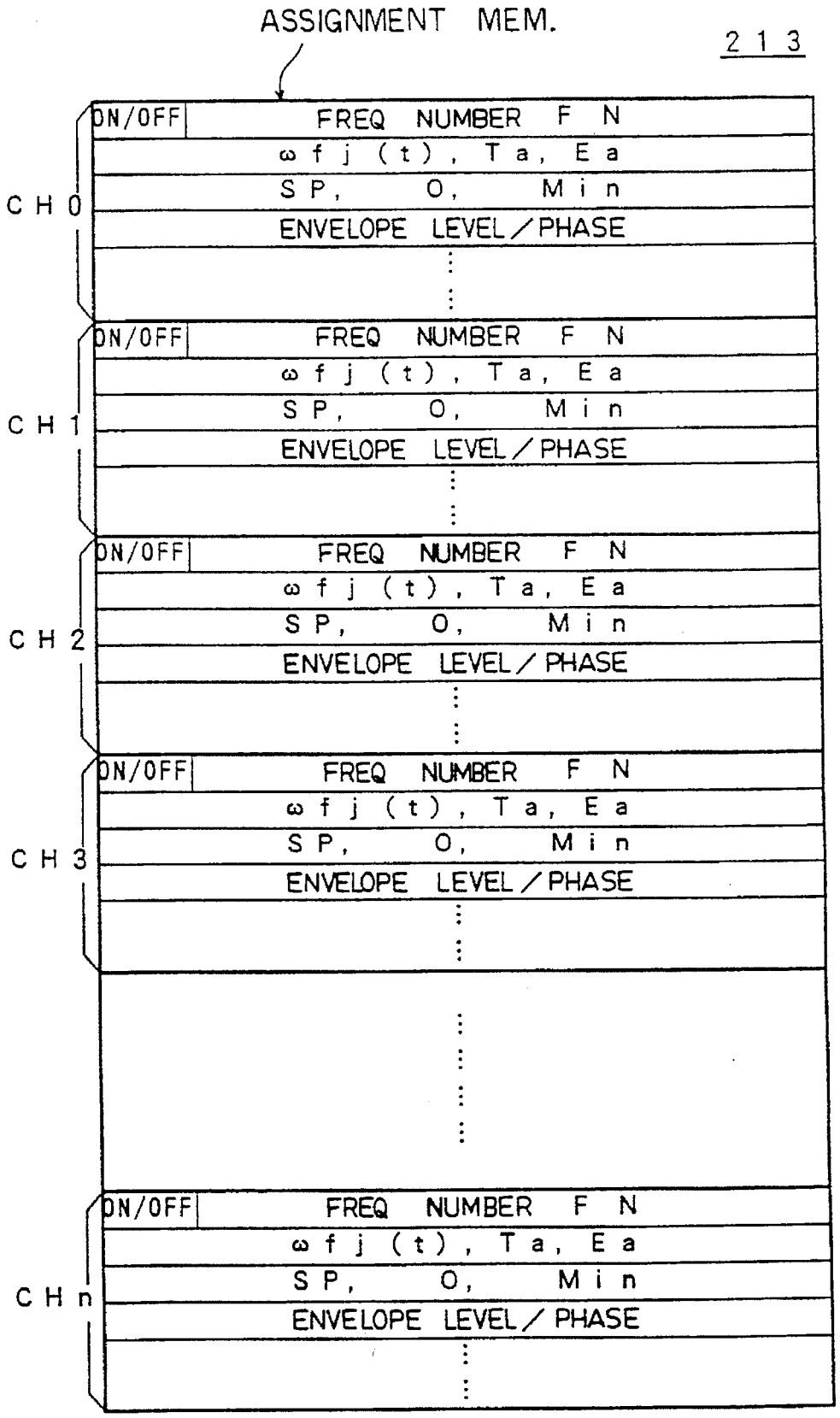
FIG. 26 is a diagram showing an assignment memory 213 in the program/data storage unit 21.

FIG. 26 illustrates the assignment memory 213 in the program/data storage unit 21. The assignment memory 213 has a plurality (16, 32, etc.) of channel memory areas and stores the data related to musical tones assigned to a plurality of musical tone-generating channels formed in the formant control parameter generator 40, formant form waveform generator 50 and formant waveform generator 60.

In the channel memory areas are stored repeat top data Ta of a musical tone to which the channels are assigned, formant density parameters ωfj(t), repeat end data Ea, various data SP, O, Min as well as on/off data, frequency number data FN (or key number data KN), envelope phase data, envelope level data, etc.

The on/off data represents that the musical tone that is assigned and is to be sounded is during the key on period, or is sounding ("1"), or is during the key-off period, or is in a silent state ("0"). The frequency number data FN represents the tone pitch of a musical tone which is assigned and is sounded. The high-order data of the frequency number data FN represents a tone pitch range or octave. The frequency number data FN are sent by the controller 20 to the formant waveform generator 60 during the divisional time of the corresponding channel. The envelope phase data represent the attack, decay, sustain or release of the envelope, and are counted depending upon the number of outputs of the request data Req.

When the number of set of the repeat top data Ta, formant density parameter ωfj(t) and repeat end data Ea is one and when musical tones that are assigned and are to be sounded are in a plural number, the frequency number data FN are written in a number same as the number of the plurality of musical tones into each of the channel memory areas at nearly the same sounding start timing. In this case, the plurality of frequency number data FN that are written have the same value but may have values that are slightly different from each other.

The plurality of formant waveform signals Fj(t) and the plurality of formant carrier signals Gj(t) assigned to the channels are formed by the formant control parameter generator 40, formant form waveform generator 50 and formant waveform generator 60, and are (additionally or multiplicationally) synthesized by being added, subtracted, multiplied or divided.

In the channel memory areas of the assignment memory 213 can be further stored musical factor data of musical tones that are assigned and sounded. Moreover, the assignment memory 213 may be provided not in the program/data storage unit 21, but in the formant control parameter generator 40, in the formant form waveform generator 50 or in the formant waveform generator 60. In the channel memory areas of the assignment memory 213 can be also stored the formant control parameters cj(t) and dj(t) having fixed values.

The method of assigning or truncating the channels formed by the time-divisional processing to the musical tones, i.e., the method of assigning or truncating the plurality of musical tone-generating systems for generating a plurality of musical tones in parallel to the musical tones, has been disclosed in, for example, Japanese Patent Applications Nos. 42298/1989, 305818/1989, 312175/1989, 2089178/1990, 409577/1990 and 409578/1990.

20. State for Changing the Number and/or the Combination of Formants

Figure 27:
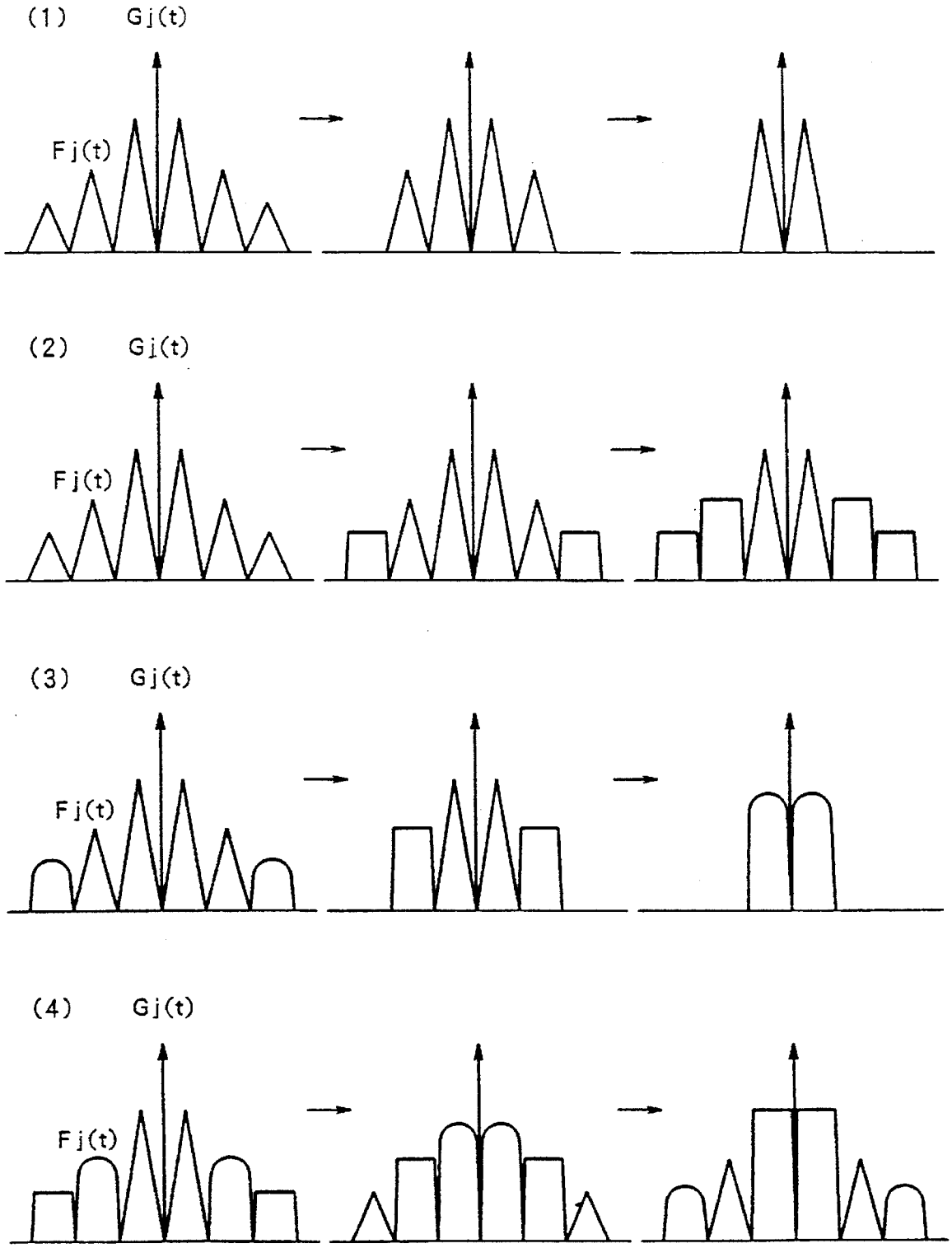
FIGS. 27(1),(2),(3) and (4) are diagrams showing the shapes of formant waveform signals Fj(t) and synthesized formants of which the number or combination is to be controlled.

FIG. 27 shows a relationship between the formant waveform signals Fj(t) of which the number or combination is controlled as described above and the formant of a synthesized waveform. In FIG. 27(1), three formant waveform signals Fj(t) are formed from one formant waveform signal Fj(t) by changing values of the formant density parameters ωfj(t) and the formant control parameters dj(t). The number of the three formant waveform signals Fj(t) changes into two and into one. Combination of the formant waveform signals Fj(t) does not change.

In FIG. 27(2), the combination of formant waveform signals Fj(t) is changing. The number of the formant waveform signals Fj(t) does not change. In FIG. 27(3), the combination and the number of the formant waveform signals Fj(t) are both changing. In FIG. 27(4), it appears that neither the number nor the combination of the formant waveform signals Fj(t) is changing. Here, the formant density parameters ωfj(t) and the formant control parameters dj(t) only are changing. This is one of the changes in the combination of the formant waveform signals Fj(t).

As described above, the number or combination of the formant waveform signals Fj(t) can be changed depending upon the musical factors, lapse of times from the start of sounding, envelope levels, envelope phases and/or settings instructed by the operator, and the quality of tone can be varied in a variety of ways. In this case, the number of peak points, positions and/or heights of formants change, too.

In the above-mentioned changes, the formant control parameters dj(t) only of the same formant waveform signal Fj(t) may be changed. The formant carrier signals Gj(t) are added by a number of times corresponding to the number of times of synthesis. Moreover, changes are not limited to those shown in FIG. 27; i.e., order of changes may be reversed, order of changes may be partly replaced, or patterns of changes may be increased or decreased.

The number of the formant waveform signals Fj(t) to be synthesized may be 4 or larger. Moreover, the formants of the formant waveform signals Fj(t) may be overlapped partly or entirely. This is done by suitably selecting the values of the formant density parameters ωfj(t). Then, the level additionally increases at a portion where the formants are overlapped, and new formant peak points can be formed. Furthermore, the formants shown in FIG. 27 may be added with other formants which, however, are not shown in FIG. 27.

21. Formant Form Waveform Generator 50

Figure 28:
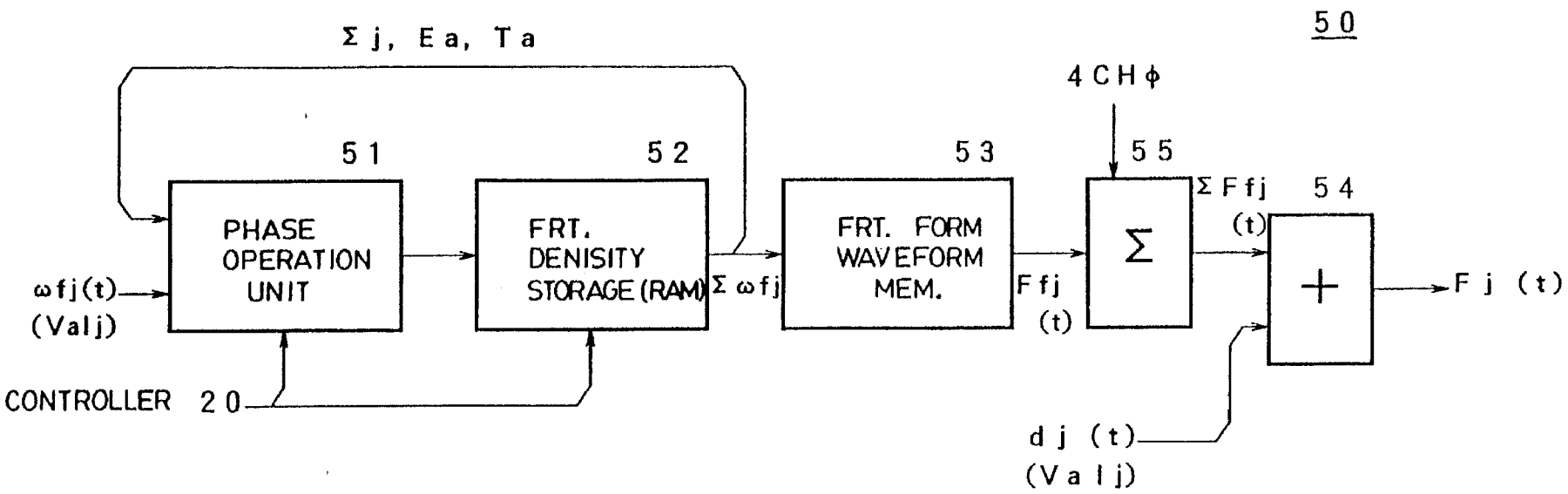
FIG. 28 is a diagram showing the formant form waveform generator 50 according to the second embodiment.

FIG. 28 illustrates the formant form waveform generator 50 according to another embodiment. In this formant form waveform generator 50, four formant waveform signals Ffj(t) are read out in a time-divisional manner during the period of time-division of a channel. Therefore, the time-divisional cycle for reading a formant waveform signal Ffj(t) is one-fourth the time divisional cycle of the processing for forming the whole musical tone.

In the formant density memory 523 of the formant density storage unit 52 are stored the accumulated formant density parameters Σ ωfj(t), and formant control parameters Taj, Eaj, U/D by amounts of (number of time division channels)×4, and the formant waveform signals Ffj(t) are read out in a number of four from the formant formwave form memory 53 for each of the channels. In response thereto, the formant control parameters Vaj, TD and V are stored by amounts of (number of time-division channels)×4 in the parameter memory 411 in the parameter storage unit 41.

The four formant waveform signals Ffj(t) that are read out are accumulated by the accumulator 55 for each of the channels, added to the formant waveform bias parameters dj(t) through the adder 54, and are sent as formant waveform signals Fj(t) to the formant waveform generator 60.

Then, as shown in FIGS. 27(1) to 27(4), a plurality of formant waveform signals Fj(t) are additionally synthesized, formant waveform signals Fj(t) are synthesized having a formant as obtained by synthesizing a plurality of formants, and the number or combination of the formant waveform signals Fj(t) is controlled. The thus synthesized formant waveform signals Fj(t) are additionally or multiplicationally synthesized with the formant carrier signals Gj(t) by being added, subtracted, multiplied or divided through the multipliers 66, 621 of the formant waveform generator 60.

In this embodiment, four formant waveform signals Fj(t) are multiplicationally or additionally synthesized with a formant carrier signal Gj(t) by the addition, subtraction, multiplication or division. The number of the formant waveform signals Fj(t) to be synthesized may be other than 4. In this case, the cycle of time division for reading the formant waveform signals Fj(t) is changed, or the value of formant density parameters ωfj(t) of the formant control parameter generator 40 and the value of accumulated formant density parameters Σ ωfj(t) of the formant density storage unit 52 are set to "0" for some of the four formant waveform signals Fj(t), so that the formant waveform signals Fj(t) are not partly read out. This makes it possible to control the number or combination of the formant waveform signals Fj(t).

The formant carrier signal Gj(t) and a plurality of the formant waveform signals Fj(t) can be synthesized together even by using the circuit shown in FIG. 20. In this case, the formant carrier signal Gj(t) and the formant waveform signals Fj(t) of each of the channels are generated simultaneously and in parallel, and are multiplication-synthesized through the multipliers 621 . . . , and are addition-synthesized through the adder 622, and are output. In this case, the formant waveform generators 60 of FIG. 15 or 19 and the formant form waveform generators 50 of FIG. 10 or 28 are provided in a number corresponding to the number of channels.

22. Formant Waveform Generator 60

Figure 29:
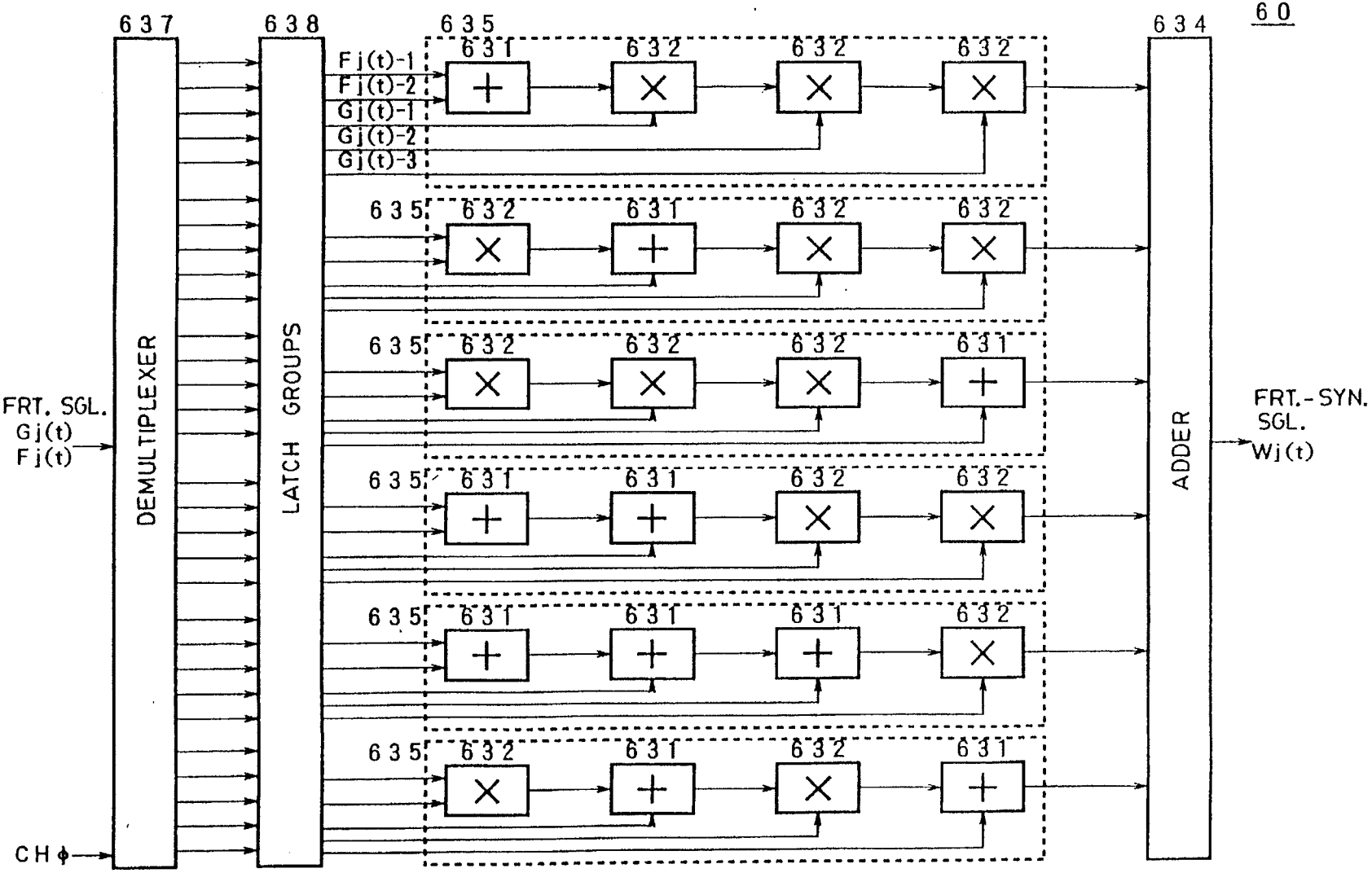
FIG. 29 is a diagram showing the formant waveform generator 60 according to a fourth embodiment.

FIG. 29 illustrates the formant waveform generator 60 according to a further embodiment. In the first multiple synthesis device 635, a plurality of formant waveform signals Fj(t)–1, Fj(t)–2 are additionally synthesized through the adder 631, and are then multiplexingly and multiplicationally synthesized with the formant carrier signals Gj(t)-1, Gj(t)-2, Gj(t)3 through the three multipliers 632, 632, 632, sequentially. The form of the synthesized formant can be changed even by such a multiplex synthesis, and the number or combination of the formant waveform signals Fj(t) can be thus changed.

Figure 31:
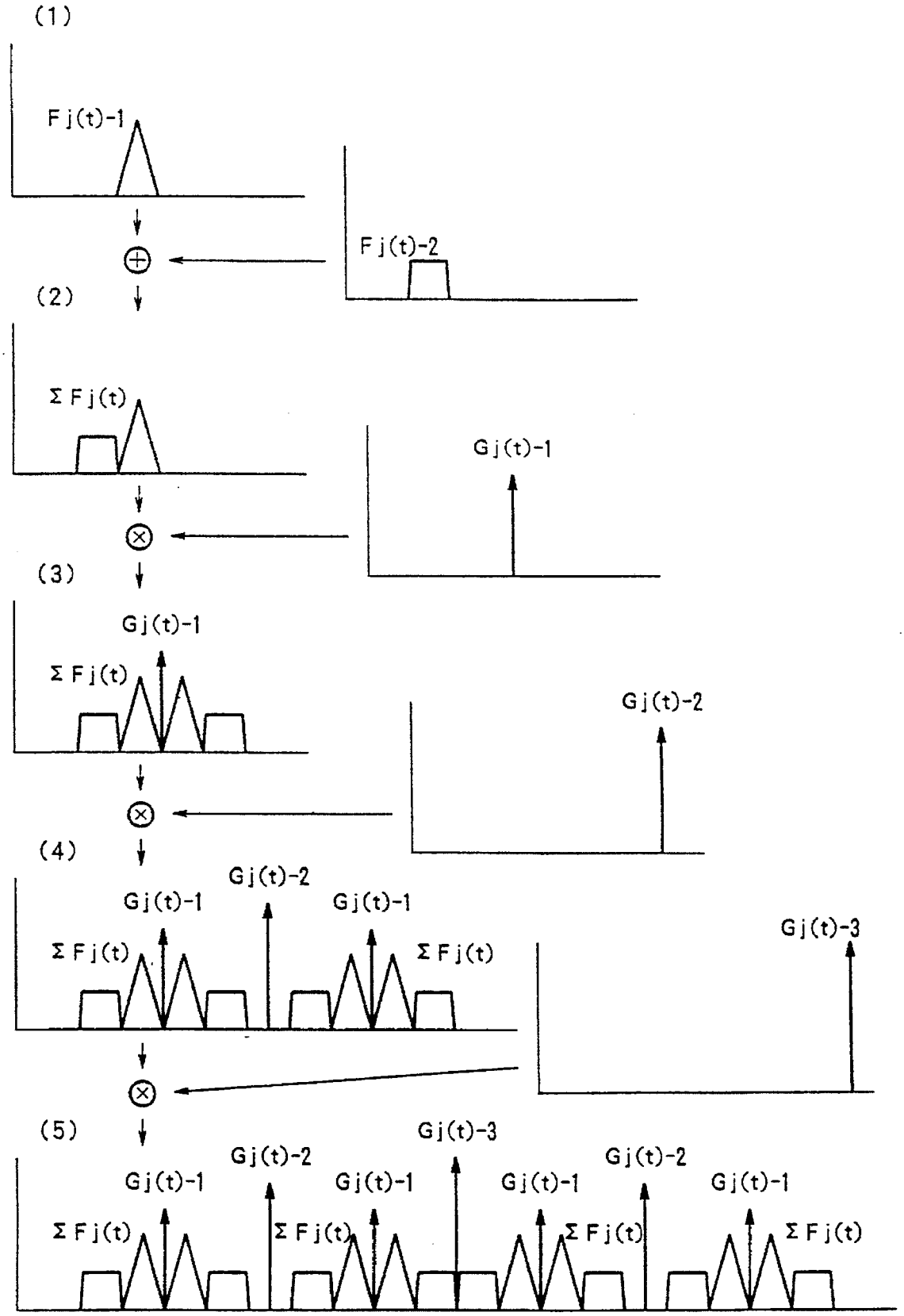
FIGS. 31(1), (2), (3), (4) and (5) are diagrams showing the shapes of formant waveform signals Fj(t), formant carrier signals Gfj(t) of which the number or combination is to be controlled and synthesized formant.

This is shown in FIG. 31. The formant waveform signals Fj(t)-1 and Fj(t)-2 are synthesized to form a synthesized formant which is then synthesized with formant carrier signals Gj(t)-1, Gj(t)-2 and Gj(t)-3, successively. Therefore, the number of synthesized formants increases and it is possible to generate musical tones having more complex formant forms. The formants shown in FIG. 31 may further be added with other formants depending upon the cases, which other formants, however, are not shown in FIG. 31.

This holds true even for the second multiple synthesis device 635, third multiple synthesis device 635, fourth multiple synthesis device 635, fifth multiple synthesis device 635 . . . In these cases, forms of the synthesized formants, combinations, positions and numbers thereof are different from those of the first multiple synthesis device 635. The adders 631 . . . and multipliers 632 . . . may be those of the two-input type or may be those having not less than two inputs, and more than two formant signals Gj(t), Fj(t) may be (additionally or multiplicationally) synthesized simultaneously by the addition, subtraction, multiplication or division.

In this embodiment, the formant waveform controller 60 of FIG. 1 is omitted, and a plurality of formant carrier signals Gj(t) are stored as a formant waveform signal Fj(t) in the formant density storage unit 52. Five channels are assigned for one musical tone, and the selected and switched formant carrier signals Gj(t) or the formant waveform signals Fj(t) are generated through the channels. The number of channels for a musical tone may be other than 5.

The formant carrier signals Gj(t) or the formant waveform signals Fj(t) are selected and switched based upon the musical factors, lapse of times from the start of sounding, envelope levels, envelope phases and/or settings instructed by the operator. In this case, the formant form table 212 is used for storing the above-mentioned numbers of repeat top data Ta, repeat end data Ea, formant density parameters ωfj(t) (or formant carrier parameters ωcj(t)), speed data SP, target data O, and mini-data Min for each of the musical factors, lapse of times from the start of sounding, envelope levels and/or envelope phases.

The selection and switching of the formant signals Gj(t), Fj(t) are input and specified by the operator through panel switch groups of the performance data generator 10. In this case, the corresponding data Ta, Ea, ωfj(t) (ωcj(t)), SP, O and Min are written into the formant form table 212 depending upon the selection and switching.

The repeat top data Ta, formant density parameters ωfj(t) (or formant carrier parameters ωcj(t)) and repeat end data Ea are stored each in a set being corresponded to each other. In this case, the formant carrier signals Gj(t) read out by the formant carrier parameters ωcj(t) and the formant waveform signals Fj(t) read out by the formant density parameters, ωfj(t) are stored in the same memory 53. Therefore, the parameters ωcj(t) are the same as the parameters ωfj(t).

In the channel memory areas of the assignment memory 213 are stored repeat top data Ta of a musical tone assigned to the channels, formant density parameters ωfj(t) (ωcj(t)), repeat end data Ea and various data Sp O, Min, as well as on/off data, frequency number data FN (or key number data KN), envelope phase data, envelope level data, etc.

These data are sent to the formant control parameter generator 40 and to the formant form waveform generator 50, and the formant carrier signals Gj(t) or the formant waveform signals Fj(t) are read out and are generated in a time-divisional manner. The formant signals Gj(t), Fj(t) are stored in parallel in the latch groups 638 via a demultiplexer 637, and are fed to the adders 631 . . . or to the multipliers 632 . . . in the multiple synthesis groups 635 . . . The formant-synthesized signals Wj(t) multiplexingly synthesized through the multiple synthesis devices 635 . . . are sent to the adder 634 where the musical tones are additionally synthesized and are output. The demultiplexer 637 and the latch group 638 may be provided on the input side of the circuit of FIG. 20 in order to receive formant signals Gj(t) and Fj(t) that are being sent in a time-divisional manner.

23. Multiple Synthesis Device 635

Figure 30:
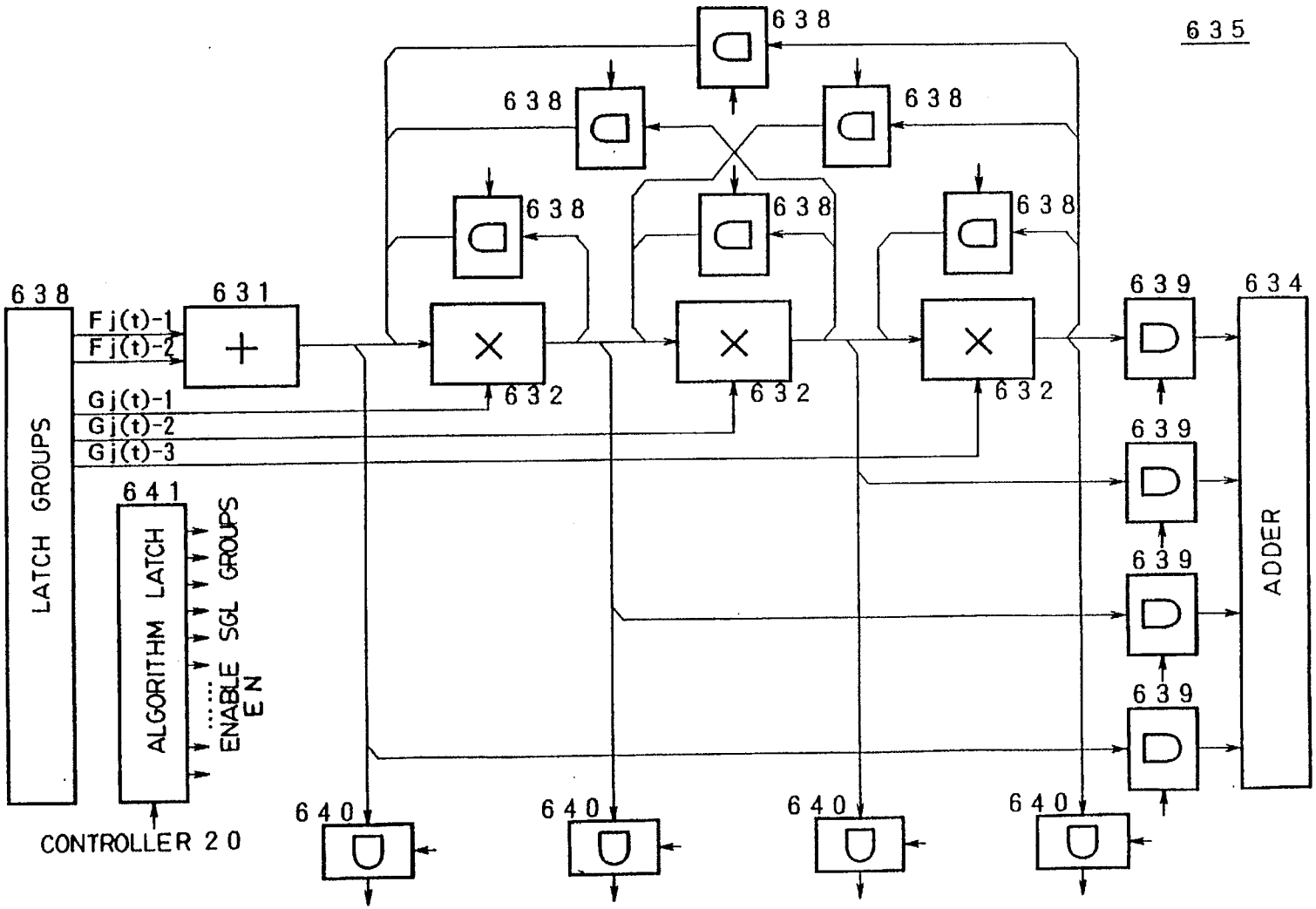
FIG. 30 is a diagram illustrating a multiple synthesis device 635 in further detail.

FIG. 30 is a diagram illustrating the multiple synthesis device 635 in more detail. The outputs of the multipliers 632 . . . are fed back to other multipliers 632 . . . or to the same multipliers 632 via AND gate groups 638 . . . Due to this feedback, the formant signals Gj(t) and Fj(t) are synthesized with the same signals Gj(t), Fj(t) or with other signals Gj(t), Fj(t), so that the synthesis is effected in a more complex and multiplexed manner, and the form of the synthesized formant is changed and the number or combination of the formant waveform signals Fj(t) is controlled.

Furthermore, the outputs of the multipliers 632 are input to the adders 634 via AND gate groups 639 . . . Therefore, synthesized signals are output from the last or middle portions of the multiple synthesis device 635, the steps of multiple synthesis are switched, the form of the synthesized formant is changed, and the number or combination of the formant waveform signals Fj(t) is controlled.

The outputs of the multipliers 632 are input via the AND gates 640 . . . to the adders 631 and multipliers 632 of other multiple synthesis devices 635. Accordingly, the multiple synthesis becomes more complex and more multiplexed, whereby the form of the synthesized formant is changed, and the number or combination of the formant waveform signals Fj(t) is controlled.

Enable signal groups EN of the AND gate groups 639 . . . are simultaneously sent in parallel from the algorithm latch 641. The contents of the enable signal groups EN change depending upon the musical factors, lapse of times from the start of sounding, envelope levels, envelope phases and/or settings instructed by the operator. This results in a change in the course of multiple synthesis, i.e., in the algorithm of synthesis operation, in a change in the combination of formant signals Gj(t) and Fj(t) that are synthesized, and in a change in the form of the synthesized formant, whereby the number or combination of the formant waveform signals Fj(t) is controlled.

In this case like in the above-mentioned formant form table 212, the enable signal groups EN are stored in a multiplexing manner for each of the musical factors, lapses of times from the start of sounding, envelope levels and/or envelope phases, and the corresponding signals are read out and are stored in the algorithm latch 641 by the controller 20. The enable signal groups EN are selected and are read out even by the settings instructed by the operator.

The contents of the enable signal groups EN are input by the operator through the panel switch groups of the performance data generator 10. Here, the input enable signal groups EN are written into the same table as the formant form table 212. Though not diagramed, OR gate groups are provided at the input terminals of the multipliers 632 . . .

In this case, the musical factors can be synthesized with formant control parameters Valj and time count data that change depending upon the envelope data or upon the lapse of time in compliance with various operations (1) that will be described later.

The data may not be stored for each of the lapse of times from the start of sounding and/or the envelope levels, and, instead, the lapse of times from the start of sounding or the envelope levels may be modification-synthesized for each of the enable signal groups EN. The correction-synthesis is effected in compliance with various operations (1) that will be described later, and an operation unit is provided at the input terminal of the algorithm latch 641 of FIG. 30 in order to modification-synthesize the lapse of time from the start of sounding or the envelope level.

24. Multiple Synthesis Devices 635

Figure 32:
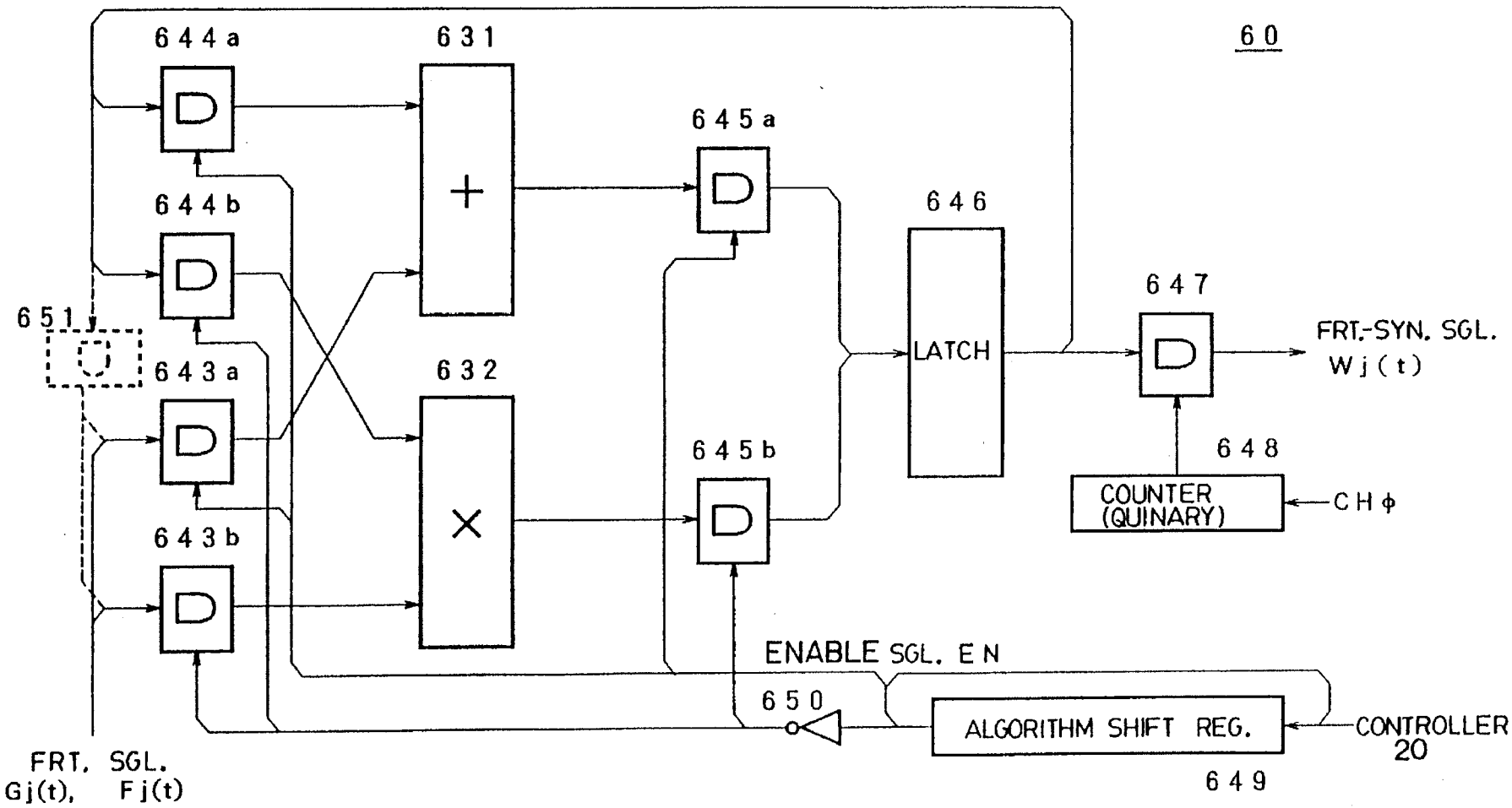
FIG. 32 is a diagram showing the formant waveform generator 60 according to a fifth embodiment.

The circuit of FIG. 32 is realized by modifying the formant waveform generator 60 of FIG. 29 based on a time-divisional manner. The formant signals Gj(t) and Fj(t) that are generated in a time-divisional manner and sequentially from the formant form waveform generator 50 are fed to the adder 631 or to the multiplier 632 through the AND gate group **643*a* or 643*b*. Furthermore, the signals operation-synthesized by the latch 646 are fed to the adder 631 or to the multiplier 632 via the AND gate group 644*a* or 644*b***.

The above signals are additionally or multiplicationally synthesized through the adder 631 or the multiplier 632 by being added, subtracted, multiplied or divided, and are stored in the latch 646 through the AND gate group **645*a* or 645*b***. The operation-synthesis of formant signals Gj(t), Fj(t) based upon addition, subtraction, multiplication or division is repeated in a multiplexed manner for each of the channel times, whereby the form of the synthesized formant is changed, and the number or combination of the formant waveform signals Fj(t) is controlled.

The formant synthesized signal Wj(t) synthesized by the latch 646 is output through the AND gate group 647. The enable signal of the AND gate group is an overflow signal from the counter 648 to which a channel clock signal CHϕ is input in an increment signal. The counter 648 is a quinary one which is the same as the number of channels to which a musical tone is assigned, and the base changes if the number of channels of one musical tone changes. To the AND gate groups 643a, **644*a* and 645*a* are serially fed the enable signal groups EN from the algorithm shift register 649 sequentially and for each of the time-divisional channels, and to the AND gate groups 643*b*, 644*b* and 645*b* are fed the enable signals from the algorithm shift register 649 being inverted through the inverter 650**. The contents of the enable signal groups EN change depending upon the musical factors, lapse of times from the start of sounding, envelope-levels, envelope phases and/or settings instructed by the operator, and whereby the multiple synthesis route (course, source) or the algorithm of synthesizing operation changes, the combination of the formant signals Gj(t), Fj(t) to be synthesized changes, the form of the synthesized formant changes, and the number of combination of the formant waveform signals Fj(t) is controlled.

In this case, like in the above-mentioned formant form table 212, the enable signal groups EN are stored in a multiplexed manner for each of the musical factors, lapse of times from the start of sounding, envelope levels and/or envelope phases, or are input by the operator through the panel switch groups of the performance data generator 10, and the corresponding signals are read out and are stored by the controller 20 in the algorithm shift register 649. In this case, the enable signal groups EN can also be selected and read out even by the settings instructed by the operator.

In this case, the musical factors can be synthesized with the formant control parameters Valj or the time count data that vary depending upon the envelope data or upon the lapse of time in compliance with a variety of operations (1) that will be described later.

The data may not be stored for each of the lapse of times from the start of sounding and/or the envelope levels, and the lapse of times from the start of sounding and/or the envelope levels may be modification synthesized for each of the enable signal groups EN. The modification-synthesis is carried out in compliance with various operations (1) that will be described later, and an operation unit is provided at the input terminal of the algorithm shift register 649 of FIG. 32 in order to modification-synthesize the lapse of times from the start of sounding and/or the envelope levels.

The algorithm shift register 649 is of the ring-shift type having stages of a number of (number of channels per a musical tone)×(number of all musical tones). When a new musical tone is sounded, the enable signal EN is stored at each of the channel timings of the musical tone that is sounded. The enable signal EN determines in time series the course of multiple synthesis.

The circuit of FIG. 32 does not permit the algorithm of feedback to the same signal. This, however, can be done if the output of the latch 646 is fed to the AND gate groups 643*a* and 643*b* via the AND gate group 651 as indicated by a chain line in FIG. 32. However, the formant signals Gj(t) and Fj(t) from (of) the formant form waveform generator 50 are not fed to the AND gate groups 643*a* and 643*b* at the time of the channel of self feedback. In this case, no data is assigned to the channel which corresponds to this channel timing. The circuit of FIG. 32 permits algorithm of feedback to other signals.

The enable signal groups EN are input by the operator through the panel switch groups of the performance data generator 10. In this case, the enable signal groups EN that are input are written into the same table as the formant form table 212.

The aforementioned modifications, changes, uses, diversions, substitutions and additions for the formant form table 212 and for the assignment memory 213 of the above-mentioned embodiment quite hold true directly and exclusively for the modifications and the like of this embodiment. The modifications and the like, however, are not described here to avoid the specification from becoming lengthy.

Though not diagramed, OR gate groups, in practice, are provided at the input terminals of the latch 646 and the AND gate groups 643*a* and 643*b*. Moreover, though not diagramed, a selector is provided at the input terminal of the algorithm shift register 649. The selector usually selects the output of the algorithm shift register 649 and feeds it back, and the selection of the selector is switched by the controller 20 when the enable signal is written by the controller 20.

In this multiple synthesis, if it is presumed that the formant carrier signal Gj(t) itself has a line of formant, then, the formant carrier signal Gj(t) can be additionally or multiplicationally synthesized like the formant waveform signals Fj(t). By effecting the synthesis in a multiplexing manner, musical tones having more complex formant forms can be generated, and the number or combination of the formant waveform signals Fj(t) can be controlled.

It is further allowed to use the formant waveform signals Fj(t) in place of the formant carrier signals Cj(t), and a plurality of formant waveform signals Fj(t) can be multiplicationally synthesized. In this case, the form of the formant that is generated becomes the one that is obtained by modifying the form of formant of the formant waveform signals Fj(t), and the number or combination of the formant waveform signals Fj(t) can be controlled.

Moreover, if the level of any one of the signals input to the adders 631 . . . of the multiple synthesis devices 635 . . . is set to "0" or if the level of any one of the signals input to the multipliers 632 . . . is set to "1", then, the adders 631 . . . and the multipliers 632 . . . are placed in a through state, so that the synthesis is not carried out. With the levels being controlled as described above, the form of the synthesized formant is changed, and the number or combination of the formant waveform signals Fj(t) is controlled.

In this case, the data stored in the formant form table 212 and in the assignment memory 213, and corresponding to the formant signals Gj(t), Fj(t), become no-operations −0 and −1. The no-operation −0 is a command that instructs the reading of data "0" from the formant form memory 52 and the no-operation −1 is a command that instructs the reading of data "1" from the formant form memory 52. Such no-operations −0 and −1 are determined in a multiplexing manner for each of the musical factors, lapse of times from the start of sounding, envelope levels and/or envelope phases like those of the formant form table 212, and are selected depending upon the musical factors or settings instructed by the operator, and are input by the operator through the panel switch groups of the performance data generator 10. Like the enable signal groups EN, the musical factors are synthesized with the formant control parameters Valj and time count data that vary depending upon the envelope data or upon the lapse of time in compliance with various operations (1) that will be described later, and the no operations −0 and −1 are modification-synthesized with the lapse of times from the start of sounding or with the envelope level in compliance with various operations (1) that will be described later.

Furthermore, the data for determining to which one of the multiple synthesis devices 635 . . . the formant signals Gj(t), Fj(t) should be input, i.e., to which channel the musical tone that is sounded should be assigned, are determined in a multiplexing manner for each of the musical factors, lapse of times from the start of sounding, envelope levels and/or envelope phases like those of the formant form table 212, and are selected depending upon the musical factors or settings instructed by the operator, and are input by the operator through the panel switch groups of the performance data generator 10. In response thereto, the program/data storage unit 21 is provided with a table of correspondence between the musical factors, lapse of times from the start of sounding, envelope levels and/or envelope phases and the assigned channels, i.e., provided with a table similar to the formant form table 212. In this table are written the data input by the operator.

The musical factors are synthesized with formant control parameters Valj and time count data that vary depending upon the envelope data or upon the lapse of time in compliance with various operations (1) that will be described later, or the data for determining the above-mentioned matters are modification-synthesized with the lapse of time from the start of sounding or with the envelope level in compliance with various operations (1) that will be described later.

Here, some of the adders 631 . . . are replaced by the multipliers and some of the multipliers 632 . . . are replaced by the adders, so that the additional synthesis and multiplicational synthesis are replaced by each other, whereby the contents of synthesis are changed, the forms of synthesized formants are changed, and the number or combination of the formant waveform signals Fj(t) is controlled. The number of stages of the multiple synthesis devices 635 . . . of FIGS. 29 and 30 can be further increased by adding adders 631 . . . or multipliers 632 . . .

A variety of modifications, changes, uses, diversions, substitutions and additions mentioned for the formant carrier signals Gj(t), formant waveform signals Fj(t), parameters Valj (ωfj(t), ωcj(t), aj(t), cj(t), dj(t), ωfjk(t), ωcjk(t), ajk(t), cjk(t), djk(t), WAD/RAD, etc.), data TD, SP, O, Min, Req, End, Ea, Ta, tables 211 and 212, and assignment memory 213 that are described above or will be described later, quite hold true directly and exclusively for the modifications, etc. of the formant carrier signals Gj(t), formant waveform signals Fj(t), parameters, tables 212 and memory 213 that are described with reference to FIGS. 18 to 32 or will be described later. This is because, the signals, parameters, data, tables and memories have the same natures and the same constitutions. The above modifications and the like are not described here in order to avoid the specification from becoming lengthy.

While the invention has been described in connection with the above embodiment, various changes and modifications of the embodiment may be made without departing from the scope and spirit of the invention. Fox example, it is possible to permit frequency modulation. In this case, a certain formant control parameter Valj is operated with respect to the cumulative formant carrier parameter ωcj(t) (Σ ωcj(t)) in the formant waveform generator 60. These operations may include all kinds of calculations (1) which will be described later in detail.

Thus, frequency modulation is possible not only on the entire formant carrier signal cos ωcj(t) or Gj(t) but also on each waveform component cos ωcj(t) thereof. In this case, the formant control parameter Valj may be multiplied on or added to the cumulative formant control parameter Σ ωfj(t) in the formant waveform generator 50. By so doing, according to the frequency modulation the formant density can be subtly changed to change the timbre.

Further, the cumulative formant density parameter Σ ωfj(t) for reading the formant waveform signal Ffj(t) in the formant waveform memory 53 may be replaced with cumulative formant carrier parameter Σ ωcj(t) corresponding to a tone pitch or the like. In this case, the formant carrier parameter ωcj(t) is supplied instead of the formant density parameter ωfj(t) to the phase operation unit 51.

Further, with respect to a single sounding operation or a single tone pitch a plurality of time division channels may be assigned simultaneously to a plurality of musical tones. Among such plurality of musical tones are left and right tone waveform data tones forming stereo positions, fundamental wave part tones and harmonic part tones, rising, intermediate and attenuating part tones from the start till the end of tone sounding, tones corresponding to the first, second and so forth formants, and so forth. In this case, the combination of formant waveform signals Ffj(t) which are of the tones with the assigned channels thereto and are read out from the formant waveform memory 53, is selected by switching according to the musical factors such as the timbre, touch, tone pitch range, etc., elapsed time from the sounding start, envelope level or envelope phase. Further instead of multiplication synthesizing the formant waveform signal Fj(t) on the formant carrier signal Gfj(t) and cos ωcj(t), it is possible to permit formant density parameter ωfj(t) corresponding to a designated pitch to be provided for directly outputting the formant waveform signal Fj(t) as musical tone.

It is possible to use fluctuations (wavering, swings, sways) data FL from a fluctuation data memory or frequency or amplitude modulation data FM2 to FM3, SFM, AM1 to AM3 or SAM described in specification U.S. patent application Ser. No. 08/172,146 (Japan Patent Application Serial No. 04-230136 and 04-346063) as the parameter values Valj (ωfj(t), ωcj(t), aj(t), cj(t), ωcjk(t), ajk(t), dj(t)), ωcjk(t), ajk(t) and cj(t).

The above parameter storage 41 (i.e., parameter memory 411), formant density storage unit 52 (i.e., formant density memory 523) and formant waveform memory 53, may be combined into a single memory or two memories, for time division reading and writing of each data. Such combined memory may include the phase shift register 61, cos table 63, accumulation memory 74, group memory 71, program/data storage 21, etc. All the processes of addition and subtraction and additive synthesis described above mean biasing, and all the processes of multiplication and division and multiplication synthesis mean weighting.

The formant waveform signal Ffj(t) stored in the formant waveform memory 53 or the formant carrier signal Gj(t) stored in the formant waveform control unit 60 may represent time-wise part sound, envelope part sound or band-wise part sound. The time-wise part sound is one of sounds corresponding to a rising (attack), a subsequent-to-rising and an attenuating (release) part of a musical tone. The envelope part sound is one of attack, decay, sustain and release parts of a musical tone. The bandwise part sound is one of a low, an intermediate and a high pitch range parts of a musical tone, and these part sounds may be overlapped each other.

For the time-wise part sound, the read start moment is determined according to the elapsed time from the start of sounding. For the envelope part sound, it is determined according to the envelope phase. For the band-wise part sound, it is determined according to the envelope level or musical factor.

Further, the multiplication or division process or multiplication process by the multiplier may be replaced with an addition or subtraction process or an additive processes. In this case, the signal, data or parameter to be multiplied or divided is converted by a logarithmic converter or into a logarithmic value from the instant of generation, then added in an adder and then inversely converted in an exponential converter.

It is possible to process the formant control parameter Valj indicative of the elapsed time from the sounding start, cumulative formant density parameter Σ ωfj(t), cumulative formant carrier parameter Σ ωcj(t) or time count data for synthesis with the cumulative formant carrier parameter Σ ωcj(t) (Σ ωcjk(t)) in the formant waveform generator 60 or weighting interpolation circuit 80 in FIGS. 15, 19, 21 and 24, formant carrier parameter ωcj(t) (ωcjk(t)) (comparative data), formant control parameter aj(t) or cj(t) (ajk(t) or cjk(t)), cumulative formant density parameter Σ ωfj(t) (Σ fjk(t)) shown in FIG. 10, formant density parameter ωfj(t) (ωfjk(t)), formant control parameter dj(t) (djk(t)) or speed data SP.

Further, the values of the parameters ωcj(t), ωfj(t), aj(t), cj(t) (ωcjk(t), ajk(t), dj(t)), ωcjk(t), ajk(t) and cj(t), data Ta, Ea, SP, O and Min, etc. in the moment of sound starting, may be stored, and after the lapse of a certain time from the start of sounding the data indicative of the elapsed time from the sounding start or envelope data may be synthesized with the value of the parameter ωcj(t) or the like. This operation and synthesis may be synthesis including all kinds of calculations (1) which will be described later in detail.

In this case, the data indicative of the elapsed time from the start of sounding or envelope level data may be converted to weighted data and the weighted data may be synthesized in the above operation and synthesis. Alternatively, weighted data stored in a table may be read out according to the elapsed time data or envelope data as address data, and the elapsed time from the start of sounding or envelope level data is converted and operated to weighted data. The weighted data may be fixed or variable and may take either positive or negative values.

Further, of each parameter ωcj(t) or the like that is stored for each musical factor, only a typical value may be stored while other values are stored as comparative data or differential data with respect to the typical value, and at the time of reading the comparative or differential data may be operated on the typical value.

In the channel memory areas of the assignment memory 213 can be stored all of the aforementioned data, parameters, various musical factors, and elapsed time of sounding except the data shown in FIG. 26. These data are read out and are sent by the controller 20 and the like for each of the channel timings. In this case, the musical factors and the elapsed time of sounding are converted through the tables 211 and 212, . . . and are output. The above-mentioned tone pitch data further include data which indicate whether the sounding is instructed by the upper keyboard, lower keyboard or foot keyboard.

Moreover, the data generated from each of the portions of the above-mentioned circuits may be once stored in a memory for each of the musical factors, lapse of times from the start of sounding, envelope levels, envelope phases and/or settings instructed by the operator. The data that are read out are input to the circuits subsequent to the portions where the data are generated. The data can be once stored, for example, at the output terminals of the adders 612, 65 and of the multipliers 66, 67 of FIG. 19.

"A variety of operations (1) described later" mentioned above include addition or subtraction of the data through the adders, multiplication or division of the data through the multipliers, combination of the above operations through the adders and multipliers, other additional operations of the data, other multiplicational operations of the data, bit-shift operation of the data by some data through the data shifters, synthesis operation in which some data become high-order data and other data become low-order data, operation of the data based upon an operation equation by an arithmetic circuit or the like circuit, and reading of operation data by storing the data that are operated in the memory and by using the data as read address data. "A variety of operations (2) described later" mentioned above include addition or subtraction of other data through the adders, multiplication or subtraction by other data through the multipliers, combination of the above operations through the adders and the multipliers, other additional operations with other data, other multiplicational operations with other data, bit-shift operation of the data by other data through the data shifters, synthesis operation for adding other data to the high-order data or to the low-order data, operation of the data based upon an operation equation by an arithmetic circuit or the like circuit, and reading of operation data by storing the operated data in the memory and using the data as read address data *5n*.

What is claimed is:

1. An apparatus for generating musical tones comprising:

formant waveform signal generating means for generating at least one formant waveform signal having a waveform obtained by synthesizing frequency components of a formant of a musical tone;

component waveform generating means for generating component waveforms as formant center signals for synthesis as center signals with the formant waveform signal generated by said formant waveform signal generating means;

amplitude coefficient generating means for generating amplitude coefficients for the component waveforms generated by said component waveform generating means;

operation means for operating the amplitude coefficients generated by said amplitude coefficient generating means upon corresponding component waveforms generated by said component waveform generating means;

formant center signal generating means for synthesizing the component waveforms upon which the amplitude coefficients are operated on by said operation means and for outputting the synthesized component waveforms as at least one synthesized formant center signal; and synthesizing means for synthesizing the formant waveform signal generated by said formant waveform signal generating means with the synthesized formant center signal generated by said formant center signal generating means to generate musical tones.

2. An apparatus for generating musical tones comprising:

component waveform generating means for generating component waveforms as formant waveform signals having waveforms obtained by synthesizing frequency components of a formant of a musical tone;

amplitude coefficient generating means for generating amplitude coefficients for the component waveforms generated by said component waveform generating means;

operation means for operating the amplitude coefficients generated by said amplitude coefficient generating means upon corresponding component waveforms generated by said component waveform generating means;

formant waveform signal generating means for synthesizing the component waveforms upon which the amplitude coefficients are operated on by said operation means and for outputting the synthesized component waveforms as at least one synthesized formant waveform signal;

formant center signal generating means for generating at least one formant center signal for synthesis with the synthesized formant waveform signals generated by said formant waveform signal generating means; and synthesizing means for synthesizing the synthesized formant waveform signal generated by said formant waveform signal generating means with the formant center signal generated by said formant center signal generating means to generate musical tones.

3. The apparatus for generating musical tones according to claim 1, wherein a frequency of a fundamental wave among the component waveforms generated by said component waveform generating means varies depending upon tone pitch of a musical tone synthesized by said synthesizing means.

4. The apparatus for generating musical tones according to claim 2, wherein a frequency of formant center signals generated by said formant center signal generating means varies depending upon tone pitch of a musical tone synthesized by said synthesizing means.

5. The apparatus for generating musical tones according to claim 1 or 2, wherein said component waveform generating means determines contents of the component waveforms, frequency of the component waveforms and density of frequency components of a formant of the component waveforms depending upon at least one of musical factors that are generated, lapse of time from a start of sounding of a musical tone, envelope levels that are generated, envelope phase and setting instructed by an operator.

6. The apparatus for generating musical tones according to claim 5, wherein said musical factors vary depending upon the lapse of time, the envelope levels or the envelope phase.

7. The apparatus for generating musical tones according to claim 1 or 2, wherein said amplitude coefficient generating means determines magnitudes of the amplitude coefficients depending upon at least one of musical factors that are generated, lapse of time from a start of sounding of a musical tone, envelope levels that are generated, envelope phase and setting instructed by an operator.

8. The apparatus for generating musical tones according to claim 7, wherein said musical factors vary depending upon the lapse of time, the envelope levels or the envelope phase.

9. The apparatus for generating musical tones according to claim 1 or 2, wherein said operation means determines content of operation depending upon at least one of musical factors that are generated, lapse of time from a start of sounding of a musical tone, envelope levels that are generated, envelope phase and setting instructed by an operator.

10. The apparatus for generating musical tones according to claim 9, wherein said musical factors vary depending upon the lapse of time, the envelope levels and the envelope phase.

11. The apparatus for generating musical tones according to claim 1 or 2, wherein a number of at least one of said formant waveform signals and said formant center signals are plural in instructing sounding of a musical tone.

12. The apparatus for generating musical tones according to claim 1 or 2, wherein said component waveform generating means, said amplitude coefficient generating means, said operation means, said formant center signal generating means, said formant waveform signal generating means and said synthesizing means execute processings for a plurality of signals or a plurality of component waveforms respectively in a time-divisional manner.

13. The apparatus for generating musical tones according to claim 1, wherein said formant waveform signal generating means comprises:

component waveform generation means for generating component waveforms of a formant waveform signal;

amplitude coefficient generation means for generating amplitude coefficients for the component waveforms generated by said component waveform generation means;

operating means for operating the amplitude coefficients generated by said amplitude coefficient generation means upon the corresponding component waveforms generated by said component waveform generation means; and formant waveform signal output means for synthesizing and outputting the component waveforms upon which the amplitude coefficients are operated on as the at least one formant waveform signal.

14. An apparatus for generating musical tones comprising:

formant waveform signal generating means for generating a plurality of formant waveform signals having a waveform obtained by synthesizing frequency components of a formant of a musical tone;

formant center signal generating means for generating at least one formant center signal for synthesis with the formant waveform signals generated by said formant waveform signal generating means;

synthesizing means for synthesizing the at least one formant center signal generated by said formant center signal generating means with a formant waveform signal generated by said formant waveform signal generating means;

musical factor generating means for generating at least one of a musical factor, envelope level, envelope phase, lapse of time from a start of a sounding of a musical tone and setting instructed by an operator;

change detecting means for detecting change in the musical factor, the envelope level, the envelope phase, the lapse of time and the setting generated by said musical factor generating means;

changing means for changing waveforms of signals generated by at least one of said formant waveform signal generating means, said formant center signal generating means and said synthesizing means depending upon changes in the musical factor, the envelope level, the envelope phase, the lapse of time and the setting detected by said change detecting means;

weighting means for weighting the generated signals before the generated signals are changed by said changing means and for weighting the changed signals;

interpolation means for interpolating both of the weighted signals that are weighted by said weighting means; and weight changing means for determining a section of both of the weighted signals to be interpolated by said interpolation means and for changing the weight of said weighting means from one side of the section to the other side for both of the weighted signals from a start of said determined section toward an and thereof.

15. The apparatus for generating musical tones according to claim 14, wherein the musical factor generated by said musical factor generating means include timbre, touch, tone pitch, tone pitch range, musical tone part, volume of sound, sound image, filter characteristic and effect.

16. The apparatus for generating musical tones according to claim 14, wherein said weighting means comprises:

before change storage means for storing the generated signals before the generated signals are changed by said changing means;

after change storage means for storing the changed signals;

before change writing means and after change writing means for respectively writing the generated signals before the generated signals are changed and the changed signals into said before change storage means and said after change storage means;

before change reading means and after change reading means for respectively reading the stored signals from said before change storage means and said after change storage means; and weight means for weighting the stored signals that are read out by said before change and after change reading means.

17. The apparatus for generating musical tones according to claim 14, wherein said weighting means comprises:

storage/shift means for receiving and storing the changed signals that are changed by said changing means and for outputting the changed signals in a sequentially shifted manner; and weight means for weight the signals output from said storage/shift means before the signals are changed and the changed signals after being changed by said changing means and input to said storage/shift means.

18. The apparatus for generating musical tones according to claim 16, wherein said before change storage means and said after change storage means, respectively, store signals of a plurality of cycles which contain component waveforms of harmonic waves of non-integral ratios, the signals of the plurality of cycles being corrected in phase with respect to each other at the head portions and at end portions thereof.

19. The apparatus for generating musical tones according to claim 18, wherein the signals of a plurality of cycles stored in said before change storage means and in said after change storage means have different phases, one of said before change reading means and said after change reading means comprising:

correction data generating means for generating correction data for correcting the phase difference; and correction means for correcting reading speed based upon the correction data.

20. The apparatus for generating musical tones according to claim 16, comprising at least three storage means for respectively storing the changed signals, the generated signals before the generated signals are changed, and generated signals generated before the changed signals, respectively, and while the changed signals are being written, the generated signals before the generated signals are changed and the generated signals generated before the changed signals are read out and are interpolated.

21. The apparatus for generating musical tones according to claim 14, wherein said interpolation means effects interpolation by additionally synthesizing both of the weighted signals.

22. The apparatus for generating musical tones according to claim 14, wherein at least one of said formant waveform signal generating means, formant center signal generating means and synthesizing means execute processings for a plurality of signals or component waveforms in a time-divisional manner.

23. The apparatus for generating musical tones according to claim 14, wherein a frequency of the at least one formant center signal determines tone pitch of a musical tone that is synthesized.

24. The apparatus for generating musical tones according to claim 15, wherein the musical factor changes depending upon either one of lapse of time and envelope data.

25. An apparatus for generating musical tones comprising:

formant waveform signal generating means for generating a plurality of formant waveform signals having a waveform obtained by synthesizing frequency components of a formant of a musical tone;

formant center signal generating means for generating at least one formant center signal for synthesis with the formant waveform signals generated by said formant waveform signal generating means;

synthesizing means for synthesizing the at least one formant center signal generated by said formant center signal generating means with the formant waveform signals generated by said formant waveform signal generating means;

musical factor generating means for generating at least one of a musical factor and setting instructed by an operator;

number determining means for determining at least one of a number and a combination of formant waveform signals generated by said formant waveform signal generating means depending upon the musical factor and the setting generated by said musical factor generating means; and formant waveform signal control means for respectively controlling the number and the combination of the formant waveform signals generated by said formant waveform signal generating means depending upon the number and the combination determined by said number determining means.

26. An apparatus for generating musical tones comprising:

a formant waveform signal generating means for generating a plurality of formant waveform signals having a waveform obtained by synthesizing frequency components of a formant of a musical tone;

formant center signal generating means for generating at least one formant center signal for synthesis with the formant waveform signals generated by said formant waveform signal generating means;

synthesizing means for synthesizing the at least one formant center signal generated by said formant center signal generating means with the formant waveform signals generated by said formant waveform signal generating means;

lapse-of-time generating means for determining a lapse of time from a start of sounding of a musical tone;

number determining means for determining at least one of a number and a combination of formant waveform signals generated by said formant waveform signal generating means depending upon the lapse of time determined by said lapse-of-time generating means; and formant waveform signal control means for respectively controlling the number and the combination of the formant waveform signals generated by said formant waveform signal generating means depending upon the number and the combination determined by said number determining means.

27. An apparatus for generating musical tones comprising:

formant waveform signal generating means for generating a plurality of formant waveform signals having a waveform obtained by synthesizing frequency components of a formant of a musical tone;

formant center signal generating means for generating at least one formant center signal for synthesis with the formant waveform signals generated by said formant waveform signal generating means;

synthesizing means for synthesizing the at least one formant center signal generated by said formant center signal generating means with the formant waveform signals generated by said formant waveform signal generating means;

envelope generating means for generating data that represents one of an envelope level and an envelope phase of a musical tone;

number determining means for determining at least one of a number and a combination of formant waveform signals generated by said formant waveform signal generating means depending upon the envelope level or the envelope phase generated by said envelope generating means; and formant waveform signal control means for respectively controlling the number and the combination of the formant waveform signals generated by said formant waveform signal generating means depending upon the number and the combination determined by said number determining means.

28. The apparatus for generating musical tones according to claim 25, 26 or 27, wherein the number of formant waveform signals controlled by said formant waveform signal control means is a number of formant waveform signals obtained by reading a stored formant waveform signal at a plurality of reading speeds.

29. The apparatus for generating musical tones according to claim 25, 26 or 27, wherein the formant waveform signals of which at least one of the number and the combination is controlled by said formant waveform control signal means are synthesized with a single formant center signal generated by said formant center signal generating means.

30. The apparatus for generating musical tones according to claim 25, 26 or 27, wherein the formant waveform signals of which at least one of the number and combination is controlled by said formant waveform control signal means are synthesized with a plurality of formant center signals which are generated by said formant center signal generating means and have nearly the same timing as starting times of soundings of musical tones.

31. The apparatus for generating musical tones according to claim 25, 26 or 27, wherein said formant waveform signal generating means of which at least one of the number and the combination of the formant waveform signals is controlled by said formant waveform signal control means comprises a plurality of music tone generating systems for generating a plurality of musical tones in parallel.

32. The apparatus for generating musical tones according to claim 31, wherein said plurality of musical tone generating systems are formed in a single circuit as channels by time-divisional processing, and musical tones synthesized from the formant waveform signals and the at least one formant center signal are assigned to each of said channels.

33. The apparatus for generating musical tones according to claim 31, wherein said plurality of musical tone generating systems are formed in a plurality of circuits, and musical tones synthesized from the formant waveform signals and the at least one formant center signal are assigned to each of said circuits.

34. The apparatus for generating musical tones according to claim 25, 26 or 27, wherein a plurality of formant waveform signals which are generated by said formant waveform signal generating means and of which at least one of the number and the combination is controlled by said formant waveform signal control means, are additionally synthesized by said synthesizing means, and the thus synthesized formant waveform signals are multiplicationally synthesized with a single formant center signal generated by said formant center signal generating means.

35. The apparatus for generating musical tones according to claim 25, 26 or 27, wherein the formant waveform signals generated by said formant waveform signal generating means and of which at least one of the number and the combination is controlled by said formant waveform signal control means, are multiplicationally synthesized with the at least one formant center signal generated by said formant center signal generating means, and the thus synthesized signals are further multiplicationally synthesized with the at least one formant center signal generated by said formant center signal generating means.

36. The apparatus for generating musical tones according to claim 25, 26 or 27, wherein the formant waveform signals generated by said formant waveform signal generating means and of which at least one of the number and the combination is controlled by said formant waveform signal control means, are multiplicationally synthesized with the at least one formant center signal generated by said formant center signal generating means, and the thus synthesized signals are multiplicationally synthesized with each other.

37. The apparatus for generating musical tones according to claim 34, wherein the synthesis by said synthesizing means is one in which the additional synthesis is entirely replaced by the multiplicational synthesis.

38. An apparatus for generating musical tones comprising:

formant waveform signal generating means for generating a plurality of formant waveform signals having a waveform obtained by synthesizing frequency components of a formant of a musical tone;

formant center signal generating means for generating at least one formant center signal for synthesis with the formant waveform signals generated by said formant waveform signal generating means;

first additionally synthesizing means for additionally synthesizing either the at least one formant center signal generated by said formant center signal generating means or the formant waveform signals generated by said formant waveform signal generating means;

first multiplicationally synthesizing means for multiplicationally synthesizing either the at least one formant center signal generated by said formant center signal generating means or the formant waveform signals generated by said formant waveform signal generating means;

second additionally synthesizing means for additionally synthesizing the signals that are additionally synthesized by said first additionally synthesizing means with the signals that are multiplicationally synthesized by said first multiplicationally synthesizing means, or for additionally synthesizing the additionally synthesized signals synthesized by said first additionally synthesizing means or the multiplicationally synthesized signals with the at least one formant center signal generated by said formant center signal generating means or the formant waveform signals generated by said formant waveform signal generating means; and second multiplicationally synthesizing means for multiplicationally synthesizing the signals that are additionally synthesized by said first additionally synthesizing means with the signals that are multiplicationally synthesized by said first multiplicationally synthesizing means, or for multiplicationally synthesizing the additionally synthesized signals synthesized by said first additionally synthesizing means or the multiplicationally synthesized signals with the at least one formant center signal generated by said formant center signal generating means or the formant waveform signals generated by said formant waveform signal generating means.

39. The apparatus for generating musical tones according to claim 38, wherein said first additionally synthesizing means and said first multiplicationally synthesizing means respectfully synthesize a plurality of formant center signals additionally and multiplicationally, or respectfully synthesize a plurality of formant waveform signals additionally and multiplicationally.

40. The apparatus for generating musical tones according to claim 38, further comprising combination selection means for selecting a combination of signals that are synthesized in said first additionally synthesizing means, in said first multiplicationally synthesizing means, in said second additionally synthesizing means and In said second muliplicationally synthesizing means.

41. The apparatus for generating musical tones according to claim 40, wherein said combination selection means determines the combination of signals to be synthesized relying upon at least one of musical factors that are generated, a lapse of time from a start of a sounding of a musical tone, a generated envelope level, a generated envelope phase and data input by an operator.

42. The apparatus for generating musical tones according to claim 38, wherein the additionally synthesized signals or the multiplicationally synthesized signals respectively output from said second additionally synthesizing means and said second multiplicationally synthesizing means are fed as formant waveform signals or formant center signals back to said first additionally synthesizing means and said first multiplicationally synthesizing means.

43. The apparatus for generating musical tones according to claim 38, wherein the additionally synthesized signals or the multiplicationally synthesized signals output from said first additionally synthesizing means, said first multiplicationally synthesizing means, said second additionally synthesizing means or said second multiplicationally synthesizing means are fed back again to the corresponding synthesizing means that have outputted the signals.

44. The apparatus for generating musical tones according to claim 40, wherein said first additionally synthesizing means and said second additionally synthesizing means are formed by the same means relying upon time-divisional processing, or said first multiplicationally synthesizing means and said second multiplicationally synthesizing means are formed by the same means relying upon time-divisional processing.

45. The apparatus for generating musical tones according to claim 44, wherein said combination selection means determines a combination of signals to be synthesized by determining a time-serial combination of said first and second additionally synthesizing means or said first and second multiplicationally synthesizing means formed by the same means.

46. The apparatus for generating musical tones according to claim 25 or 38, wherein the frequency of the at least one formant center signal determines a tone pitch of a musical tone that is synthesized.

47. The apparatus for generating musical tones according to claim 25, wherein the musical factor generated by said musical factor generating means includes timbre, touch, tone pitch, tone pitch range, musical tone part, volume of sound, sound image, filter characteristic and effect, and can be further set depending upon settings instructed by an operator.

48. The apparatus for generating musical tones according to claim 47, wherein the musical factor changes depending upon a lapse of time or envelope data.

* * * * *